US010561906B2

(12) United States Patent
Zarda, Jr.

(10) Patent No.: US 10,561,906 B2
(45) Date of Patent: Feb. 18, 2020

(54) TENNIS RACQUET WITH ADJUSTABLE FRAME ISOLATION

(71) Applicant: Paul Richard Zarda, Jr., Winter Springs, FL (US)

(72) Inventor: Paul Richard Zarda, Jr., Winter Springs, FL (US)

( * ) Notice: Subject to any disclaimer, the term of this patent is extended or adjusted under 35 U.S.C. 154(b) by 0 days.

(21) Appl. No.: 16/529,449

(22) Filed: Aug. 1, 2019

(65) Prior Publication Data

US 2019/0374821 A1 Dec. 12, 2019

Related U.S. Application Data

(63) Continuation of application No. 15/961,187, filed on Apr. 24, 2018, now Pat. No. 10,369,424, which is a (Continued)

(51) Int. Cl.
*A63B 49/038* (2015.01)
*A63B 60/52* (2015.01)
(Continued)

(52) U.S. Cl.
CPC ..... *A63B 49/038* (2015.10); *A63B 49/028* (2015.10); *A63B 60/42* (2015.10);
(Continued)

(58) Field of Classification Search
CPC ..... A63B 49/02; A63B 51/00; A63B 51/06
See application file for complete search history.

(56) References Cited

U.S. PATENT DOCUMENTS 3,707,288 A 12/1972 Edlefsen
3,843,121 A 10/1974 Edlefsen
(Continued)

FOREIGN PATENT DOCUMENTS

DE 2116920 10/1972
DE 2725471 12/1977
(Continued)

OTHER PUBLICATIONS

Lindsey, C., "Ball spin testing vs simple simulation model", Internet article: http://twu.tennis-warehouse.com/learning_center/spinexperiment.php, retrieved Jun. 1, 2018 (Apr. 2010).
(Continued)

*Primary Examiner* — Eugene L Kim
*Assistant Examiner* — Christopher Glenn
(74) *Attorney, Agent, or Firm* — McHale & Slavin, P.A.

(57) ABSTRACT

The present invention is directed to a racquet design with an inner and outer frame connected by an isolation system. Uniquely adapted to tennis racquets, the natural motion of the inner frame relative to the outer frame upon impact of the tennis ball on the inner frame will generate spin when the ball contacts the inner frame. The relationship between the inner frame, outer frame and isolation system can control the spin imparted to the ball for a given tennis swing. The tuning of the isolators relative to conventional racquet characteristics will increase the amount of ball spin caused by conventional racquets. The invention also increases the accuracy of the tennis ball's trajectory.

11 Claims, 65 Drawing Sheets

Related U.S. Application Data continuation of application No. 14/210,614, filed on Mar. 14, 2014, now Pat. No. 9,975,009.

(60) Provisional application No. 61/801,852, filed on Mar. 15, 2013, provisional application No. 61/939,725, filed on Feb. 13, 2014.

(51) Int. Cl.

| | |
|---|---|
| ***A63B 49/028*** | (2015.01) |
| ***A63B 60/42*** | (2015.01) |
| ***A63B 49/02*** | (2015.01) |
| ***A63B 102/02*** | (2015.01) |
| ***A63B 60/54*** | (2015.01) |

(52) U.S. Cl.

CPC ..... *A63B 60/52* (2015.10); *A63B 60/54* (2015.10); *A63B 2049/0214* (2015.10); *A63B 2049/0217* (2013.01); *A63B 2102/02* (2015.10)

(56) References Cited

U.S. PATENT DOCUMENTS

| | | | | |
|---|---|---|---|---|
| 3,891,211 | A | 6/1975 | Diefenbach | |
| 4,124,209 | A | 11/1978 | DiLeo | |
| 4,135,717 | A | 1/1979 | DiLeo | |
| 4,139,194 | A | 2/1979 | Fischer | |
| 4,185,822 | A | 1/1980 | Li | |
| 4,190,249 | A | 2/1980 | Fischer | |
| 4,231,575 | A | 11/1980 | Kutt et al. | |
| 4,249,731 | A | 2/1981 | Amster | |
| 4,274,634 | A | 6/1981 | Berluti | |
| 4,299,385 | A | 11/1981 | Boden | |
| 4,357,012 | A * | 11/1982 | Maynard | A63B 60/10 473/532 |
| 4,458,898 | A | 7/1984 | Boden | |
| 4,488,722 | A | 12/1984 | Harz | |
| 4,655,455 | A | 4/1987 | Kurusu | |
| 4,681,319 | A | 7/1987 | Zilinskas | |
| 4,685,676 | A | 8/1987 | Boden | |
| 4,772,021 | A | 9/1988 | Maynard | |
| 4,804,183 | A | 2/1989 | Doran et al. | |
| 5,002,278 | A | 3/1991 | Costa | |
| 5,178,388 | A * | 1/1993 | Schlenker | A63B 49/02 473/521 |
| 5,310,179 | A | 5/1994 | Takatsuka | |
| 5,413,335 | A * | 5/1995 | Braun | A63B 49/038 473/521 |
| 5,458,331 | A | 10/1995 | Bothwell | |
| 5,649,702 | A * | 7/1997 | Janes | A63B 49/02 473/537 |
| 6,663,516 | B2 | 12/2003 | Severa et al. | |
| 6,840,874 | B2 | 1/2005 | Severa et al. | |
| 7,297,080 | B2 | 11/2007 | Severa et al. | |
| 8,192,308 | B2 | 6/2012 | DeMasi | |
| 9,975,009 | B2 | 5/2018 | Zarda, Jr. | |
| 2007/0087871 | A1 * | 4/2007 | Giannantonio | A63B 51/06 473/532 |

FOREIGN PATENT DOCUMENTS

| | | |
|---|---|---|
| EP | 0455885 | 11/1991 |
| FR | 2373302 | 2/1982 |

OTHER PUBLICATIONS

Zarda, P. et al, "The Zarda spin control system (Z-SCS) and Z-SCS racquet concepts", Wilson Sporting Goods presentation, (Nov. 2013).

Zarda, P., "Tennis racquets & stringing topics to better understand racquet loads, stresses & related issues", presented at International Alliance of Racquet Technicians, (Sep. 2013).

Cross, R., "Why you sometimes hit the ball out", Internet article: http://twu.tennis-warehouse.com/learning_center/index.php, pp. 4-10, retrieved Jun. 1, 2018.

Brody, H., "Unforced errors and error reduction in tennis", Br J Sports Med, vol. 40, pp. 397-400, (2006).

Cross, R., "The inch that changed tennis forever", Tennis Industry magazine, Internet article: http://www.tennisindustrymag.com/articles/2006/01/the_inch_that_changed_tennis_forever_f.html, retrieved Sep. 24, 2019.

Speckman, J., "The new physics of tennis", The Atlantic, Internet article: https://www.theatlantic.com/magazine/archive/2011/01/the-new-physics-of-tennis/308339, retrieved Jun. 1, 2018, (Jan./Feb. 2011).

Lindsey, C., "Static friction and spin", Tennis Warehouse University, Internet article: http://twu.tennis-warehouse.com/learning_center/COF.php, retrieved Sep. 24, 2019).

* cited by examiner

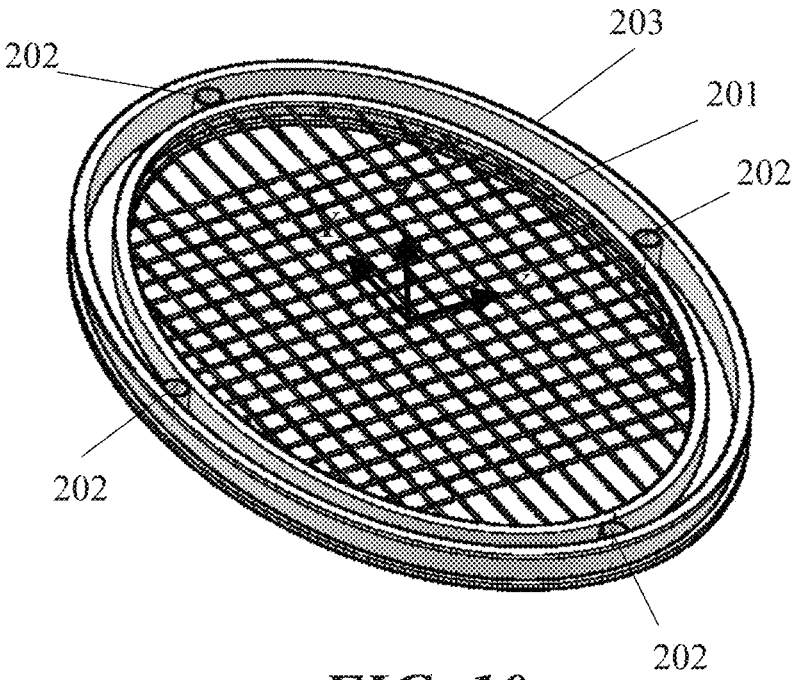
FIG. 10
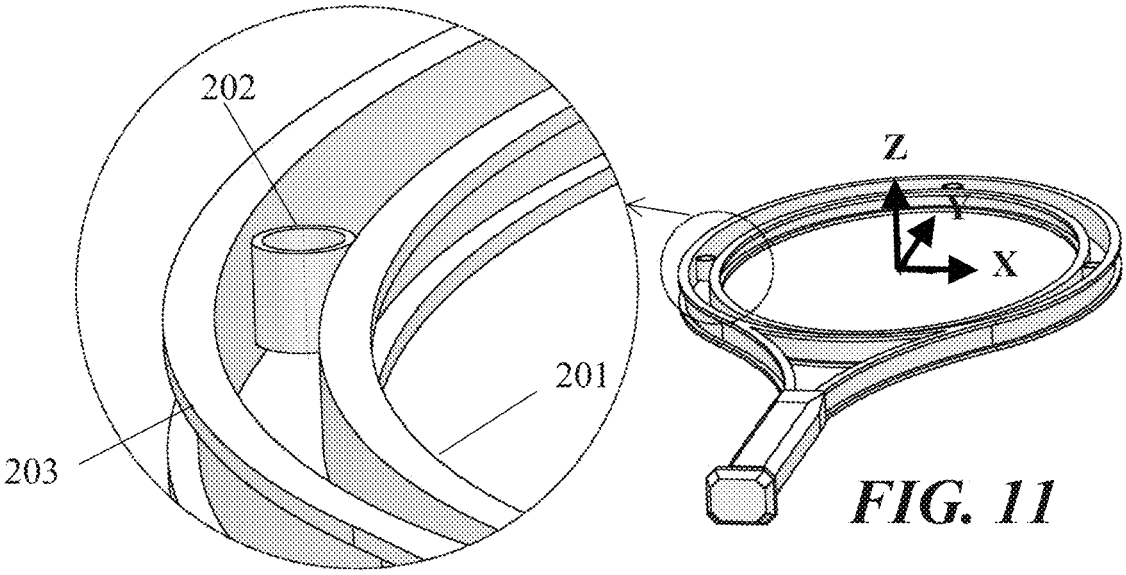
FIG. 11
FIG. 12

FIG. 18
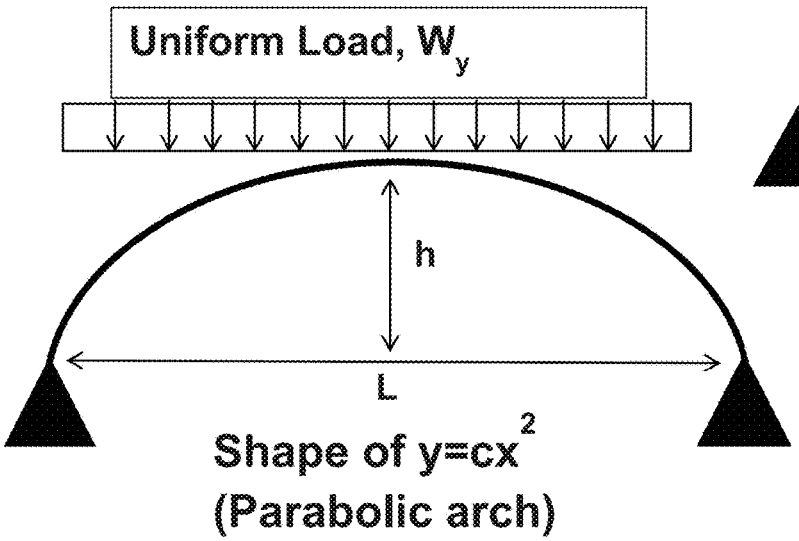
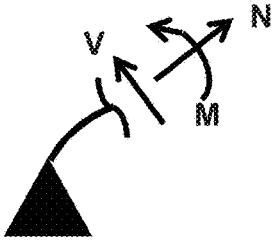
FIG. 19
a = minor dimension
b = major dimension
$W_x$ = cross strings load/unit length
$W_y$ = main strings load/unit length
$T_x$ = Cross string tension
$T_y$ = Main string tension
$n_x$ = # of cross strings at Tx tension
$n_y$ = # of main strings at Ty tension
FIG. 20
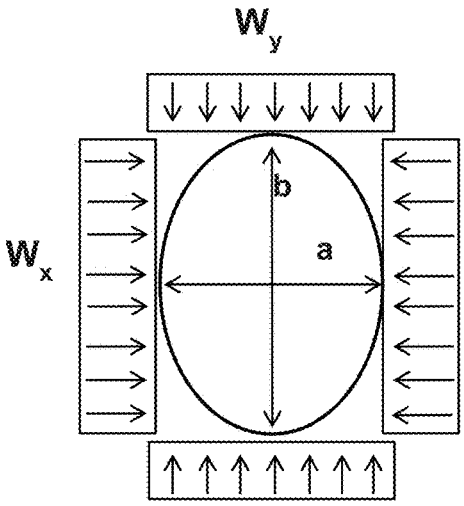
FIG. 21

For M & V = 0 (minimum stress, minimum deflections, minimum weight), it requires:

1) Frame shape = ellipse

2) $W_x = (a/b)^2 W_y$ Equation 1

3) $T_x = (a/b)(n_y/n_x)T_y$ (Key Stringing Requirement) Equation 2

| Racquet Head Shape b x a (inches) (FIG. 404) | Main Strings | | Cross Strings | |
|---|---|---|---|---|
| | # Main Strings | Tension Ty (lbs) | # Cross Strings | Tension Tx (lbs) |
| Circular Head 11 x 11 | 17 | 60 | 17 | 60 |
| Badminton Head 9.5 x 8 | 16 | 60 | 19 | 42.5 |
| Davis Classic 11 x 9 | 16 | 60 | 19 | 41.1 |
| Wilson 13 x 10 | 16 | 60 | 19 | 38.9 |

*FIG. 22*

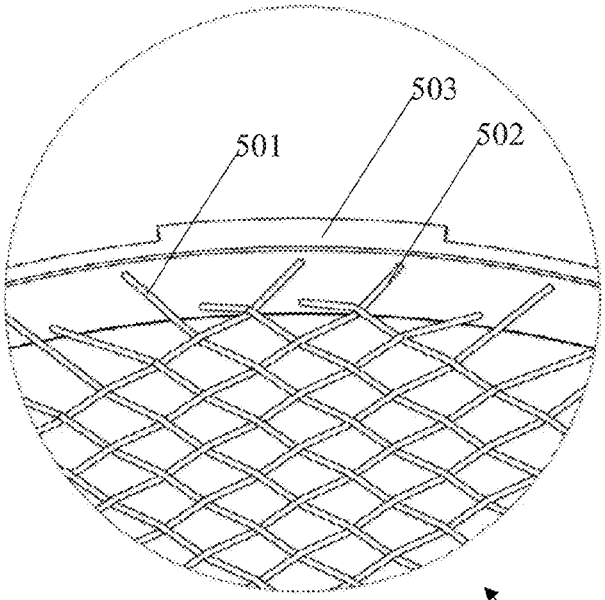
FIG. 24
FIG. 23
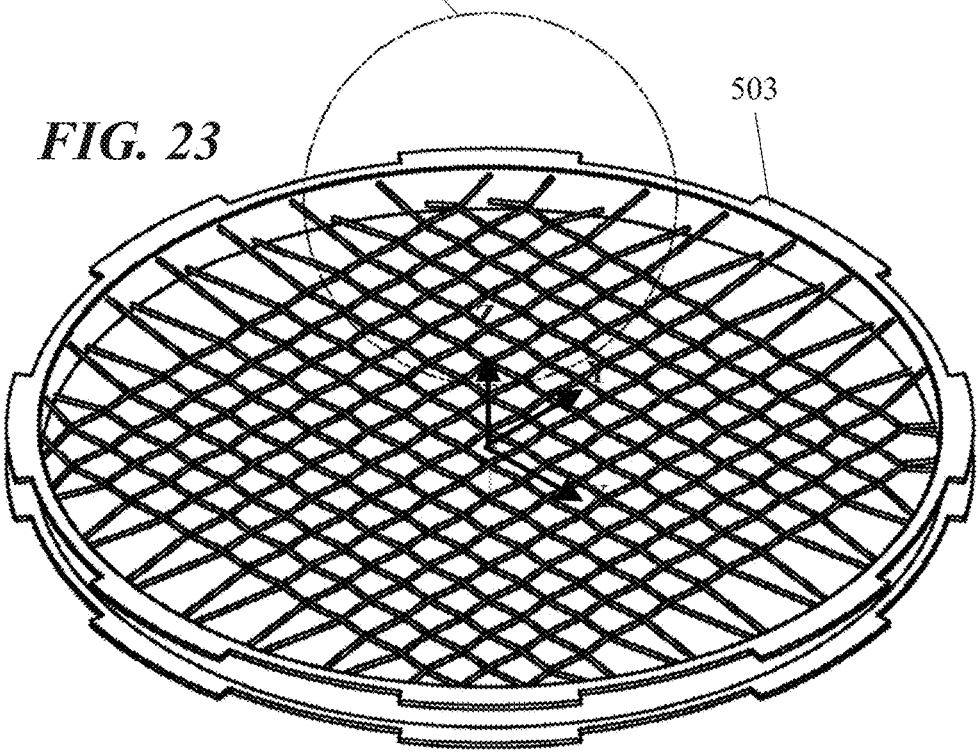

View A-A from FIG. 25

FIG. 29
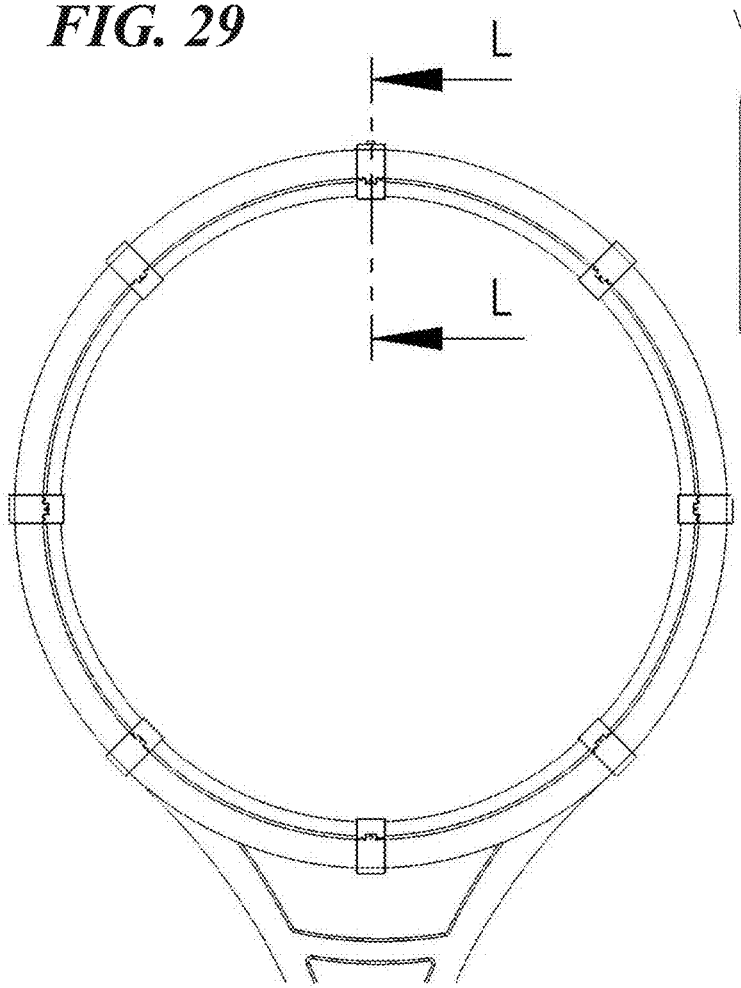
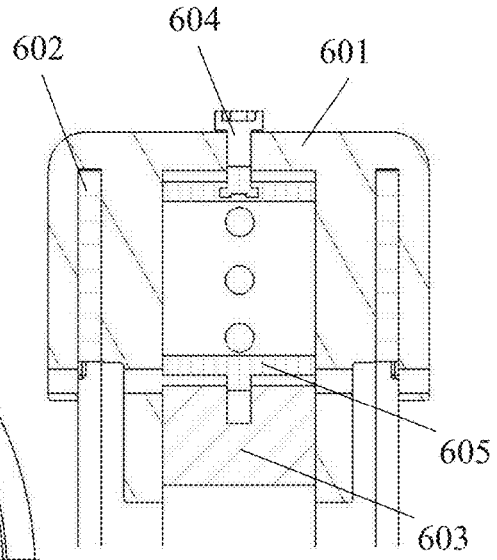
FIG. 30
View at L-L in FIG. 29

*FIG. 34*
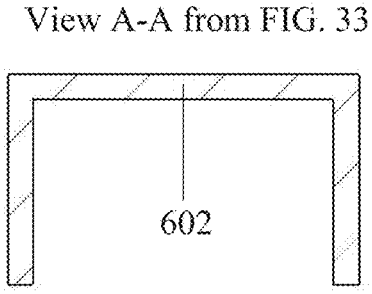
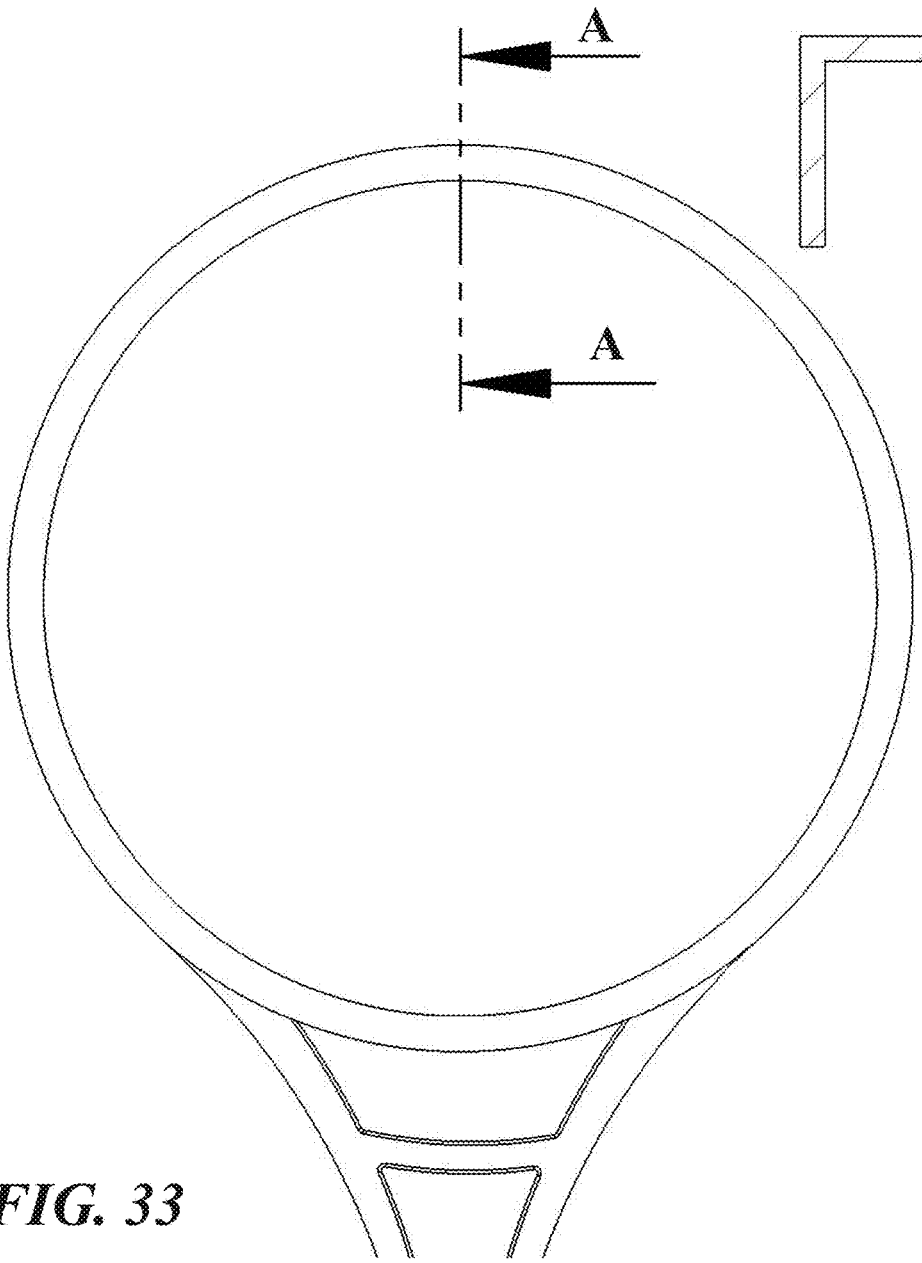
*FIG. 33*

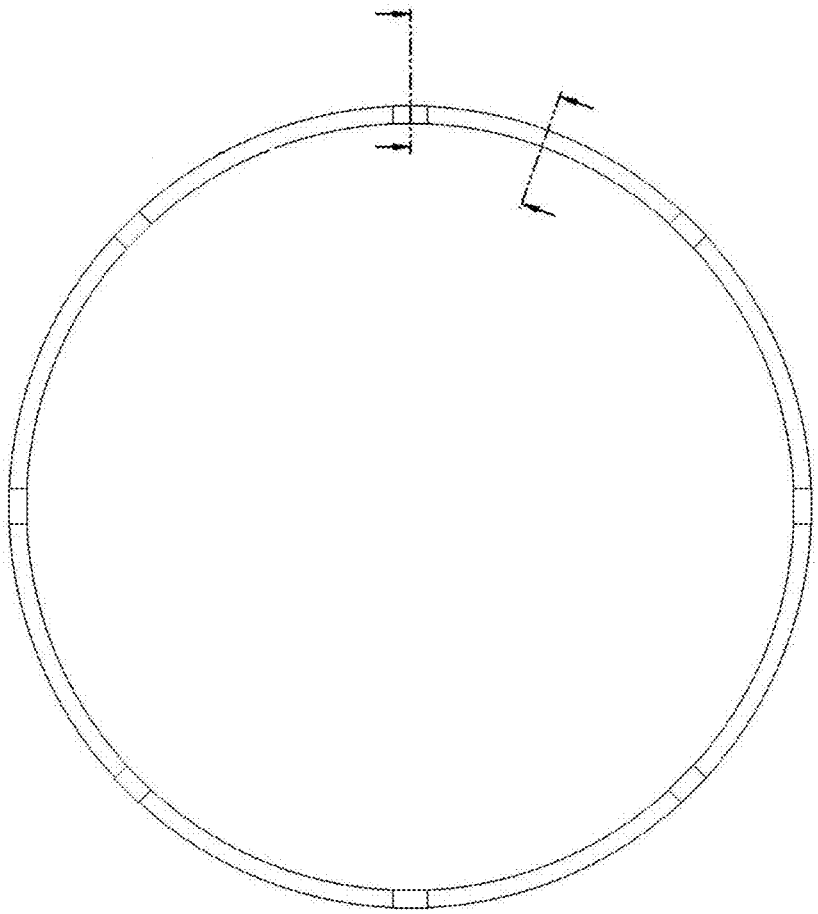
*FIG. 37*
*FIG. 38*
View A-A from FIG. 37
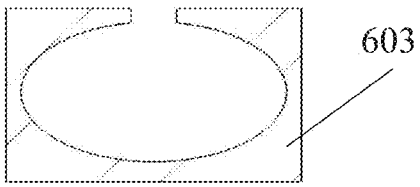
*FIG. 39*
View B-B from FIG. 37
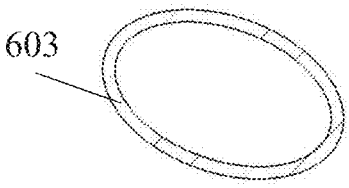

702
706
705
704
701

Y
Z
X
703
707
703

701

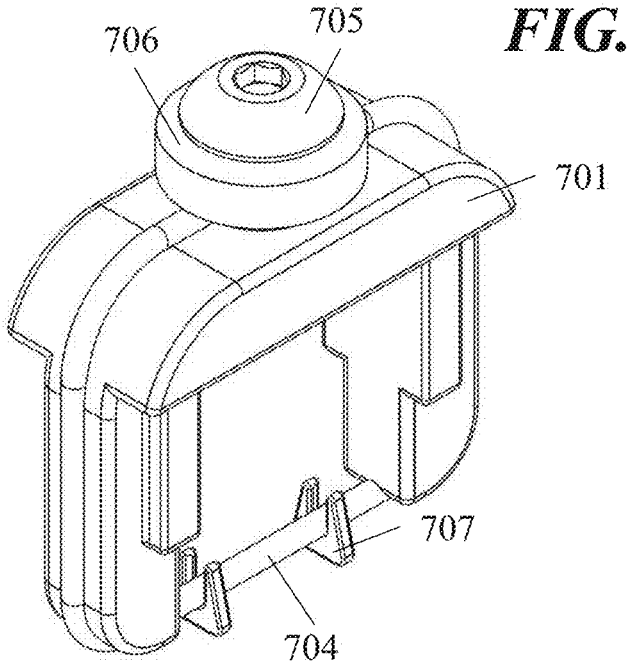
FIG. 51
FIG. 52
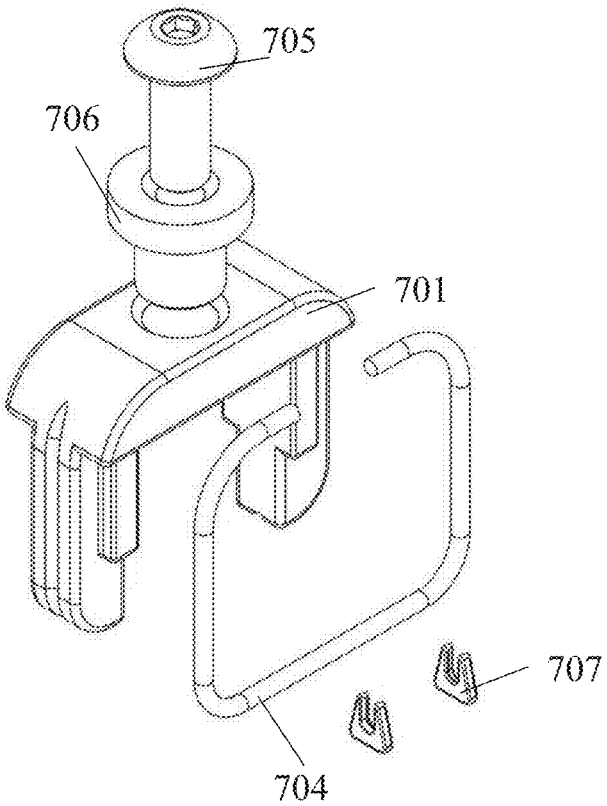

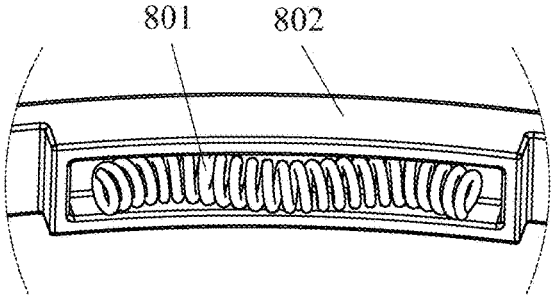
FIG. 54
FIG. 53
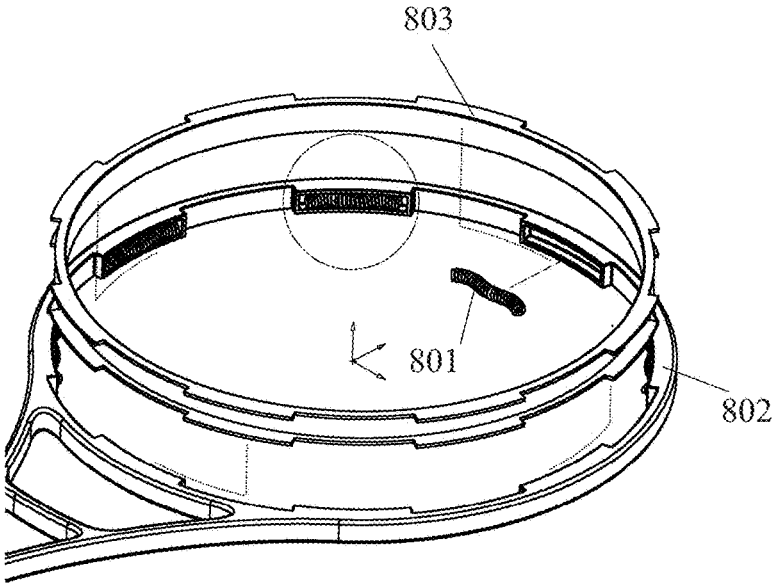

FIG. 55
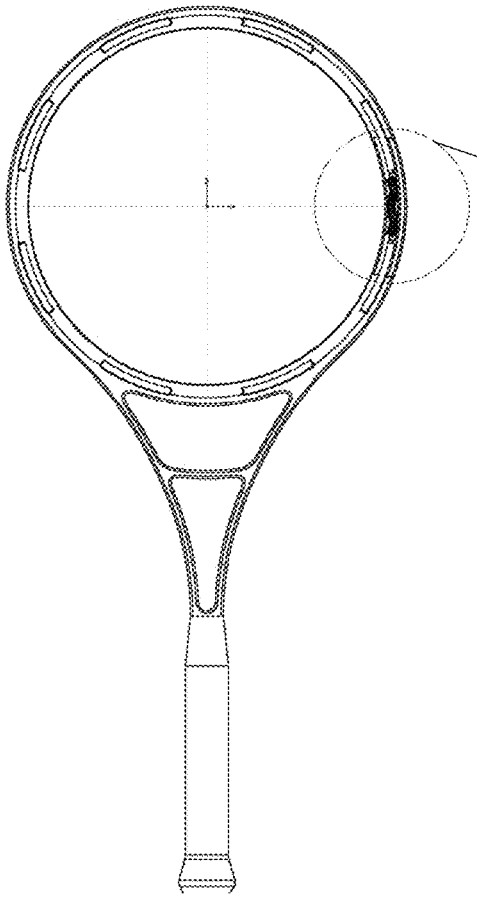
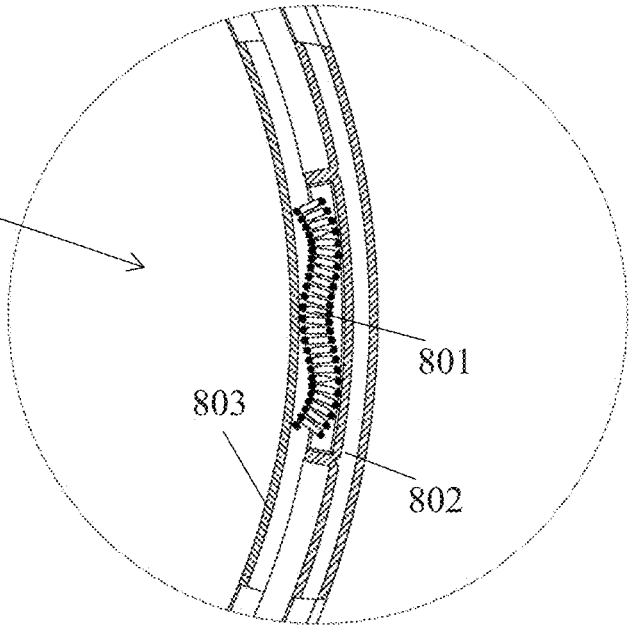
FIG. 56
FIG. 57
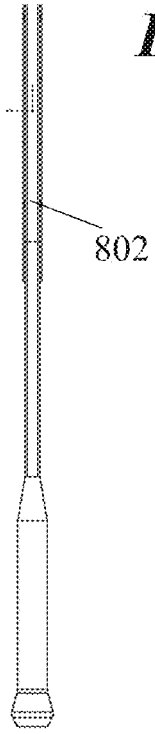

View A-A from FIG. 61

View B-B from FIG. 61

View B-B from FIG. 64

803

803

View D-D from FIG. 73

View B-B from FIG. 79

View C-C from FIG. 83

View B-B from FIG. 91

FIG. 96
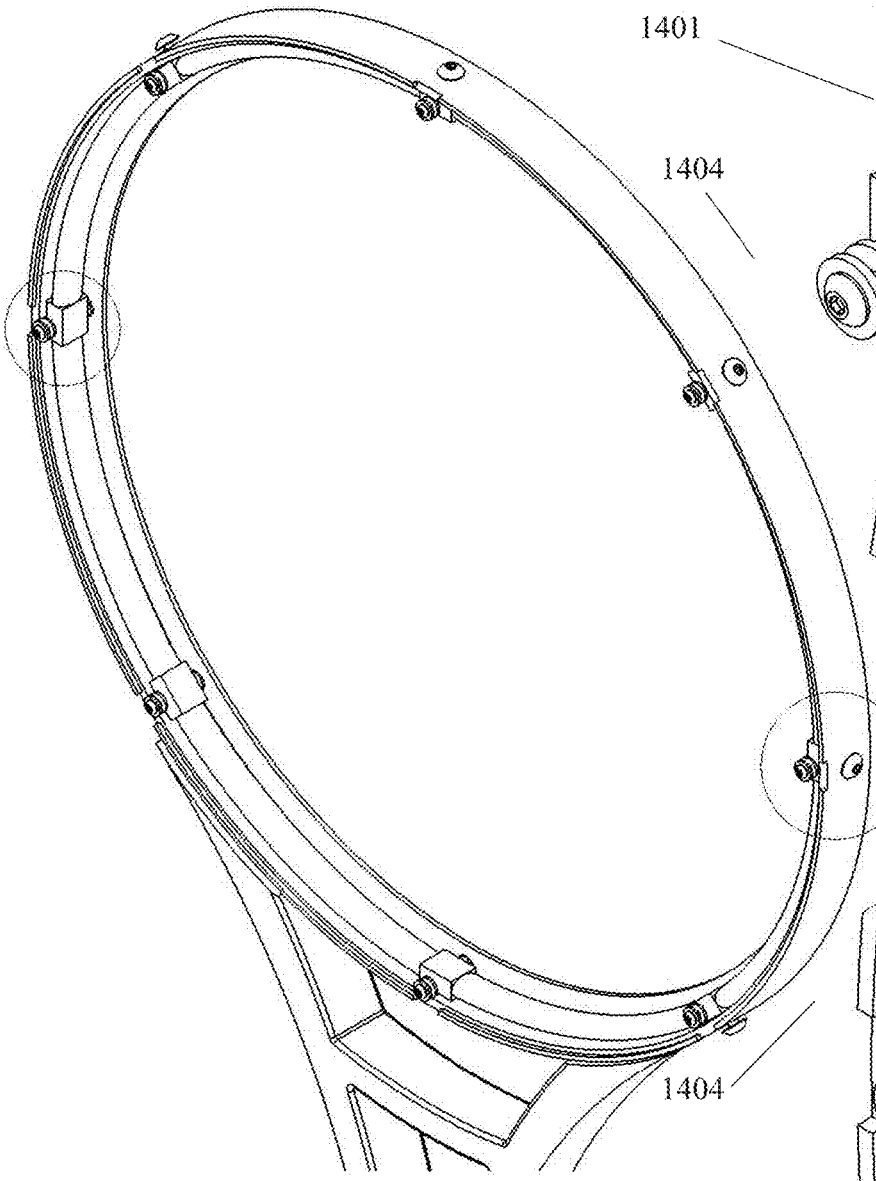
FIG. 97A
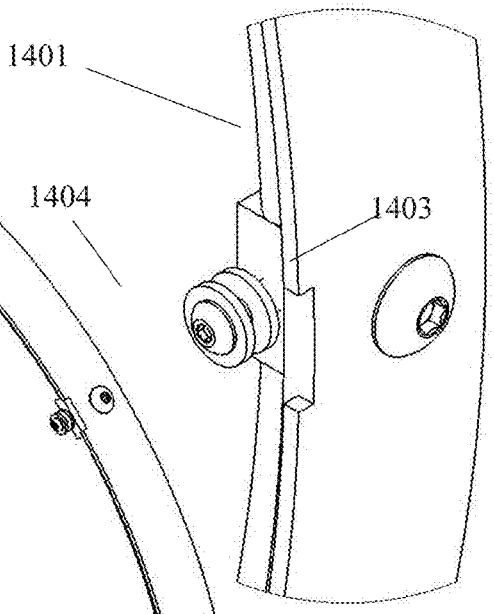
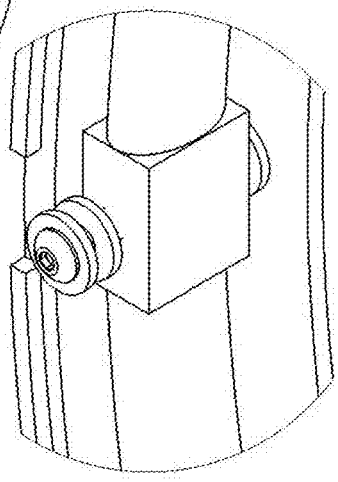
FIG. 97B

View at A-A in FIG. 1405

TENNIS RACQUET WITH ADJUSTABLE FRAME ISOLATION

PRIORITY CLAIM

In accordance with 37 C.F.R. 1.76, a claim of priority is included in an Application Data Sheet filed concurrently herewith. The present invention claims priority as a continuation of U.S. patent application Ser. No. 15/961,187 entitled "TENNIS RACQUET WITH ADJUSTABLE FRAME ISOLATION" filed Apr. 24, 2018, which claims priority to U.S. patent application Ser. No. 14/210,614 entitled "TENNIS RACQUET WITH ADJUSTABLE FRAME ISOLATION" filed Mar. 14, 2014 and issued as U.S. Pat. No. 9,975,009, which claims priority to U.S. Provisional Patent Application No. 61/801,852, filed Mar. 15, 2013 and U.S. Provisional Patent Application No. 61/939,725, filed Feb. 13, 2014. The contents of these applications are incorporated herein by reference.

FIELD OF THE INVENTION

This invention relates primarily to the field of tennis and in particular to a tennis racquet with a strung inner secondary frame structurally attached to a primary outer frame using an isolation system.

BACKGROUND OF THE INVENTION

The use of spin in the sport of tennis is a strategy employed by players at all levels. At intermediate and advanced levels, mastery of topspin and underspin offers a significant competitive advantage. For example, tennis players, who are able to hit the ball causing significant ball topspin, can aim the ball's trajectory well above the actual net (minimizing the error of the ball hitting the net) while relying on the spin to bring the ball down inside the opponent's boundary lines. This clearance allows players to hit the ball with greater speed with the confidence that it will land in the field of play. In addition, both topspin and underspin/slice will also cause difficulties for the opponent to respond. In the case of topspin, the ball will bounce and 'jump' off of the court making it difficult for the opponent to adjust. In the case of underspin, the ball will skid or die making it equally difficult for the opponent to adjust. It is accepted in the sport of tennis that those capable of consistently mastering topspin and underspin have reached a higher level of ability that will favorably impact their game.

Most tennis racquets are similar in shape and stringing to that shown in FIG. 4. The racquet shown in FIG. 4 has a typical string pattern 107 of 16 main strings and 19 cross strings (16×19). The main strings run in the direction of the Y-axis of the coordinate system 108 of FIG. 4, and the cross strings run in the direction of the X-axis. The Z-axis is normal to the string bed as shown in FIG. 4.

In the 1970s the spaghetti tennis racquet (or more appropriately named "the spaghetti strings"; almost any racquet could be strung using the spaghetti strings) offered a noticeable increase in spin rate over conventionally strung racquets for an equivalent tennis stroke. The spaghetti stringing technique was revolutionary and historically significant, and the present invention's design will be contrasted against the design of the spaghetti (2 expired patents define the spaghetti design in detail). The concept of the design of the spaghetti tennis racquet is shown in FIG. 1, FIG. 2 and FIG. 3. FIG. 1 shows a plan view of the spaghetti-strung racquet. The racquet frame 101 supports 6 cross strings 102. There are 2 pair groups of main strings (103 and 104) that are on either side of the cross strings. In FIG. 2, the front and back main strings (103 and 104) are shown as they lock into the slider-bars (105 and 106 in FIGS. 1 and 2). Most importantly, the 2 sets of main string are not interwoven with the cross strings as seen in more traditional stringing configurations.

Referring to FIG. 3A, the spaghetti is designed so that the front set of main strings (103), locked into the 4 slider bars (105), moves together as they slide on the 4 cross strings (102). Since they are not interwoven this movement is much easier than in traditionally strung rackets. This motion is roughly left<->right in FIG. 3A, or, more specifically, the X-direction of the coordinate system (108) of FIG. 3A (this X-direction is also called the 3 o'clock<->9 o'clock direction, and the Y-direction is also called the 12 o-clock<->6 o-clock direction; see FIG. 3A). On a smaller scale this motion also occurs with traditional stinging configurations by not interweaving the main and cross strings, the x-y motion for the spaghetti configuration is greatly amplified.

The back set of main strings (104) and slider-bars (106) function in the same way as the front assembly (although independent of the front assembly). Both sets of main string assemblies can flex for out-of-plane loading. For in-plane loading, only the side that contacts the ball flexes in the plane of the string bed.

When a ball is struck by a tennis racquet, both the ball and racquet are moving. It is common to investigate this impact by referencing the impact relative to the racquet frame: hence the racquet is fixed and the ball impacts it (relative velocities are used). This is demonstrated by the ball (110) in FIG. 3B, moving in the XZ plane of coordinate system 108, striking a racquet that is fixed to ground. The ball is coming in at an angle to the normal (Z-direction) of the racquet, and this simulates the real impact of a ball and racquet causing spin of the ball about the minus Y-direction. The vector 111 illustrates the path of the ball before impact. After impact, the ball rebounds with spin. The common explanation for the advantage of the spaghetti is that, during ball impact, the top main string assembly is pushed by the ball in the minus X-direction (the slider bars will slide on the cross strings). In addition, both the front and back main-string assemblies as well as the cross strings will simultaneously deform in the minus Z-direction). Energy is stored for both motions and then returned to the ball. The Z-direction energy rebounds the ball off the string bed; the X-direction energy allows the top main string assembly to rebound in the plus X-direction, applying a tangential force to the contact point of the ball. This tangential force applies a moment to the ball (about the minus Y-direction), and this causes the ball to spin about the minus Y-direction (right hand rule). Slow motion video during this contact shows the added spin may be due to this kick back tangential force, but it is also clear that the X-direction compliance of the main string assembly allows the ball to not slip on the string bed, causing added rotation. It will become obvious that, through a different mechanism, the present invention will also minimize the slipping of the ball on the string bed.

Another observation about the spaghetti is that the maximum spin that the spaghetti can offer is directly related to the directional impact of the ball on the racquet. Referring to FIG. 3A, let the angle that the ball makes with the Z-axis be constant. But let the ball approach the racquet in the YZ plane. It is obvious that the spaghetti loses its advantage here since the in-plane stiffness of the main-string assembly in Y-direction is significantly stiffer than in the X-direction. Any direction other than the biased XZ plane will have less spin effectiveness; and such a direction occurs in actual play when a ball is struck when the Y-axis of the spaghetti racquet is not parallel to the tennis court. It will become obvious that, unlike the spaghetti system, the present invention is not dependent on the angle of approach.

Another problem with the spaghetti is that the in-plane and out-of-plane stiffness was not controlled. Most tennis players (pros and amateurs alike) hit with racquets whose out-of-plane string bed stiffness is 140/150 lbs/in to 250 lbs/in. A stiffness softer than this makes the ball "trampoline" off the string bed, which both significantly hampers control and significantly hampers keeping the ball "in the court"; and stiffness higher than this make the racquet hit like a board with a significant loss in power. The spaghetti system offers out-of-plane stiffness in the order of 90/100 lbs/in, making it almost impossible to control if the motion of a player's stroke did not lend itself to generating topspin. Because of the double string assembly and the plastic roughed-up inserts 103 and 104 of the spaghetti design shown in FIGS. 1 thru 3A, the spaghetti system no longer meets United States Tennis Association and International Tennis Federation rules for a strung tennis racquet to be used in sanctioned tournament play. It will become obvious that the present invention can provide an in-plane and out of plane stiffness better suited to current expectations.

Tennis players and tennis manufacturers, over the last several years, have found another way to help increase ball spin: open string patterns. FIG. 4 shows a racquet that is strung with a conventional stringing pattern (16 mains×19 cross). Figure S shows the same racquet strung with an open string pattern of 16 main strings (110) and 10 cross strings (109); and FIGS. 6 and 7 illustrate a close-up comparison of these string patterns. There are other open string patterns that have significantly less strings, but the principle on which the open string pattern causes increased top spin is the same: the string kickback and the in-plane compliance of the main strings is the key. As the ball strikes the open string bed, in exactly the same manner outlined previously for the spaghetti, the main strings slide on the cross strings, and then rebound. Once again, slow motion video during this contact shows the added spin may be due to this kick back tangential force, but it is also clear that the X-direction compliance of the main string allows the ball to not slip on the string bed, causing added rotation. With less cross strings interweaving the main strings are able to move more than traditional stringing patterns, though still less than that of the spaghetti system.

The open string pattern has several problems in its use. The open string pattern has the same directional limitation that was explained in the spaghetti system: an open strung racquet making an angle to the tennis court as it impacts the ball will get only a partial advantage of the spin generated by the open pattern (compared to the same racquet, same conditions, but the racquet is swung parallel to the court). Another disadvantage of the open string pattern racquet is the significantly increased wear of the string bed causing a shorter string life. Since the movement of the main strings sliding over the cross strings is fundamental to the advantage of the open string system, it is no surprise to see the cross strings essentially "sawing" the main strings in half. And this is indeed the case, where the more effective the open string pattern is to cause increased spin, the shorter the main string life. In addition, this frictional sliding reduces the amount of in-plane-motion returnable energy that is available for spin generation. It will become obvious that the present invention overcomes these limitations in the open stringing pattern.

A review of prior art shows previous patents that include an inner and outer frame construction. FIG. 8 serves as a pictorial example of such a dual frame construction: the inner frame 201 supports the string bed, isolators 202 will structurally integrate the inner and outer frames, and the outer frame 203 completes the racquet and delivers the handle interface to the tennis player. The isolators could be a collection of the discrete isolators as shown in FIG. 8, or a continuous system illustrated by a rubber tube or a continuous leaf spring. In the case of one patent, the inner frame is essentially integral with the outer frame; hence it is not isolated. In another case there is a rubber tube that holds the inner and outer frames together. The purpose of the both patents is to easily change the strings/inner-frame from the outer frame. This allows the quick replacement of a pre-strung inner frame. Other prior art uses an inner and outer frame construction to help minimize vibration of the racket upon impact often linked to tennis elbow. In none of the prior art is there any claim or objective associated with added topspin or underspin. There is also no discussion of: i) the weight of the inner frame; ii) using/adjusting the in-plane and/or out-of-plane stiffness of the isolators to increase spin; iii) using/adjusting the isolation system to improve the accuracy of the directional trajectory of the impacted ball; iv) using/adjusting the isolation to offer rotational independence of ball impact (occurs when the racquet's Y-direction is not parallel to the court); v) controlled stringing procedures to reduce inner frame stress and buckling; and vi) extended string life.

SUMMARY OF THE INVENTION

The present invention is directed to a tennis racquet design with an inner and outer frame connected by an isolation system. When a tennis ball strikes the inner frame string bed, its dynamic loads will be transmitted into the string bed. The normal load will deflect the strings and isolators and, depending on the combined stiffness out of plane of the isolator/inner frame/string bed, those strings can re-bound just like conventionally strung racquets. However, the in-plane movement and compliance of the string bed helps maintain adequate frictional force between the ball and string bed so the ball does not slip on the string bed. After impact, this results in an increase in ball rotation compared to conventional racquets. The minimization of the weight of the inner frame (compared to the weight of the ball) will decrease the opportunity of the ball to slip against the strings. The elimination of that slippage will result in increase rotation (topspin or underspin) of the ball. In addition, during impact, the isolators store more energy in them (in-plane deformation) and then return that energy, through the non-slip frictional load, back into spinning the ball.

An objective of the invention is to employ an inner frame that, relative to an outer frame, will generate spin when a tennis ball contacts the inner frame.

Another objective of the invention is to minimize ball slipping on the tennis racquet string bed.

Another objective of the invention is that when the ball contacts the inner frame it will create a deflection of the inner frame in the x-y plane.

Another objective of the invention is to teach a relationship between an inner frame, an outer frame and an isolation system to control the spin imparted to a tennis ball for a given tennis swing.

Yet another objective of the invention is to permit tuning of isolators relative to conventional racquet characteristics to increase the amount of ball spin compared to conventional racquets.

Another objective of the invention is to increase the accuracy of a tennis ball trajectory.

A feature of the instant invention is the ability to easily remove the inner frame and isolators and replace with another set of different isolators and/or different pre-strung inner frames. The inner frame insert (without a handle or yoke) allows for easy stringing of the inner frame. This "insert" design allows for automated stringing of the frame and the opportunity of patented designs of that stringing machine and string design/material.

Another feature of the instant invention is the ability to easily modify the isolation system to affect the play of a racquet. The isolating system could be adjusted, replaced or supplemented to make small or large adjustments in how the racquet performs. These adjustments could take place during a match or after matches. While the adjustments could include replacing the inner-frame/string-system, it could also include removing part or all of the isolating system or replacing it with another. The adjustments can also include some means of altering the isolating system while connected to the inner and outer frame.

Another objective of the instant invention is to minimize the motion of the strings relative to each other on the inner frame thereby increasing the life and performance of the tennis strings used on the inner frame.

Another objective of the instant invention is to increase the sweet spot of the inner racquet defined by a true bounce of a tennis ball around the entire circumference of the string bed.

Still another objective of the instant invention is teach the use of an elliptical inner frame shape which will allow strings to be strung according to a formula to only cause normal stresses in the frame, wherein the inner and strung frame will be minimized in its weight.

Another objective of the instant invention is teach the use an inner frame that weighs the same or less than a conventional tennis ball.

Another objective of the instant invention is an inner frame whose weight is between 20 grams and 200 grams, with a minimized target weight of 30-40 grams.

Another objective of the instant invention is a tuning of the isolator system for the in-plane and out-of-plane stiffness to maximize spin for a given swing motion/speed.

Another objective of the instant invention is to offer optimized combinations of inner frame, outer frame and isolator to maximize spin for a full range of skill sets and swing speeds/styles.

Another objective of the instant invention is to increase spin irrespective of the angle of approach of the ball to the inner frame.

Yet still another objective of the instant invention is teach the use of an inner frame strung with tensions according to a recipe to allow for minimizing the weight of inner frame by minimizing bending stresses in the inner frame.

Still another objective of the invention is to present a design that will significantly increase the life of the strings wherein the main and cross strings do not noticeably move relative to each other and wherein the entire string bed will move together deforming an isolation system in the x-y plane. The strings could be bonded together allowing for an even longer life.

Another objective of the invention is the out-of-plane stiffness of an individual isolator is between 10 lbs/in and 200 lbs/in; and the in-plane stiffness of an individual isolator, for any direction, is between 5 lbs/in and 100 lbs/in.

Another objective of the invention is that the effective stiffness of the overall isolator system, is between 30 lbs/in and 1200 lbs/in for out-of-plane motion; and between 10 lbs/in and 1000 lbs/in for in-plane motion.

Other objectives and further advantages and benefits associated with this invention will be apparent to those skilled in the art from the description, examples and claims which follow.

BRIEF DESCRIPTION OF THE DRAWINGS

FIG. 10 is another view of FIG. 8 without the handle and yoke section showing strings and the racquet Coordinate System;

FIG. 11 is another 3-D view of FIG. 8;

FIG. 12 is a zoomed view of FIG. 11 showing one of the generic tubular isolators;

FIG. 18 shows a uniform load being applied to a parabolic arch;

FIG. 19 shows the loads developed in the arch in FIG. 18;

FIG. 20 is a key showing variables for stringing of a tennis racquet;

FIG. 21 shows the loads and dimensions for the stringing of an elliptical racquet;

FIG. 22 shows formula and a table of recommended string tensions to minimize stress in the frame;

FIG. 23 shows a staggered inner frame stringing pattern which helps stiffen the inner frame to avoid buckling;

FIG. 24 is a zoomed region of FIG. 23;

FIG. 29 is a plan view of the assembled head;

FIG. 30 is x-section L-L of FIG. 29 where several exposed component of the Clip/Isolator are observed;

FIG. 33 is a plan view of the outer frame showing x-section A-A;

FIG. 34 shows a cross section A-A of the Outer Frame in FIG. 33 exposing critical sway space for in-plane and out-of-plane inner frame motion;

FIG. 37 is a plan view of the inner frame showing x-sections A-A and B-B;

FIG. 38 shows cross section A-A of FIG. 37;

FIG. 39 shows cross section B-B of FIG. 37;

FIG. 51 shows a detailed view of the Isolator assembly showing the string and clip and Inner Frame retainers;

FIG. 52 shows an exploded view of FIG. 52;

FIG. 53 shows an exploded view of a front-face insert-and-twist Circular Inner Frame, Outer Frame, and Isolator;

FIG. 54 shows zoomed view of the spring isolator in the outer frame of FIG. 53;

FIG. 55 a front plane view of the assembled Circular Head insert-and-twist frame;

FIG. 56 is a zoomed view of Isolator spring of FIG. 55;

FIG. 57 is a side view of FIG. 55;

FIG. 96 is FIG. 95 with the front plate cover removed showing the inner frame and isolators;

FIG. 97A is a zoomed view of a bolt isolator of FIG. 96;

FIG. 97B is a zoomed view of another bolt isolator of FIG. 96;

FIG. 105 illustrates a racquet swing at ball impact that is 'square' and parallel to the court;

FIG. 106 illustrates a contrasting racquet swing to FIG. 105 where the swing makes an angle to the court;

FIG. 107 illustrates a bird's eye view of ball and racquet head impact; before/after ball impact vectors are shown for rigid isolators and deformable (dotted) string bed;

FIG. 108 shows FIG. 107 scenario but for rigid strings, flexible isolators mounted on outer frame FIG. 109 shows tuned-isolator ball-rebound accurate response for a flexible isolator and flexible string bed.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 13:
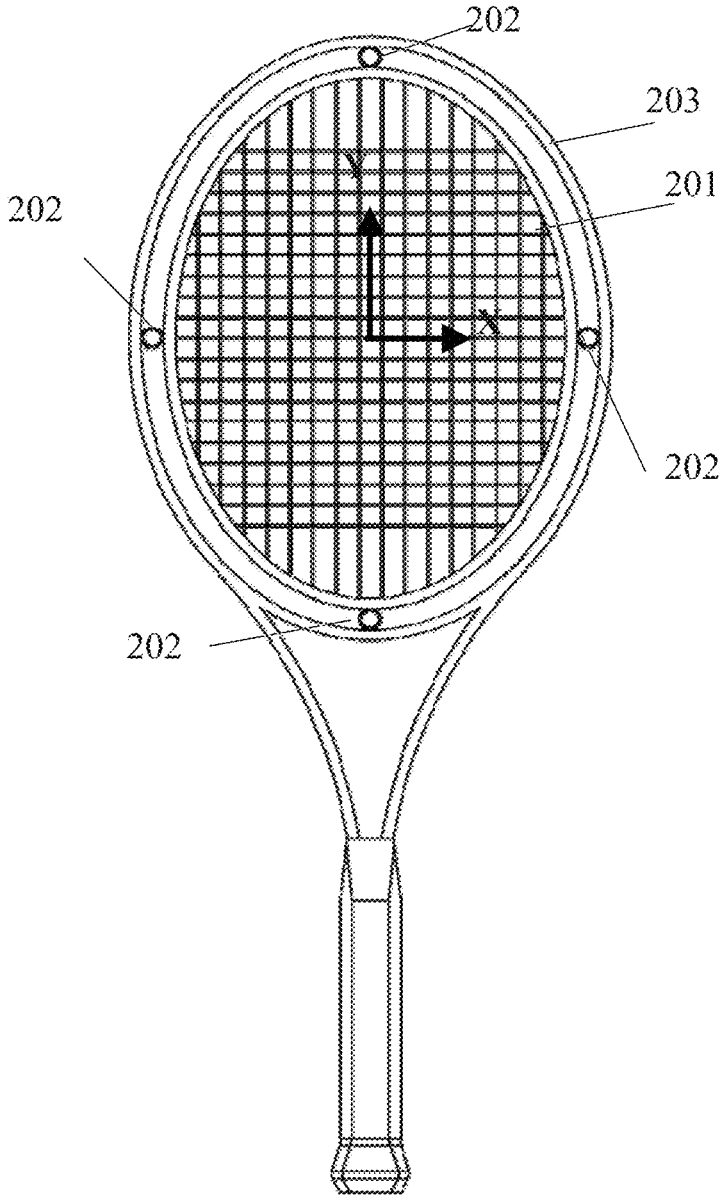
FIG. 13 is a plan view of FIG. 8.
Figure 14:
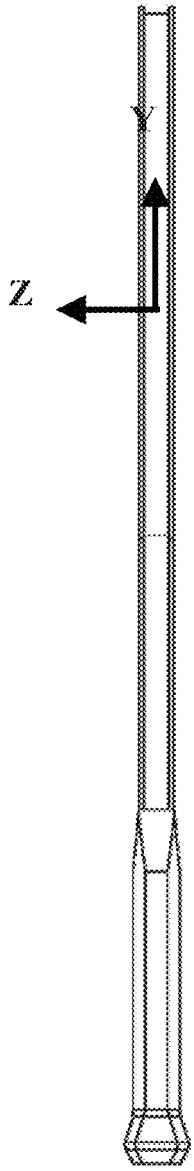
FIG. 14 is a side view of FIG. 8.

The generic functionality of the invention is illustrated in FIGS. 8 through 26 and FIGS. 101 through 109. Presented in the review of these figures will be generic concepts, functionality and attributes that apply to all embodiments including their components, assembly and processes, presented. In addition, while some figures certainly could lead to a manufactured structure, the intent of that geometry description is for illustration. The invention presented is a racquet capable of spin control and first illustrated in FIGS. 8 thru 15, where there is an inner frame 201, isolators 202, and outer frame 203. The inner frame can be any shape, but a circular shaped head (in normal-to-the-string-bed view the head shape is mathematically an exact circle) or an elliptical shaped head (in normal-to-the-string-bed view the head shape is mathematically an exact ellipse) is preferred. The isolators (see FIG. 12) can be discrete (as shown) or continuous. For the discrete system, there can be any number of isolators (made of any material, including a magnetic design) and they can be at any location around the periphery of the inner and outer frame. FIG. 13 shows 4 isolator locations at 12 o-clock, 3 o'clock, 6 o'clock and 9 o'clock. The inner frame 201 is strung with any string system that is used today; a stringing system that limits relative string motion is preferred. The isolator system 202 offers the structural connection between the inner and outer frames. The isolators are designed so that they are easily assembled in place or easily removed. Once removed, the inner frame can be structurally separated from the outer frame. It is intended that the inner frame would be strung separately. The spin control racquet invention provides top-spin and under-spin to the ball (if appropriately struck) by using a different design compared to the spaghetti and other racquets on the market.

One unique feature of the spin control invention is an inner frame (see FIGS. 8 thru 15, item 201) which contains strings under tension (or another material) intended to make contact with the ball. The inner frame is connected to the outer frame using an isolation system 202 in FIGS. 8 thru 15 which allows movement of the inner frame relative to the outer frame upon ball impact with the strings of the inner frame. The movement between the inner and outer frame will take place both in the XY plane (in-plane displacement) as well as out-of-plane displacement (Z-direction in FIGS. 8 thru 15). This relative deflection is because the isolators can offer flexibility (compliance) to the inner frame in the XY plane, as well as flexibility (compliance) to the inner frame for out-of-plane deflections.

Figure 1:
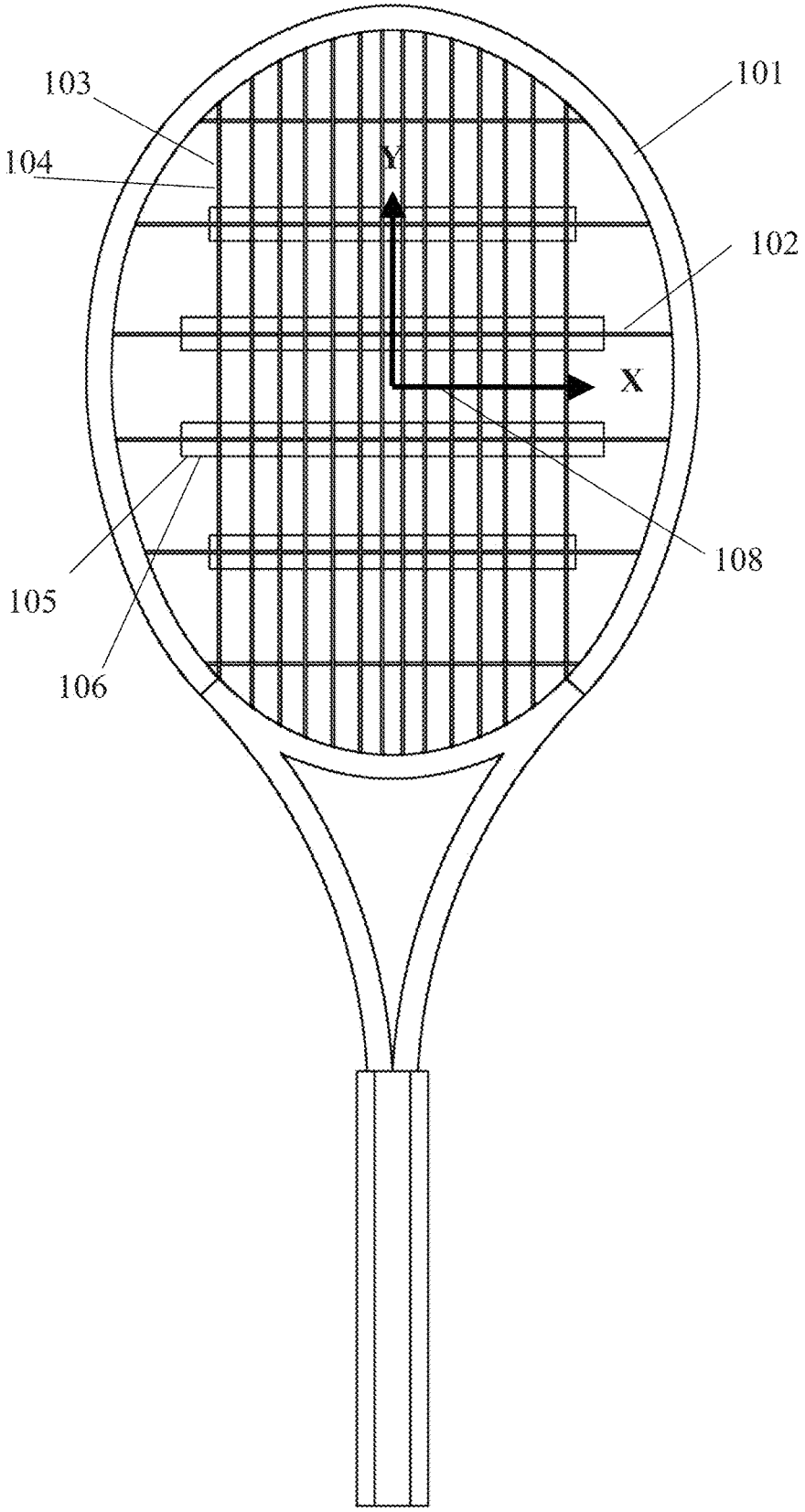
FIG. 1 is a plane view of a conventional spaghetti-strung racquet.
Figure 2:
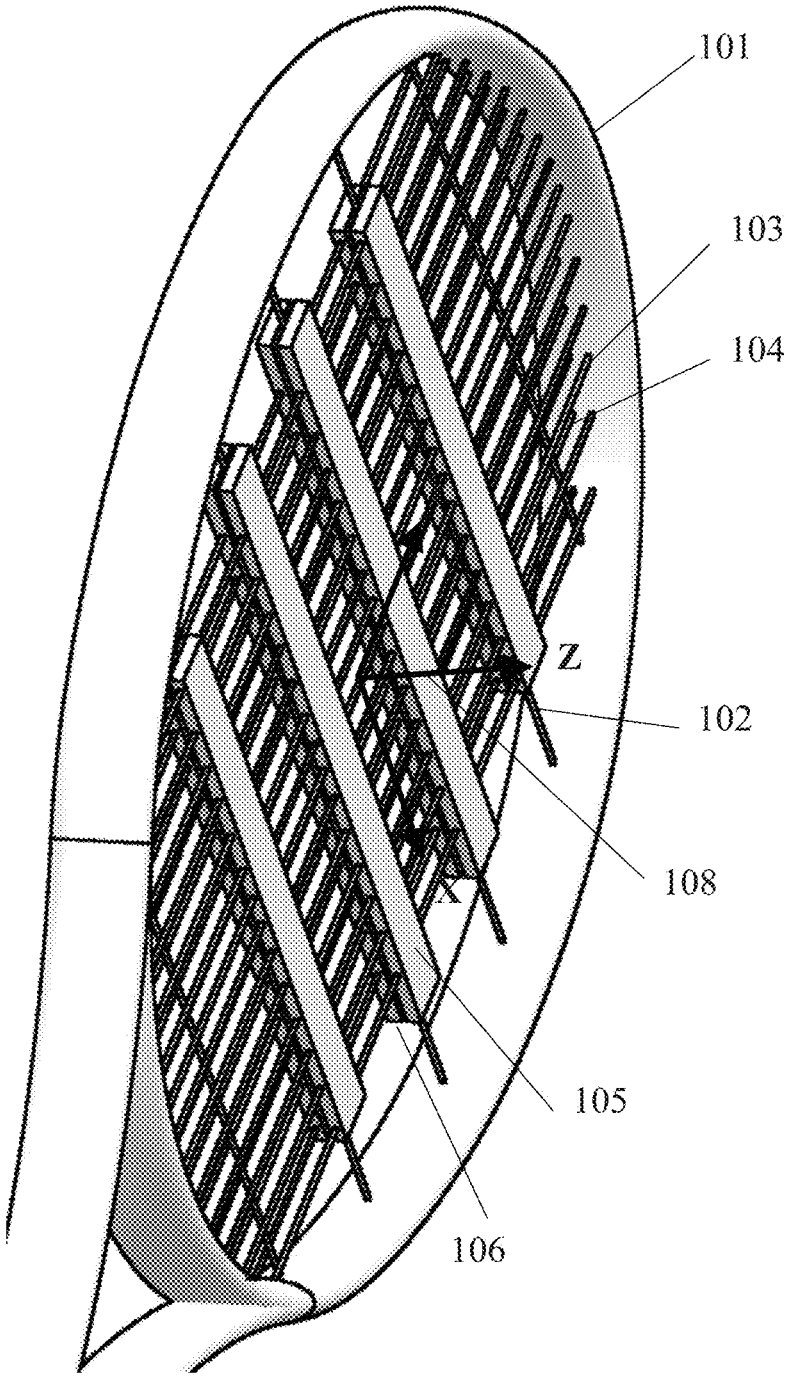
FIG. 2 is a zoomed iso view of the spaghetti head.
Figure 3A:
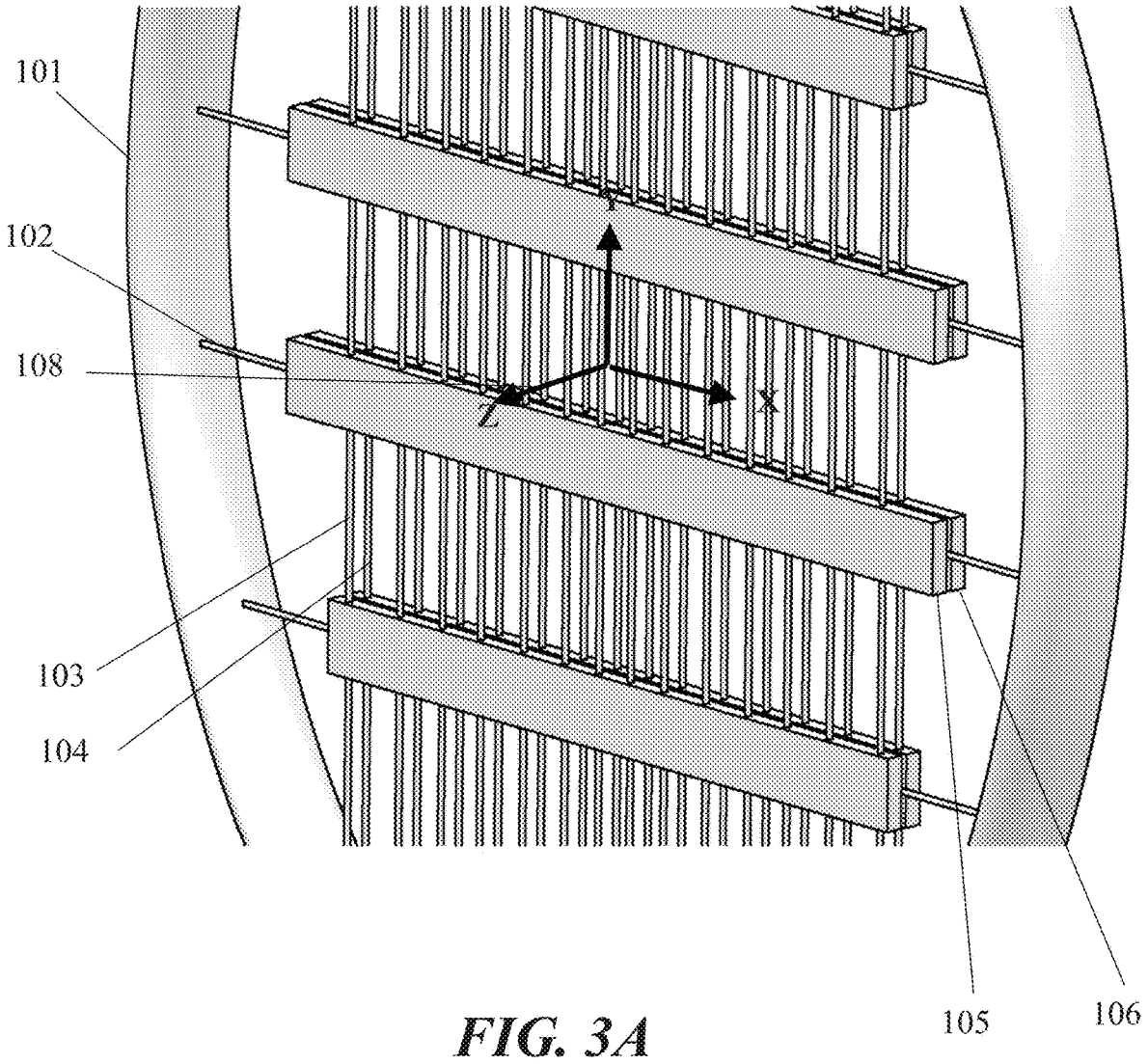
FIG. 3A is another zoomed iso view of the spaghetti head.
Figure 3B:
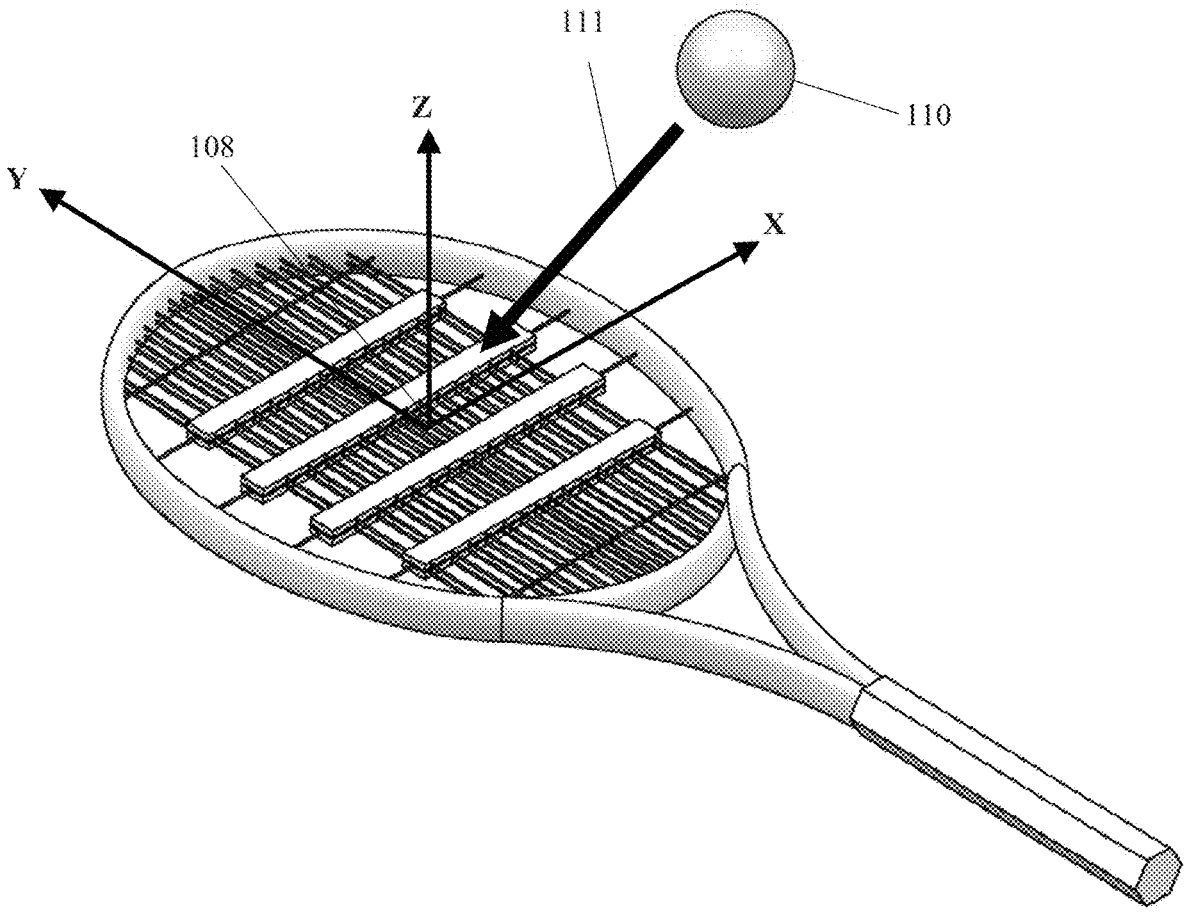
FIG. 3B is pictorial iso view of the spaghetti head with a ball impact vector in the X-Z plane.
Figure 4:
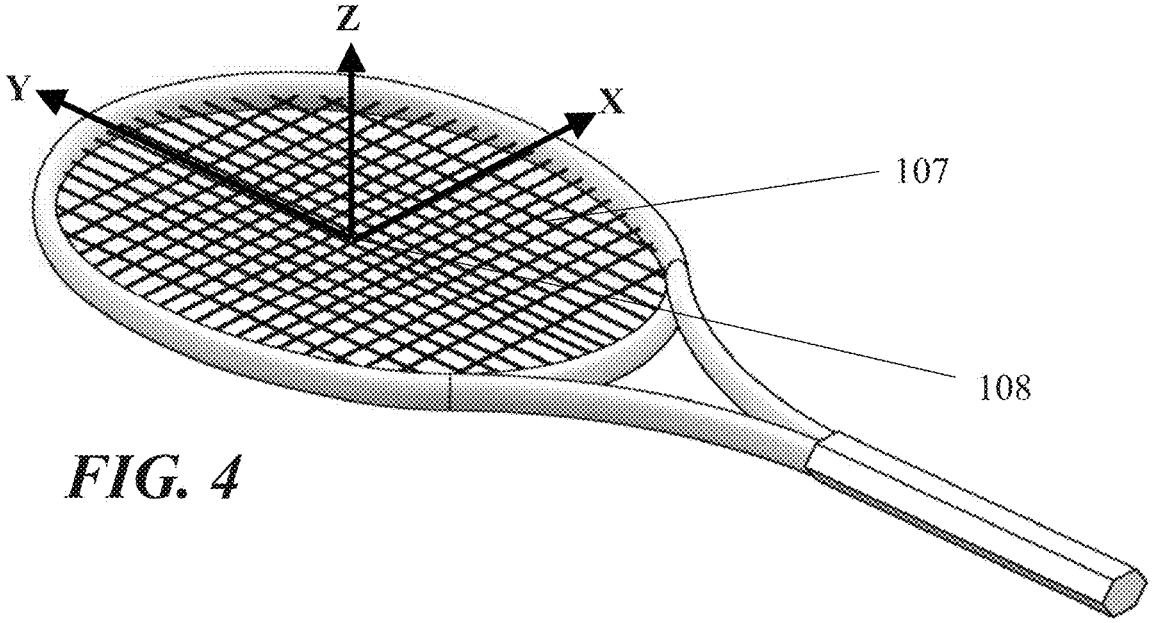
FIG. 4 is a traditional tennis racket with 16 main and 19 cross strings.
Figure 5:
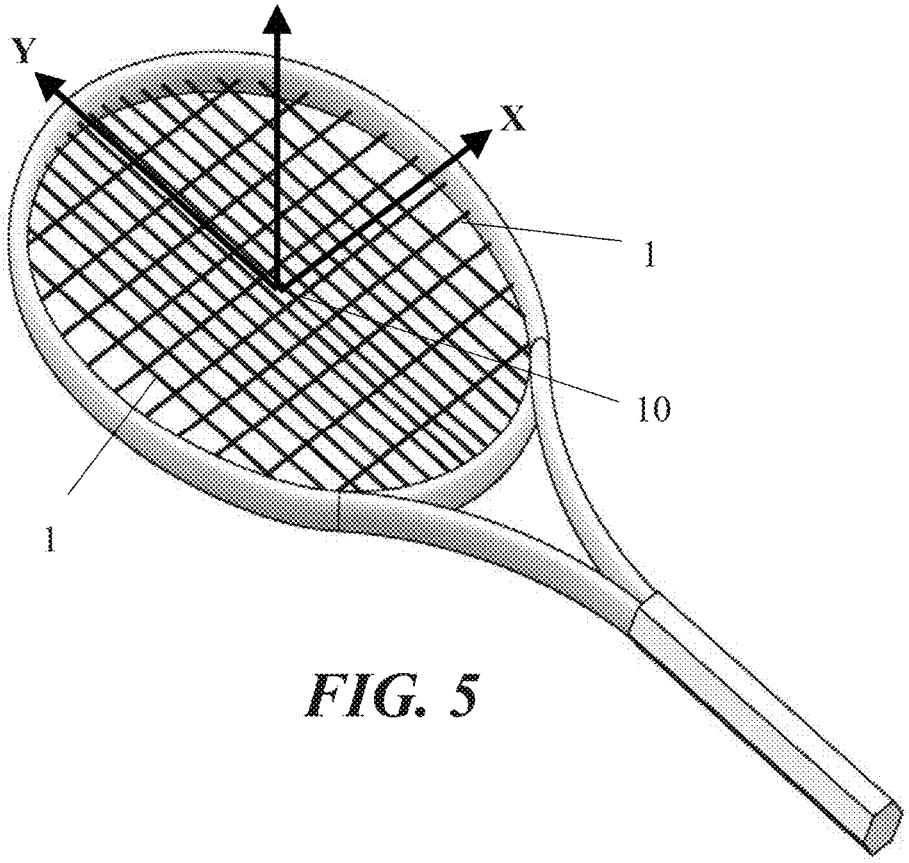
FIG. 5 is a traditional tennis racket with an 'open' string pattern of 16 main and 10 cross.

A conventional racquet with stringing similar to that shown in FIG. 4 has an in-plane stiffness that the ball sees that is significantly higher (5 to 10 times or more higher) than the in-plane stiffness the ball sees with striking the inner frame/isolator system of the spin control racquet. Hence one of the important features of the spin control system is the presence of an inner frame; and that includes an inner frame that is isolation system structurally supported.

During ball impact, except for the strings of the inner frame deflecting out-of-plane (as strings do for any conventional racquet), the inner frame moves essentially as a rigid structure. This allows the isolation system to offer overall support of the inner frame. For example, for in-plane deflections, the inner frame moves, as a rigid body, as much as 0.25 inches to 1.0 inches or more in the XY plane. The isolators and outer frame are designed to accommodate this in-plane motion of the inner frame for any in-plane direction. Specially, the inner frame can move, in the XY plane, referring to FIG. 15, in the X-direction, in the Y-direction, in a direction at 45 degrees to the X-direction and Y-direction, or in a direction at any angle Theta-Z (Theta-Z is an angular rotation direction about the Z-axis of FIG. 15).

Spin is achieved by allowing the entire string bed to move at some angle in the x-y plane and then pop back. At the same time, as the strings simultaneously are moved in the x-dir and z-dir and then re-bound, the ball is being pushed off the bed in the local z-dir of the racquet, and simultaneously being spun (about the y-dir) as it is loaded tangently through friction. This synched motion in both directions puts the added spin on the ball while simultaneously propelling the ball off the string bed. It is this synched motion that can be achieved by choosing the appropriate isolator stiffnesses for a given swing speed and angle of contact.

The isolation system of the inner frame relative to the outer frame is to provide different stiffnesses for the isolators in the x-y plane (Kx and Ky) versus the out-of-plane stiffness Kz. The Kx, Ky stiffnesses are, taken as a group, between 10 lbs/in and 1000 lbs/in and are tuned to maximize ball spin. The Kz stiffness of the entire isolation system is also tuned so that the overall out-of-plane stiffness the ball sees is between 50 lbs/in and 400 lbs/in (that stiffness includes, in series, the stiffness of the strings, the Kz isolation system, and the stiffness of the racquet). Both the isolators and inner frame can be easily removed and replaced. This design allows for adjustment of the Kx and Ky stiffnesses so that, no matter what the head's motion is as it strikes the ball, the in-plane x-y stiffness the ball sees can be made the same. Hence if a racquet is swung where the motion of the head is not exactly parallel to the ground at ball impact (the racquet handle makes an angle with the ground; as in a serve) the ball will experience the same top spin. This allows the serving motion to cause significant spin, likely curing the ball in two planes.

Another feature of the spin control system is the design weight of the inner frame is to be made as small as possible. Specifically, with reference to a tennis ball's weight of 57.7 grams or so, the weight of inner frame (including the weight of the strings, grommets, and interface structure to the isolators, and any moving components that can move directly or indirectly with the inner frame and hence are part of its dynamic weight), should be between 20 grams and 200 grams or so, with a target weight of 30-40 grams or so). It can be shown (both thru experimental testing and simulations) that the ability of the spin control system to generate spin is inversely related to the effective dynamic mass of the inner frame (whose weight is defined above): the smaller the mass of the inner frame, the higher the amount of spin that can be achieved. In addition, the control of this inner frame effective weight (a feature of the spin control system and the inner frame), is also a claim of the patent. Controlling this weight can control the maximum amount of spin the spin control system invention can provide. Designing this effective dynamic inner frame weight to be as light as possible (compared to the ball) will allow the ball to minimize "sliding" on the string bed during impact, and thus allows the re-bounding inner frame to impart higher tangential forces to the ball, causing increased spinning of the ball during and after ball impact.

The inner frame can have another material, instead of strings, that may cover the inner frame to provide a contact surface for the ball. The structure of the inner frame can be made from any material. A light weight, high strength, low material and manufacturing cost, is preferred. Once such candidate is a graphite composite. The use of other manufacturing materials for the design of the inner frame is part of this claim.

The shape of the inner frame, and the stringing and string pattern of the inner frame, is an important part of the spin control system. The largest loads that the inner frame will see occur because of the string tension that is applied to the inner frame (or to any racquet frame for that matter). The ability to minimize the stresses resulting from this string tension loading will directly contribute to minimizing the weight of the inner frame and the effectiveness of the spin control system.

A basic understanding of these loads and resulting stresses is fundamental to the spin control system. A formula for the tensioning of the strings is one of the basic claims of this patent.

Consider, referring to FIG. 18, a uniform load Wy (lbs/in) applied to an arch (like a Roman arch). For an arbitrary shape of the arch, loads will develop in the arch shown in FIG. 19: an axial force N (lbs), a shear force V (lbs), and a bending moment M (lb-in). The bending moment M causes large stresses in the structure; minimizing M will reduce stresses and hence the weight considerably.

A shape for the arch that will minimize the bending moment M in the arch. A specific parabolic shape involving L and h (see FIG. 18) will cause the bending moment M (and shear V) to go to zero, thus minimizing stresses in the arch and requiring the arch to only carry, and very efficiently only carry, the axial load N.

For the double loading shown in FIG. 21 (see description in FIG. 20), is there a shape for that structure that will also minimize M? This structure and loading can represent a strung tennis racquet, with Wx, Wy representing cross string and main string loading, respectively. M & V in this racquet will go to zero if the shape of the structure is a mathematical ellipse (minor axis a, major axis b, see FIG. 20 and FIG. 21), and the Wx, Wy string loading is not arbitrary but chosen per Equation 1 in FIG. 22.

If there are Nx\Ny equally spaced cross\main strings, respectively, then, for a specified Ty main string tension, the cross string tension Tx is given by Equation 2 of FIG. 22. The table of FIG. 22 gives, for main string tension Ty=60 lbs, typical cross string tensions Tx (last column) for various racquet head shapes (assuming they are elliptical). Cross string tension run about ⅔ (40 lbs) of the main string tension (60 lbs).

Stringing the inner frame based on the tension formula of Equation 2 of FIG. 22, will minimize the stresses (M and V=0) and hence will allow for minimizing the weight of the inner frame. Note that this tension formula represents the final tension in the racquet and not the tension that is actually pulled (the racquet flexing and stringing machine flexing will make those numbers different).

The spin control features that are claim here: i) The shape of the inner frame is elliptical or nearly elliptical (within 20% of an elliptical shape as measured by a maximum normal deviation normalized by the maximum dimension; note a circular shape is an ellipse and would represent minimum weight for a given area); ii) The final tensions, however they are achieved, are based on Equation 2 of FIG. 22 (within 20%, including, if unequal string spacing and varying tensions apply, then average values Wx/Wy are used and compared for agreement per Equation 1 of FIG. 22, and normalized by the average main string tension or by Wy, whichever applies); iii) This applies to any strung frame, not just the inner frame presented here.

Minimizing the weight of the inner frame, subject to a specified string tension loading, will require that the inner frame be tightly engineered to remove any conservatism. Based on the discussion in the previous section, the inner frame will be elliptical in plan-view shape (and, for a specified hitting area, a circular shape would be the optimum elliptical shape for minimum weight). For the Equation 2 string loading condition, its stress field will be in a pure membrane stress field (ie, axial load only). This efficient load carrying situation will allow a minimum weight; but this loading condition will be a compressive load, and this light weight compressive loaded structure will be a strong candidate for buckling.

For a given x-sectional area of a tubular-like inner frame, simulation studies clearly show a closed x-section is significantly better than an open x-section (by a factor of 4 to 8 or so) to minimize buckling. Buckling can occur both in-plane and out-of-plane.

Figure 6:
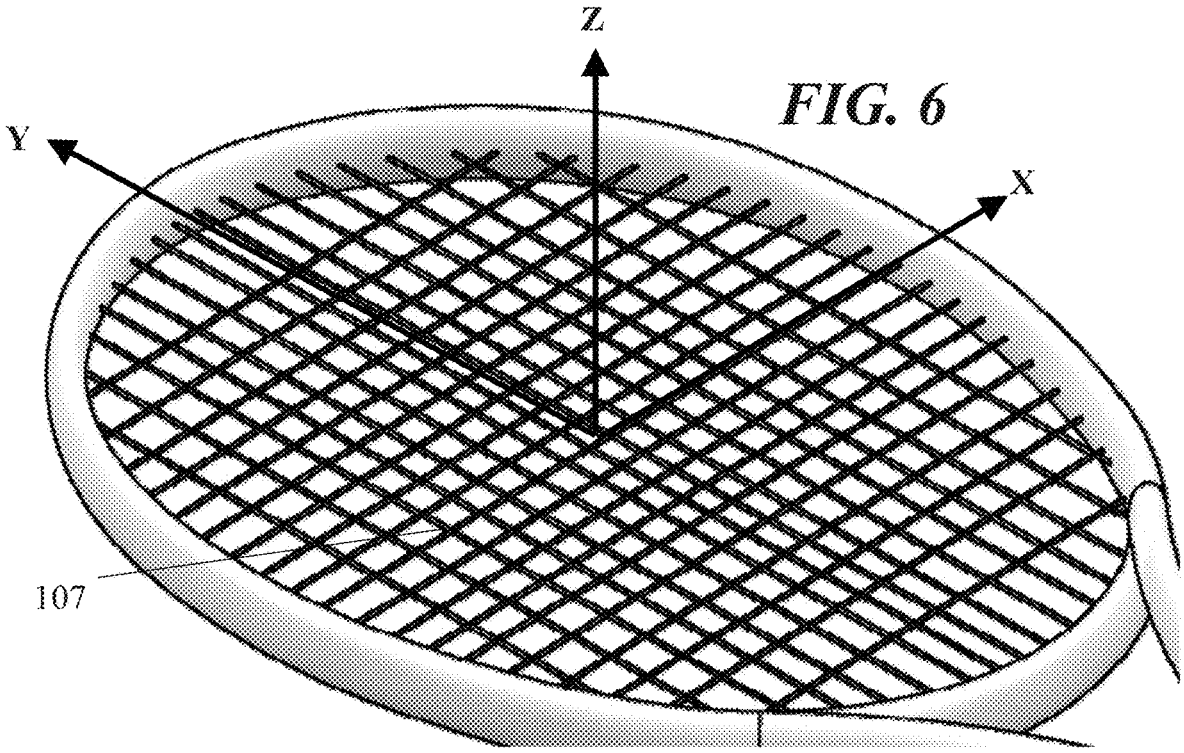
FIG. 6 is zoomed view of FIG. 4.
Figure 7:
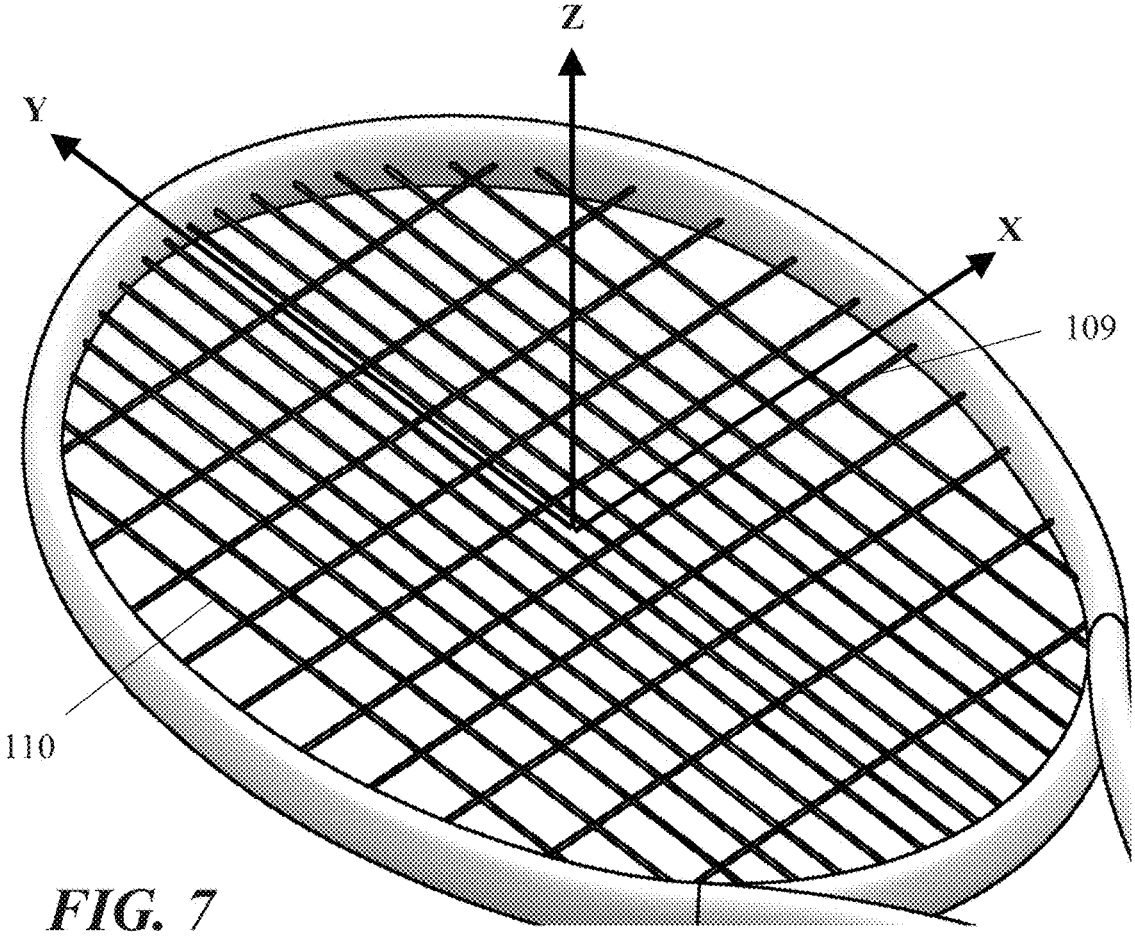
FIG. 7 is a zoomed view of FIG. 5.
Figure 8:
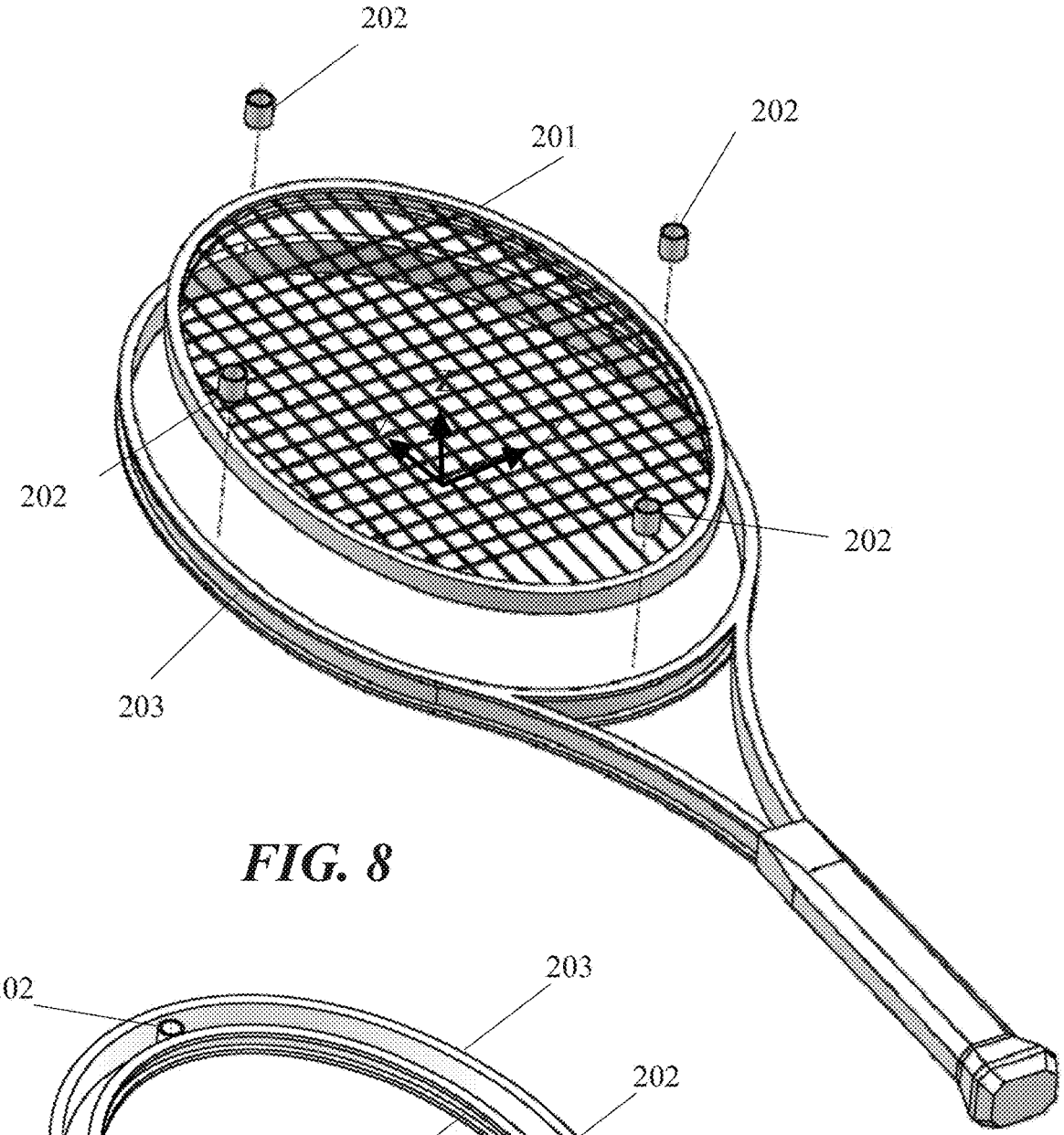
FIG. 8 is a generic racquet design of the present invention with an inner and outer frame and isolators.
Figure 9:
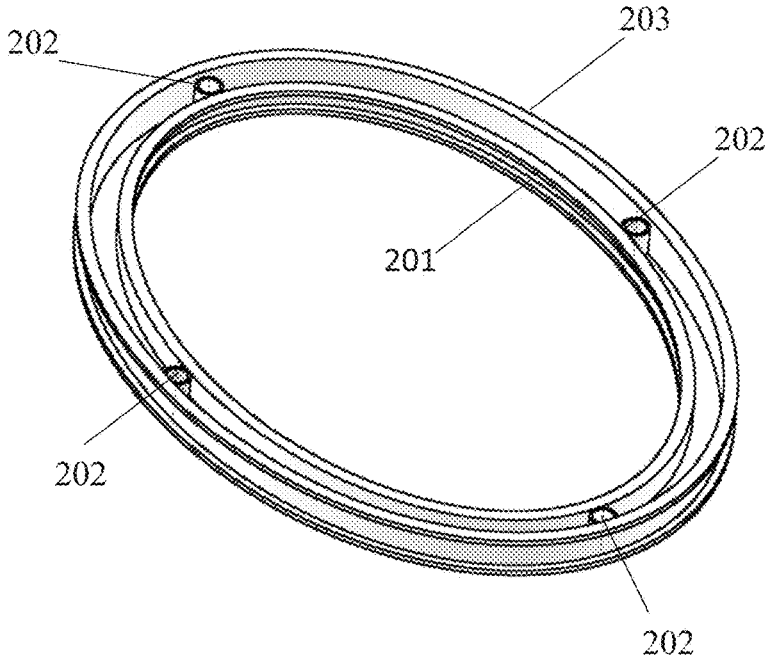
FIG. 9 shows the inner and outer frame of FIG. 8 without strings and without the handle/yolk.

Simulation studies of this inner frame indeed show that buckling is a potential failure condition. The buckling condition that was simulated was based on models of a circular inner frame with a conventional stringing pattern similar to that shown in FIG. 6 (while FIG. 6 shows a racquet strung, the pattern can still be applied to an inner frame). The string pattern of FIG. 6 shows the main and cross strings supported at the mid-plane (z=0) of the frame. These simulation results showed the inner frame was close to buckling for the string tension and string spacing analyzed. The modeling included the string bed modeled with a pattern and mid-plane frame support similar to that shown in FIG. 6.

FIG. 23 shows an inner frame with a staggered string system. While this particular inner frame will be discussed in detail in the embodiment's section, it helps illustrate a staggered string pattern that is not supported at the mid-plane of the inner frame 503 (see FIGS. 23, 24, 25 and 26), but supported at off mid-plane supports (501 and 502 locations in FIG. 24). This staggered stringing, when added to the simulation model, show an increase of 10-15% in the ability of the inner frame to resist buckling when compared to a mid-plane only supported string bed.

The spin control features of the inner frame that are claimed here: i) A closed cross section for a thin-walled tubular shape, and ii) the ability to support the string pattern both at the mid-plane of the inner frame as well as off mid-plane support (the off mid-plane dimension can be as much as thickness or more of the out-of-plane dimension of the inner frame).

Figure 15:
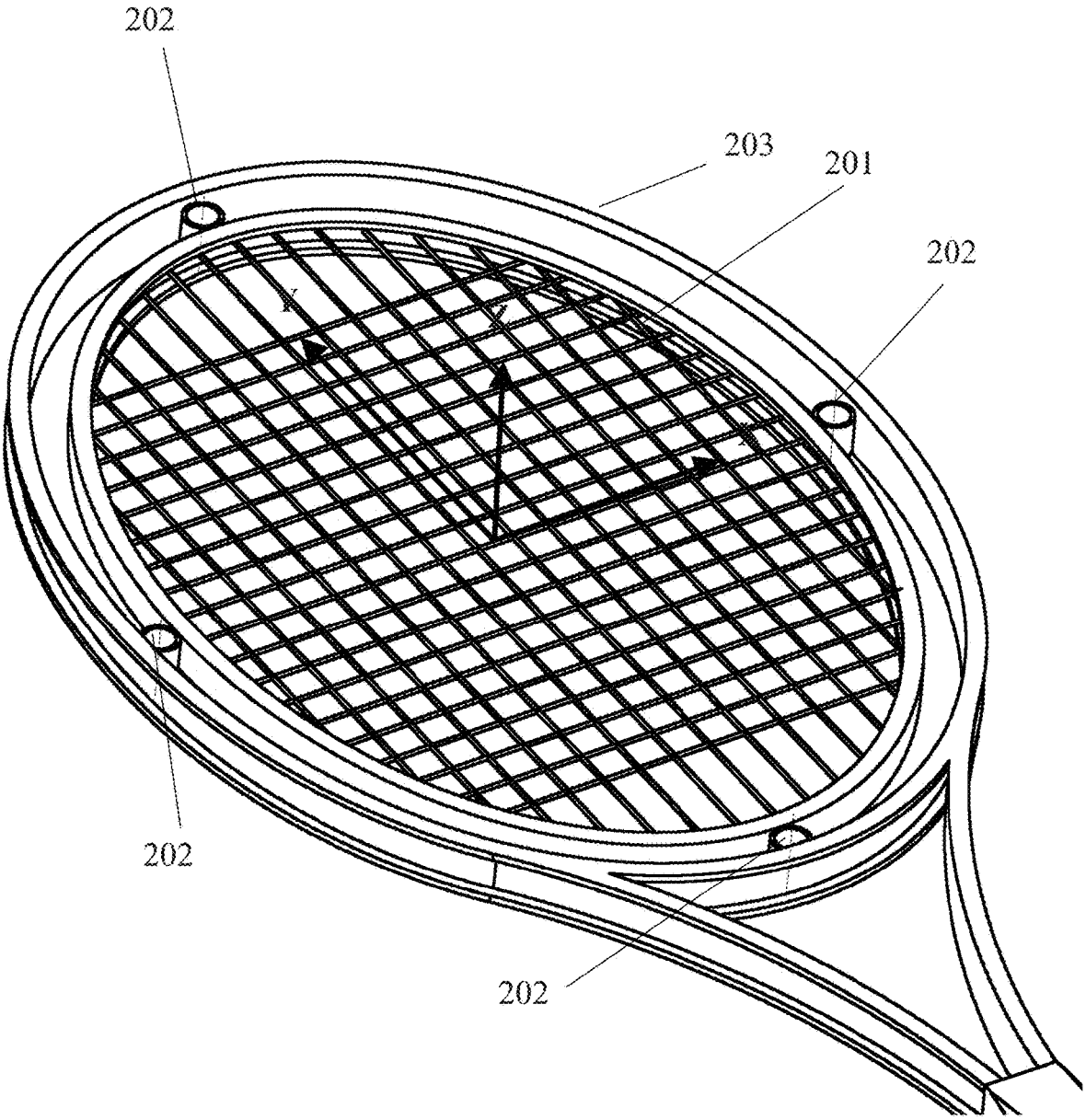
FIG. 15 is a zoomed view of the head of FIG. 8.

The isolation system is another key feature of the spin control system. The isolation system controls the motion of the inner frame relative to the outer frame by any number of methods. In one embodiment, an isolation system (continuous isolators or a collection of discrete isolators), built of any material of known stiffness, provides a mechanical resistance to the motion of the inner frame relative to the outer frame. In other embodiments, pneumatic, hydraulic or electromagnetic means may be used to resist motion between the inner and outer frames. In another embodiment the inner frame may actually nest inside the outer frame and upon impact with the ball may move beyond the outer frame. In any of these embodiments, the material choice or design may allow stiffness that is different for different loading conditions (in-plane XY loading or out-of-plane Z-direction loading, which directions are illustrated in FIG. 15).

Figure 16:
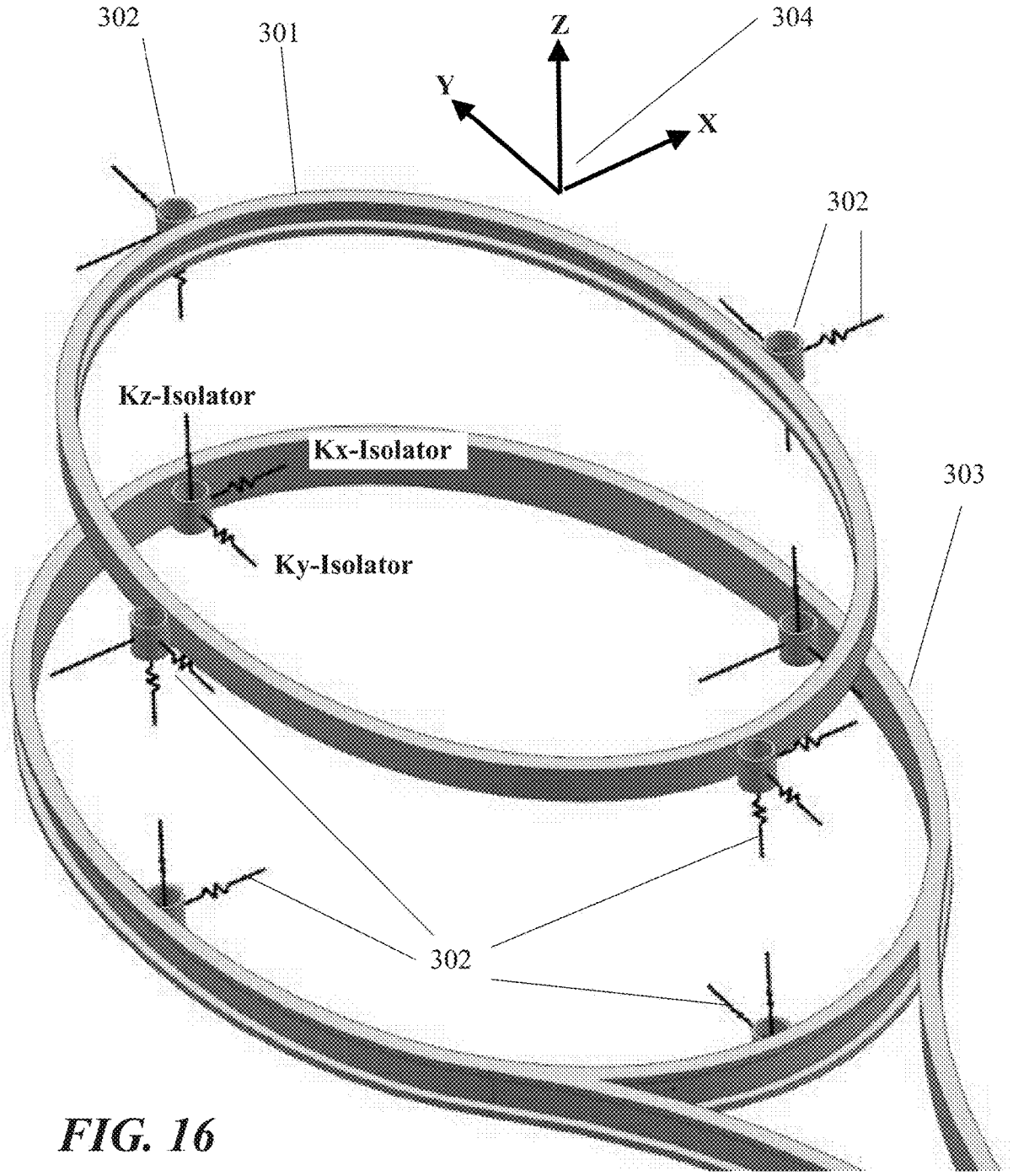
FIG. 16 a spring stiffness schematic of the isolator springs of the generic racquet.

A key feature of the spin control system is the ability to size/tune the isolators to provide increased ball spin rates over conventional racquets. FIG. 16 illustrates 4 "symbolic" isolators 302 that connect the inner frame 301 and outer frame 303 together. To help define the isolators, consider an individual isolator as a spring system as shown in FIG. 16. The isolator at 12 o-clock in FIG. 16 is described by its stiffness: (Kx, Ky and Kz) stiffness or (Kx-Isolator, Ky-Isolator, Kz-Isolator), or (Ktangential, Knormal, Kz), or (Ktheta, Kradial, Kz), respectively. While these springs could literally be springs, the more appropriate view of them is that the Kx, Ky and Kz springs represent the equivalent behavior of the actual mechanical isolator (like the thin walled tubes 302 of FIG. 17) as it connects the inner frame 301 to the outer frame 303. For visualization purposes, the springs are shown in FIG. 16 as split-in-two as they attach the inner and outer frame together.

The interpretation of the isolators 302 in FIG. 16 has been as springs between the two bodies. Other interpretations can include: i) linear or non-linear static springs; ii) linear and non-linear springs that are equivalent to a linear and non-linear dynamic stiffness or compliance; iii) linear or non-linear dampers, causing energy loss between the inner and out frame; iv) any combination of these interpretations. The isolators can be designed so that each isolator is adjustable or replaceable, changing some or all of the characteristics offered here, to cause additional spin and/or accuracy control of the tennis ball during impact.

Another feature of the spin control system is the ability to easily modify the isolation system to effect the play of a racquet. The isolating system could be adjusted, replaced or supplemented to make small or large adjustments in how the racquet performs. These adjustments could take place during a match or after matches. While the adjustments could include replacing the inner-frame/string-system, it could also include removing part or all of the isolating system or replacing it with another or combining multiple isolators at different locations. The adjustments can also include some means of altering the isolating system while connected to the inner and outer frame. This could be done using some sort of tool that modifies the properties of the isolator without removing disconnecting the inner frame from the outer frame. Different isolator combinations could be designed for different playing styles, swing speeds, or talent levels.

Figure 17:
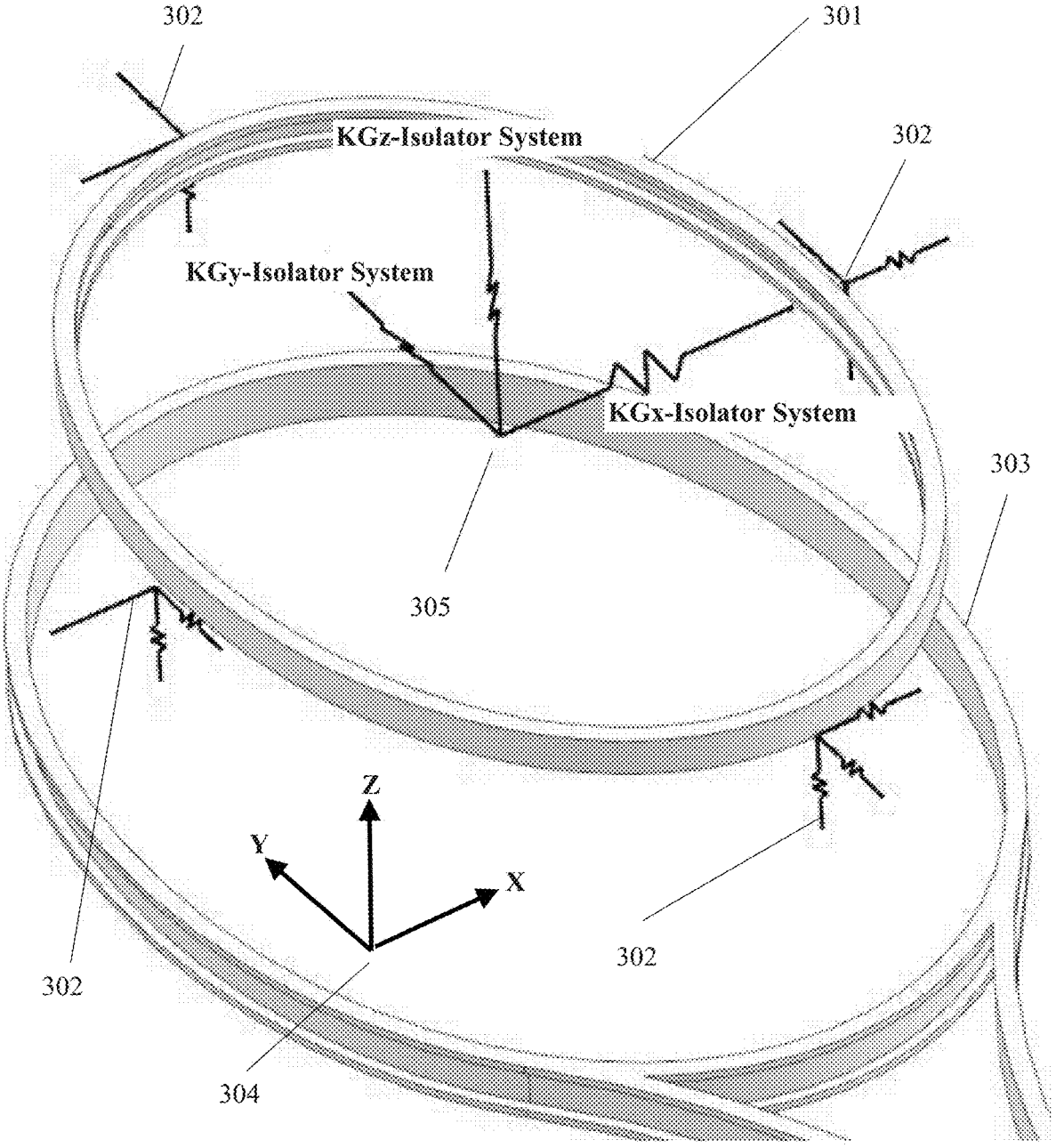
FIG. 17 is a schematic of the equivalent isolator spring stiffness KG of all the discrete isolators of FIG. 16.
Figure 25:
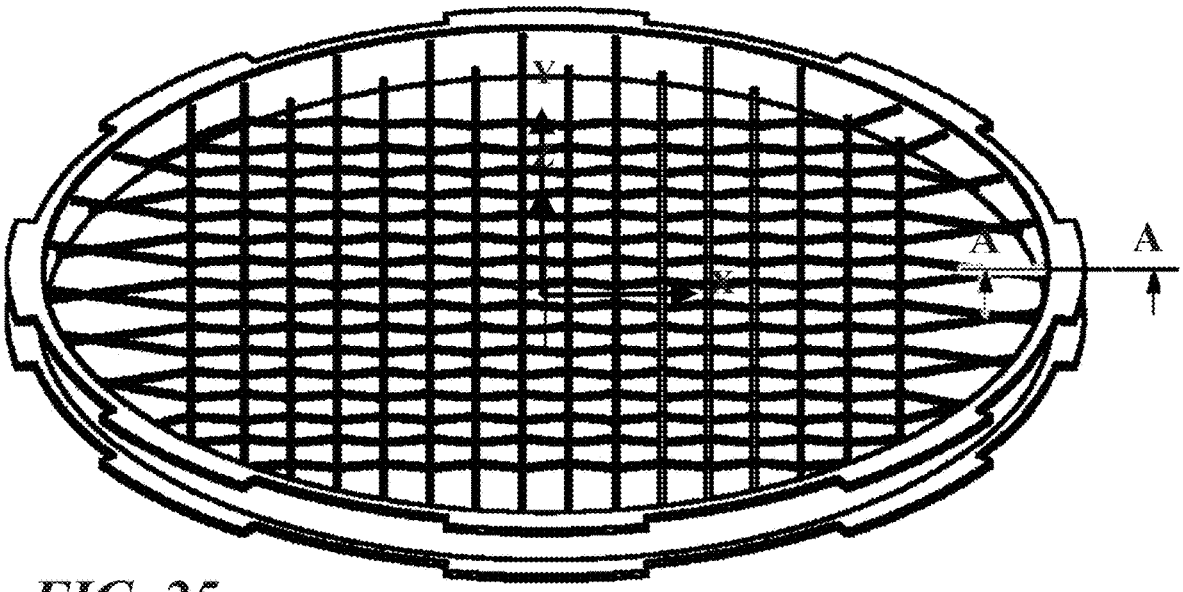
FIG. 25 is an iso view of inner frame with staggered stringing.
Figure 26:
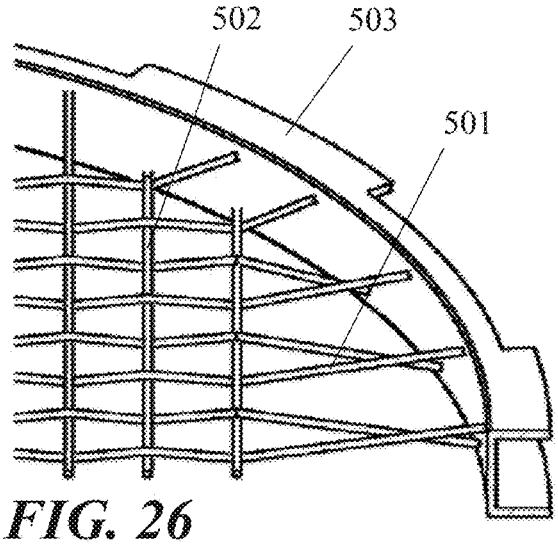
FIG. 26 shows cross-sectional cut A-A of FIG. 25.

The collection of the individual isolators of FIG. 16 can be considered equivalent to the global isolator 305 shown in FIG. 17. This global isolator, represented by (KGx, KGy, KGz), or (KGx-Isolator System, KGy-Isolator System, KGz-Isolator System), represents the connection of the inner frame to the outer frame (hence the collection of all the individual isolators of FIG. 17). The inner frame moves, essentially, as a rigid body on the isolation system (the string system, for out-of-plane deflection, is the exception to the inner frame moving solely as a rigid body; for string bed motion out-of-plane motion, the bed acts as a spring relative to the inner frame; for in-plane motion, the string bed is very stiff for an interwoven string system).

(KGx, KGy, KGz) are adjusted (by adjusting individual isolators Kx, Ky, Kz) to maximize ball spin (and control ball trajectory accuracy; see below) or optimize ball spin for a given player in a given set of conditions. String bed stiffness, measured for a collection of racquets, strings, and string tensions, ranges in stiffness from about 110/130 lbs/inch to 250 lbs/inch (string bed stiffness represents the out-of-plane stiffness a rigid tennis ball would see while center-frame Z-axis loading the bed as the racquet frame is supported).

During ball impact, for a conventional racquet, as the racquet exerts both a normal string-bed force to drive the ball over the net, and a tangential string-bed force to apply top/bottom spin to the ball, the ball is in contact with the string bed between 3-4 milliseconds to 8-9 milliseconds (with an average of 5-6 milliseconds). This contact time is primarily related to the mass of the ball, the dynamics stiffness of the ball and the dynamic stiffness of the string bed (other items can also play a role).

For a conventional racquet, the out-of-plane dynamic stiffness plays a role in determining this contact time (the softer that stiffness, the longer the contact time, and vice-versa; in addition, the ball's inherent dynamic stiffness also plays a fundamental role). In addition, the in-plane loading for a conventional racquet, during impact between the ball and strings/racquet, is quite different than its out-of-plane loading. The tightly-spaced, interwoven string bed is very stiff in-plane as the ball and racquet/string bed are pushing against each other through the frictional contact force. For maximum ball spin, the ball must not slip on the string bed (or slipping must be minimized), and the frictional force, at least during the initial part of this contact, must adequately develop to allow the ball to transition from sliding across the string bed to rolling across the string bed (during this contact time of 5-6 milliseconds). A stiff in-plane string bed stiffness will reduce ball spin by causing the ball to slide and not roll across the string bed.

For the spin control system invention, during ball impact, under the exact same conditions discussed above for the conventional racquet, the response of the ball is entirely different. For out-of-plane ball response, the ball "sees" the out-of-plane string bed stiffness as well as the KGz stiffness of the isolation system (springs in series). If the KGz stiffness is large compared to the string bed stiffness (for example, 3 to 4 times that of the string bed stiffness), then the out-of-plane "performance/power" of the racquet will be similar to a conventional racquet with the same characteristics (assuming the overall racquet and string bed properties are matched up). If KGz is comparable to the string bed stiffness, then the overall system will be softer, and the dwell time of the ball on the string bed will increase.

The in-plane response of this spin control system invention will also be different. The ball will see a more compliant system for the in-plane stiffness KGx and KGy of FIG. 17. Tests/simulations have shown that if Kx and Ky are comparable to the equivalent of the out-of-plane stiffness (ball+string bed+KGz, in series), then an increase in ball spin over a non-isolated system is seen (the stiffness ratios could range from 0.1 to 10.0). An important attribute of this invention is that the stiffnesses of the discrete isolators 302 in FIG. 16 can be varied, as discussed earlier, to maximize ball spin or optimize it for a given player in a given set of conditions. This leads to a compliant in-plane string bed stiffness that will reduce the tangential force needed to take the ball from initially slipping to not slipping (ie, rolling); and a compliant, in-plane string bed can store energy during impact and return that energy to the ball's rotational energy (thus increasing ball spin).

Another feature of this spin control system invention is the ability to easily remove the inner frame and isolators and replace with another set of different isolators and/or different pre-strung inner frames. The simple inner frame insert allows for easy stringing of the inner frame. This "insert" design allows for automated stringing of the frame and the opportunity of patented designs of corresponding stringing machines. Inner frames of varying properties could be swapped out to offer different playing characteristics in combination with a given set of isolators.

The outer frame of this invention can be similar in size and shape to almost any racquet that is available today. Its weight will be less than most racquets in order that, when combined with the weight of the isolators and inner frame, the assembled weight would be comparable to racquets available today. In addition to the reduced weight restriction, the outer frame's key properties of this invention would include: i) A design that would structurally support the isolation system; a sound structural connection that would transfer load between the inner frame and the outer frame; ii) a frame design that would allow for adequate sway space for in-plane and out-of-plane motion of the inner frame relative to the outer frame; in-plane sway space motion could be 0.2 inches or more; out-of-plane motion could be similar; iii) an outer frame design that would allow for the easy removal of the isolators, or for in-position changes of the isolators; iv) a frame, when combined with the isolators and inner frame, would result in an overall rigidity comparable to existing racquets.

Figure 101:
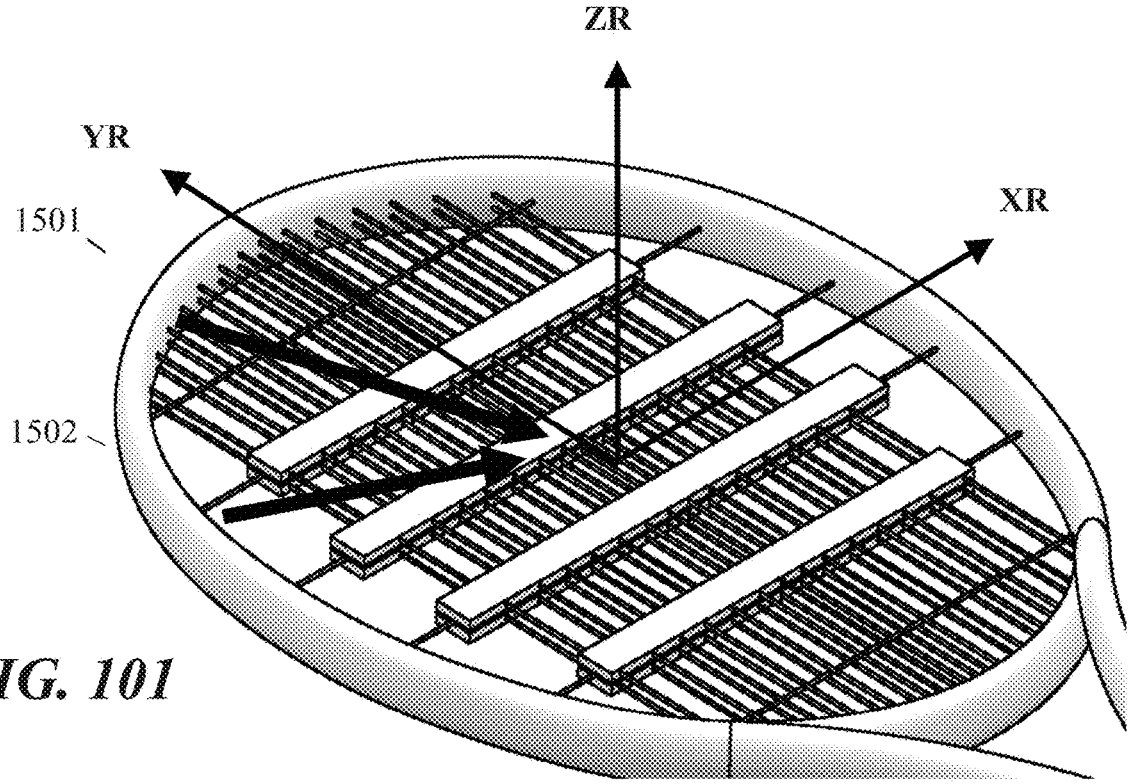
FIG. 101 is an iso pictorial of incoming tennis ball projected trajectories onto a spaghetti racquet.

Another important property of the spin control system invention is the ability to generate consistent and controllable spin, with properly designed isolators, for complex positions of the racquet as ball contact is made. Referring to FIG. 17, if each discrete isolator has the same stiffness in the X and Y directions of coordinate system 305 (Kx and Ky of FIG. 16), it can be mechanically shown that the global stiffness KGx and KGy of FIG. 17 is the sum of the individually stiffnesses Kx and Ky of each isolator. Since KGx and KYy are the same value, it can be shown mathematically that the stiffness that the inner frame "sees" in any in-plane direction is exactly the same (the KGx=KGy value). This allows the tuned isolation system to respond exactly the same no matter the direction that in-plane load is applied. FIG. 101 illustrates a tennis ball's incoming projected trajectory onto the spaghetti racquet XR-YR plane is path 1501. While the spaghetti will offer some kick-back rotational spin increase for path 1501, path 1502 will improve ball spin; and path XR, the most effective re-bound energy direction, will offer the best opportunity to improve ball spin. The spaghetti racquet's (and similarly open string pattern racquets') ability to offer spin increase is directionally dependent on ball impact direction as implied in FIG. 101.

Figure 102:
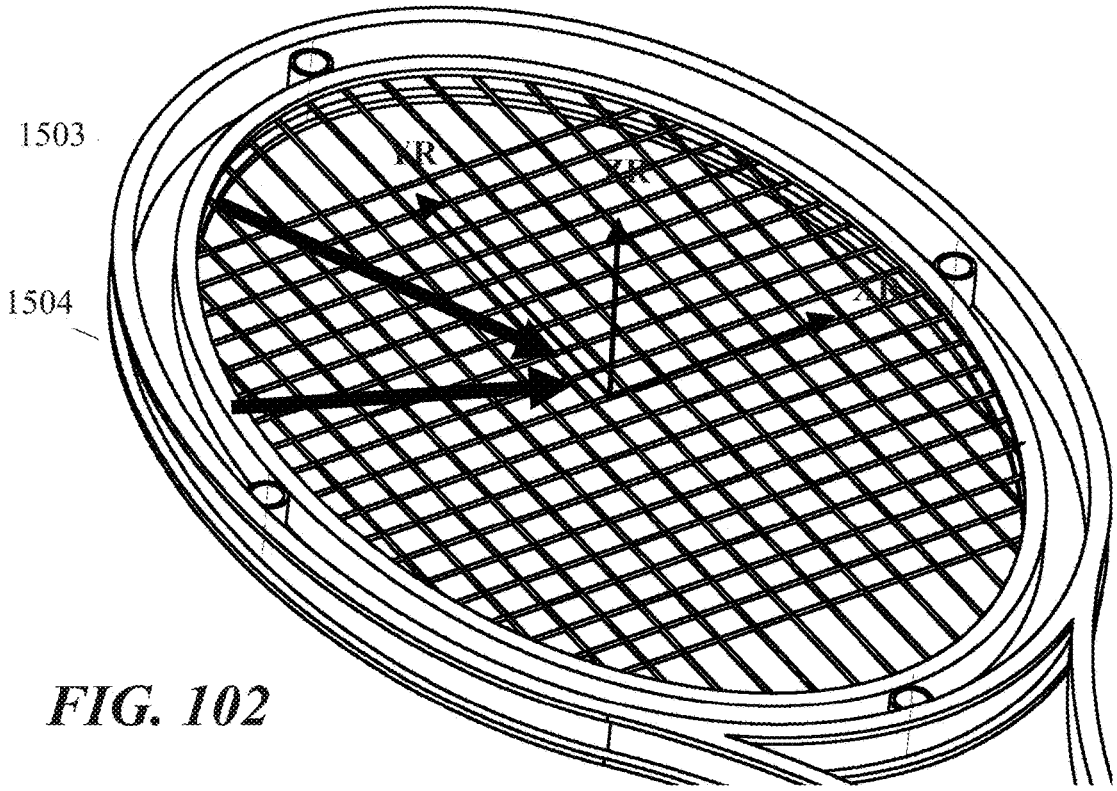
FIG. 102 is an iso pictorial of incoming tennis ball projected trajectories onto the invention (generic depiction)

FIG. 102 illustrates the same condition just discussed for the proposed spin control system invention. For the condition of Kx and Ky equal and the same for all isolators, KGx and KGy are equal. Hence the in-plane stiffness that the inner frame 'delivers' to the ball, for any in-plane direction, including 1503, 1504, XR and YR (of FIG. 102), is the same. The proposed spin control system invention can be designed to be a directionally independent system. Conversely a combination of isolators could be intentionally introduced to provide a different stiffness in the XY plane at varying angles as desired for a given player.

Figure 103:
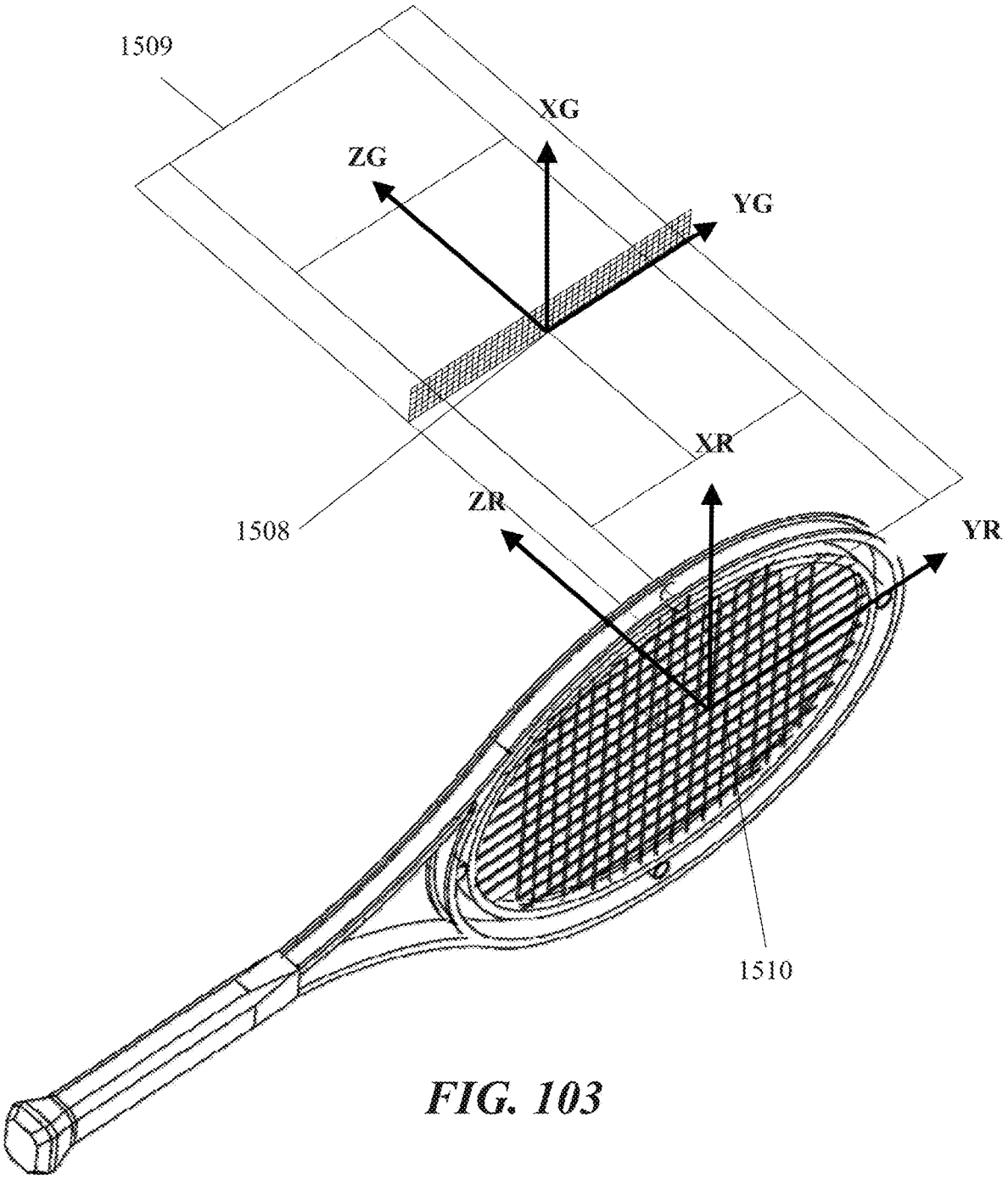
FIG. 103 is an iso depiction of a racquet swing at ball impact to illustrate court and racquet coordinate systems.
Figure 104:
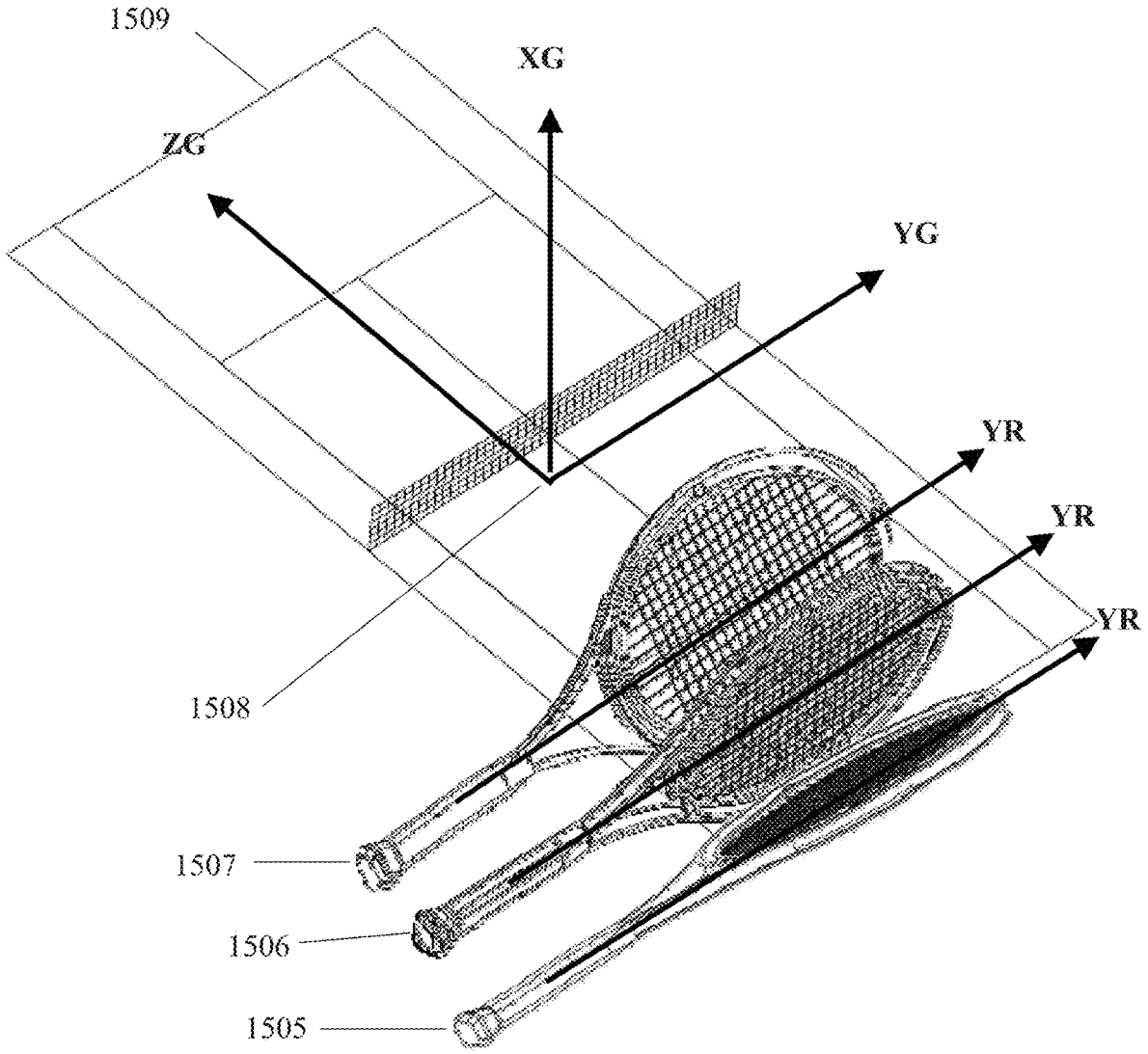
FIG. 104 is an iso depiction of a racquet swing movement to illustrate court and racquet position.

FIG. 103 illustrates a depiction of a racquet that is being swung and defines the court coordinate system and the racquet coordinate system. The global coordinate system 1508 is fixed on the tennis court 1509, and coordinate system 1510 is moving with the racquet. FIG. 104 illustrates a racquet being swung, as it goes from the open frame position 1505, to the position 1506 where it makes ball contact, to the closed face 1507 position after ball contact. At the moment of ball impact, the local racquet axes 1510 (see FIG. 103 and position 1506 of FIG. 104) are lined up with global axes 1508. Hence at impact, the racquet is parallel to the ground (the YG-ZG plane). In this case the YR-axis does not intersect the ground (see FIG. 104).

Figure 105:
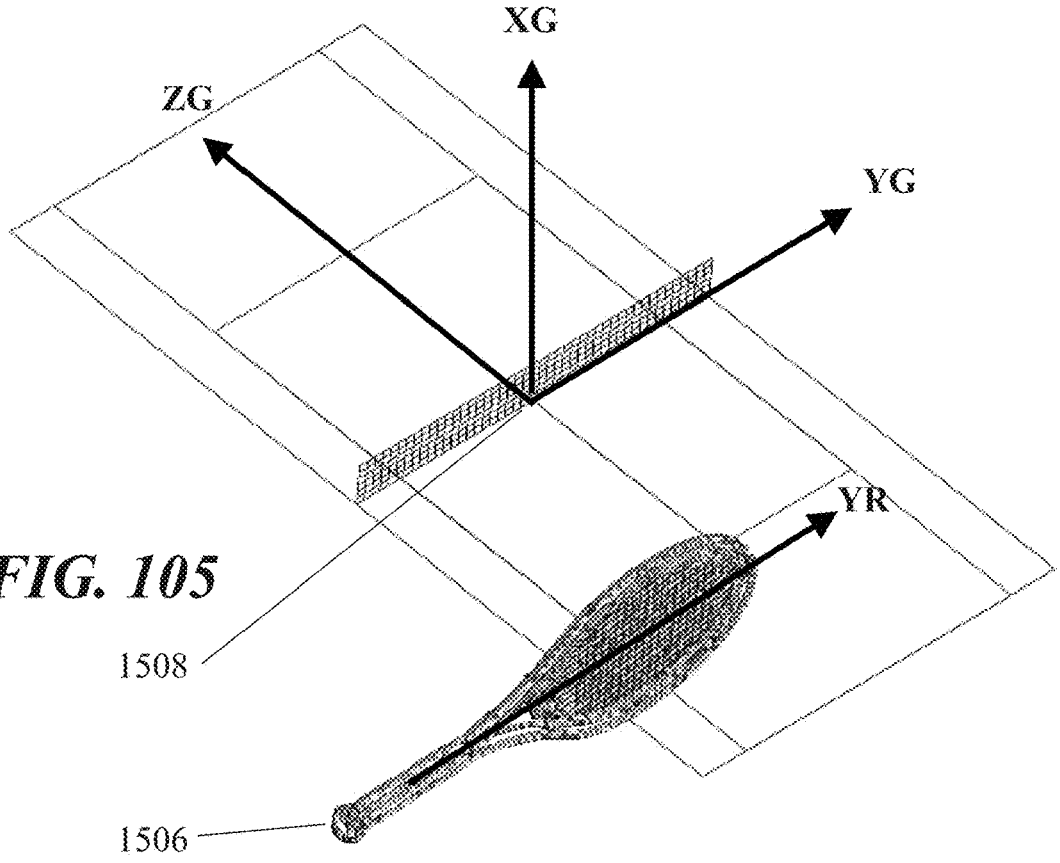
Figure 106:
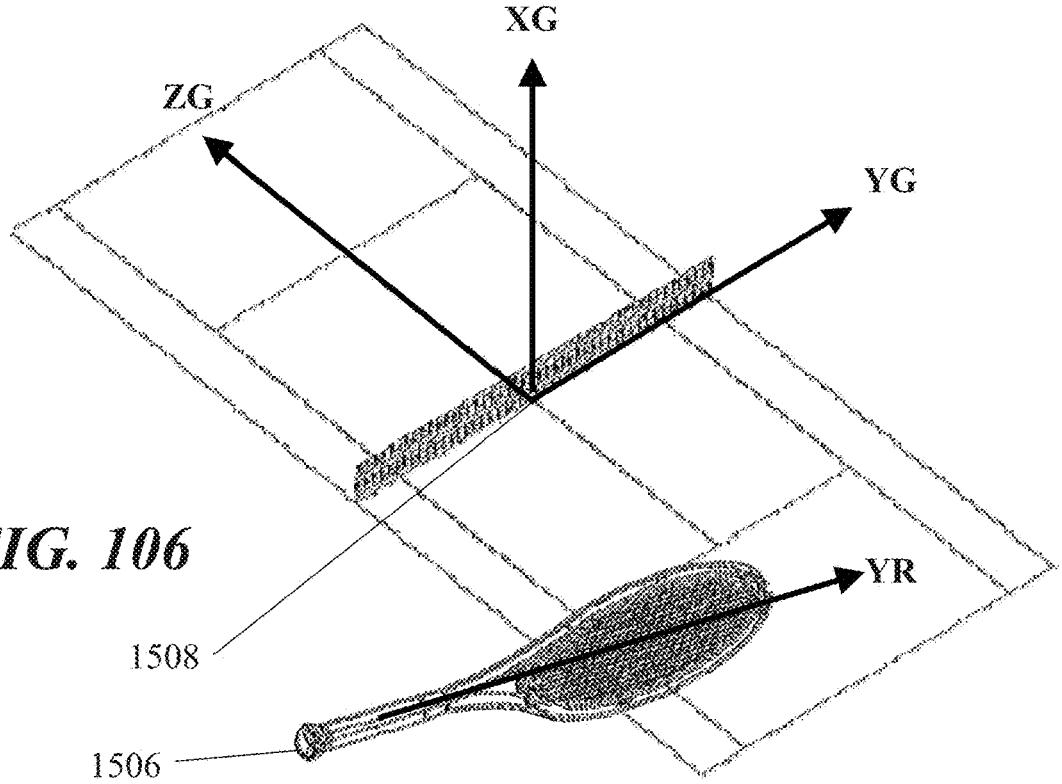

FIGS. 105 and 106 show contrasting racquet swings. Ball impact occurs in position 1506 for FIG. 105. A ball impact for this situation would get maximum spin effectiveness for a spaghetti or open string pattern (as well as the present invention). The resulting trajectory will occur in an XG-ZG coordinate plane.

For a swing illustrated in FIG. 106 for position 1506, the results are different. Position 1506 could occur when a player is striking a ball near the ground (not an un-common situation). Note that the XR axis intersects the ground for position 1506, and the swing would cause a ball impact similar to vector 1501 or 1502 of FIG. 101 (for the spaghetti), or 1503/1504 of FIG. 102 for the spin control system invention. Since the racquet swing motion is from minus XG to plus XG for top spin, while the racquet rotates about the YG axis, the spaghetti (or open string pattern) would cause a ball spin somewhat about YR and not YG. This would cause a reduced spin effectiveness of the racquet, as well as spin would occur about the YR axis. YR-axis spin would cause the ball aerodynamically to move out of an XG-ZG plane; this means a reduction in control/accuracy of the spaghetti or open string pattern system. In contrast, for this invention, there would no reduction in spin effectiveness of the racquet (see FIG. 102 discussion), and the racquet system design, with the previously defined player's swing motion 1506, would cause a ball rotation about YG and not YR. This would result in a pure XG-ZG plane trajectory, hence providing an effective increase in ball spin, with the corresponding control and accuracy.

Another objective of this patent is to increase re-bound accuracy when a ball impacts the string bed/inner frame supported by a tuned isolation system. This rebound accuracy is measured by the angle the ball rebounds off of the string bed.

Figure 107:
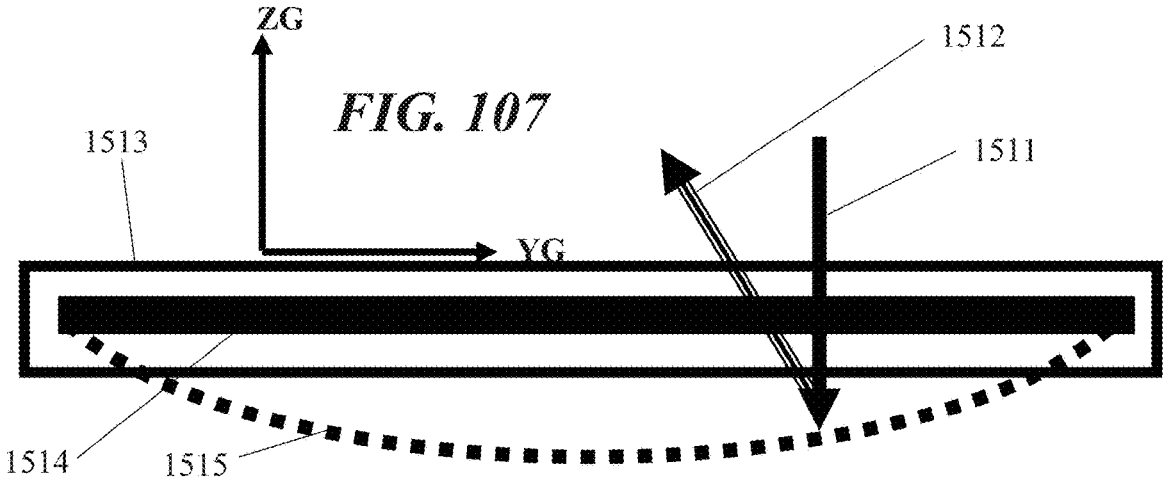
Figure 108:
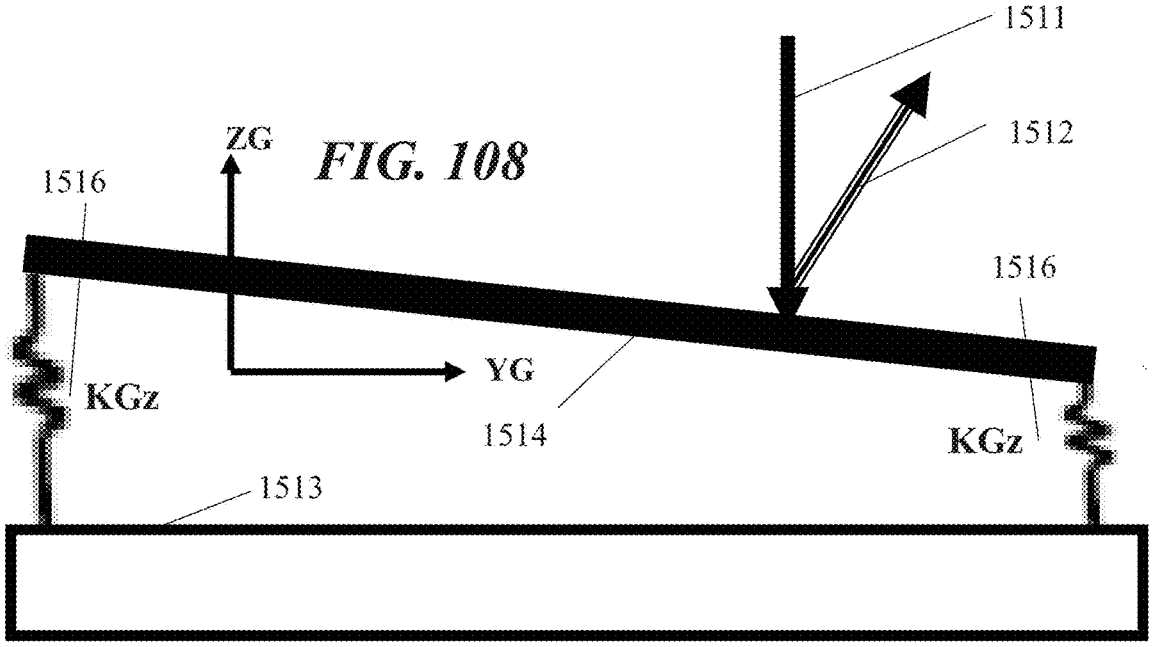
Figure 109:
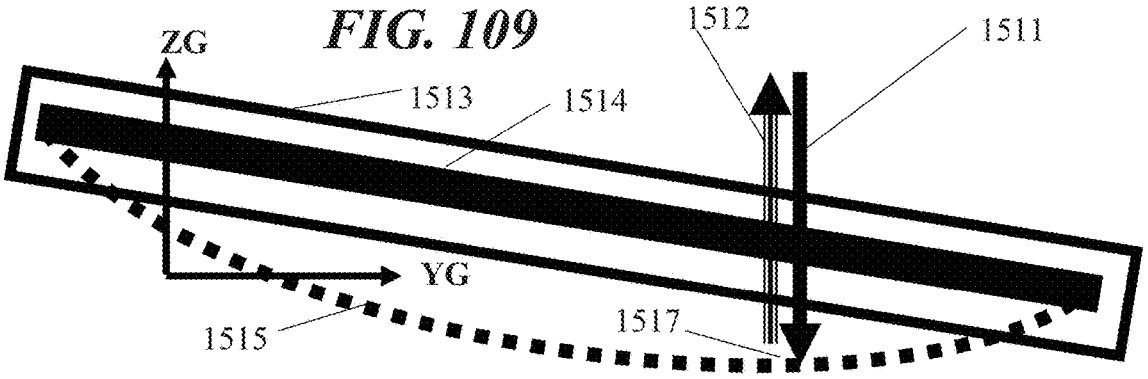

FIGS. 107 through 109 illustrate a pictorial for a ball rebound situation. FIG. 107 is a plan view (view is from the minus XG-direction; refer to FIG. 105). The head 1513 of the racquet is shown schematically as an open rectangle (the handle could be on the left side in FIG. 107 in the minus YG direction). The inner frame is shown as the bold rectangle 1514. In FIG. 107, there is no isolation system and the inner frame is hard mounted to the outer frame. Consider a ball impact, direction 1511 that is not centered on the racquet face. The flexible string bed will deform to position 1515 (exaggerated), and ball rebound would take path 1512 to the left. The rebound direction 1512 is complicated, but the ball will rebound to the left.

FIG. 108 shows a situation where the string bed is very stiff (it does not deflect), and the isolation system is made flexible with some stiffness KGz (this is the out-of-plane stiffness of the isolation system; this stiffness and its control is another attribute of the proposed invention). The same off center impact occurs in FIG. 108 with direction 1511, but the rebound is direction 1512 with a rebound to the right.

FIG. 109 shows a re-bound from a properly tuned spin control system invention. For a flexible string bed (FIG. 107), and a flexible isolation system (FIG. 108), the rebound illustrated in FIG. 109 is the sum of those two effects. Since the two rebounds of FIGS. 107 and 108 oppose each other (at least the rebound direction), it is possible to choose KGz, given the string bed stiffness, to cancel the competing rebounds and produce the rebound 1512 shown in FIG. 109. The rebound 1512 is in the plus ZG direction (note the normal to the string bed at point 1517 is the ZG-direction). Hence another attribute of this invention is the increase in rebound accuracy by isolator adjustment (stiffness KGz).

Figure 27:
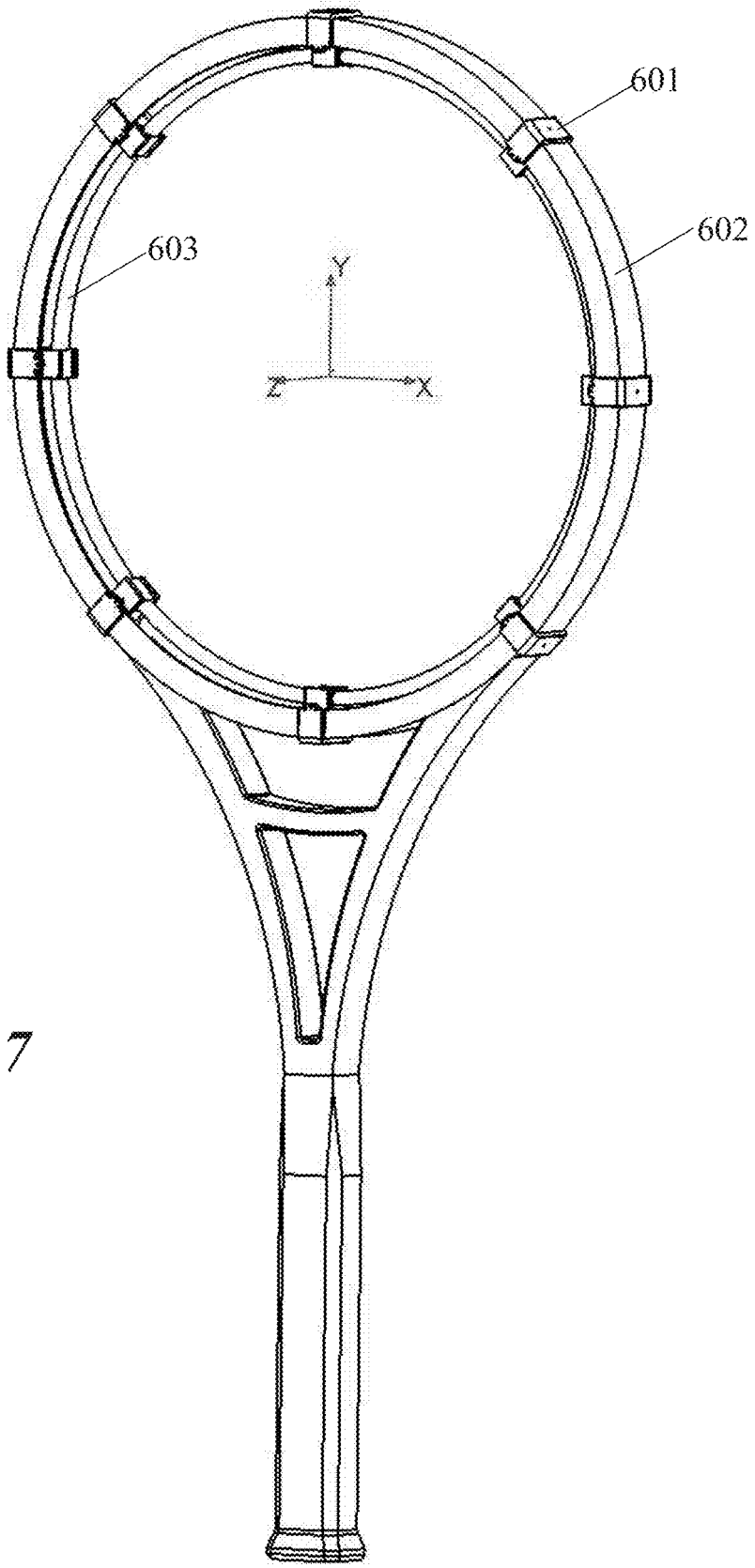
FIG. 27 shows an Inner Frame and Outer Frame held together by 12 Clip/Isolators.
Figures 28A, 28B, 28C:
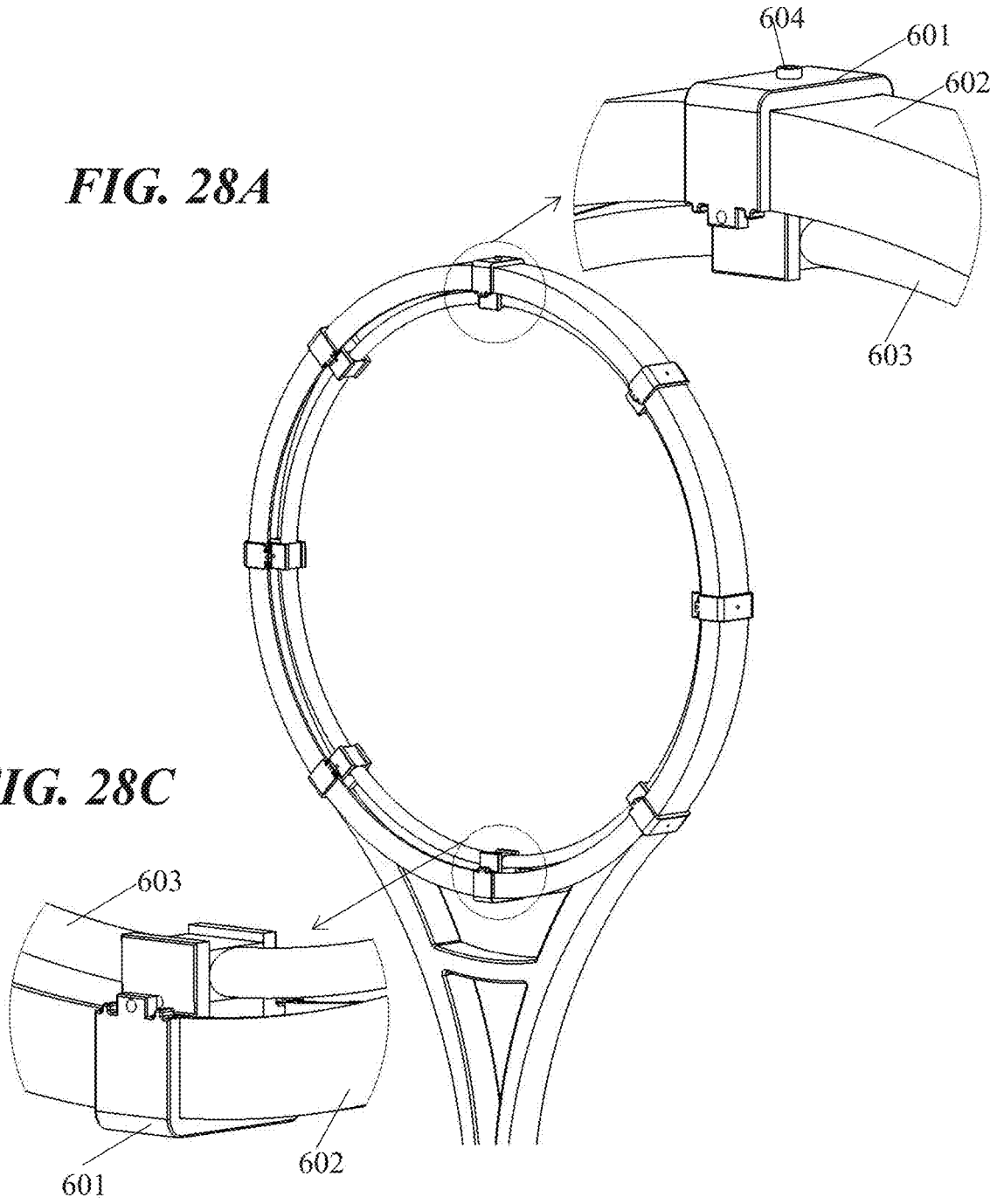
FIG. 28A shows a zoomed iso of FIG. 27.
FIG. 28B is a zoomed iso of one of the Clip/Isolators.
FIG. 28C is a zoomed iso of another Clip/Isolator.
Figure 31:
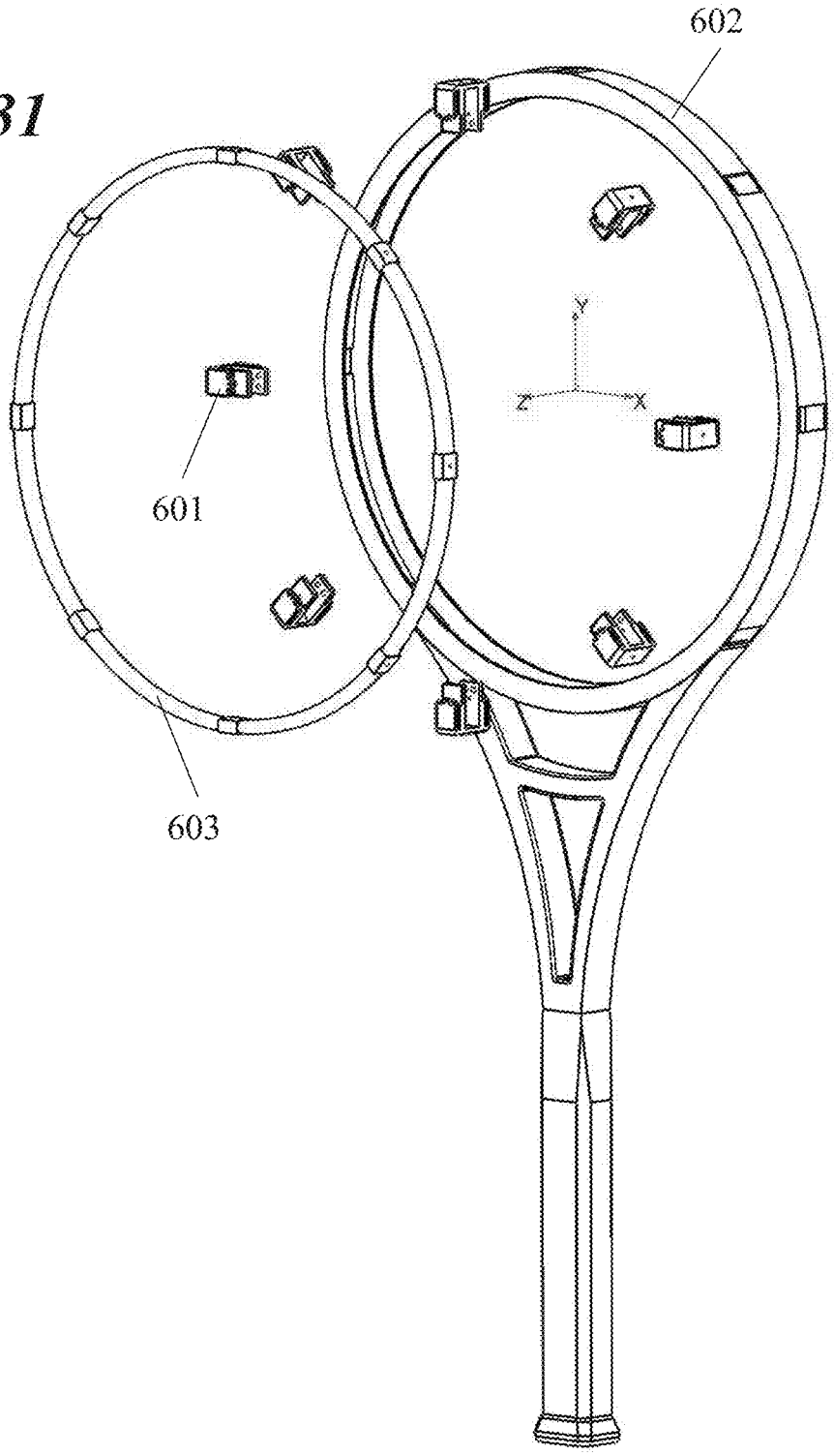
FIG. 31 is zoomed view showing 12 Clip/Isolators for a single Inner Frame and Outer Frame.
Figures 32A, 32B:
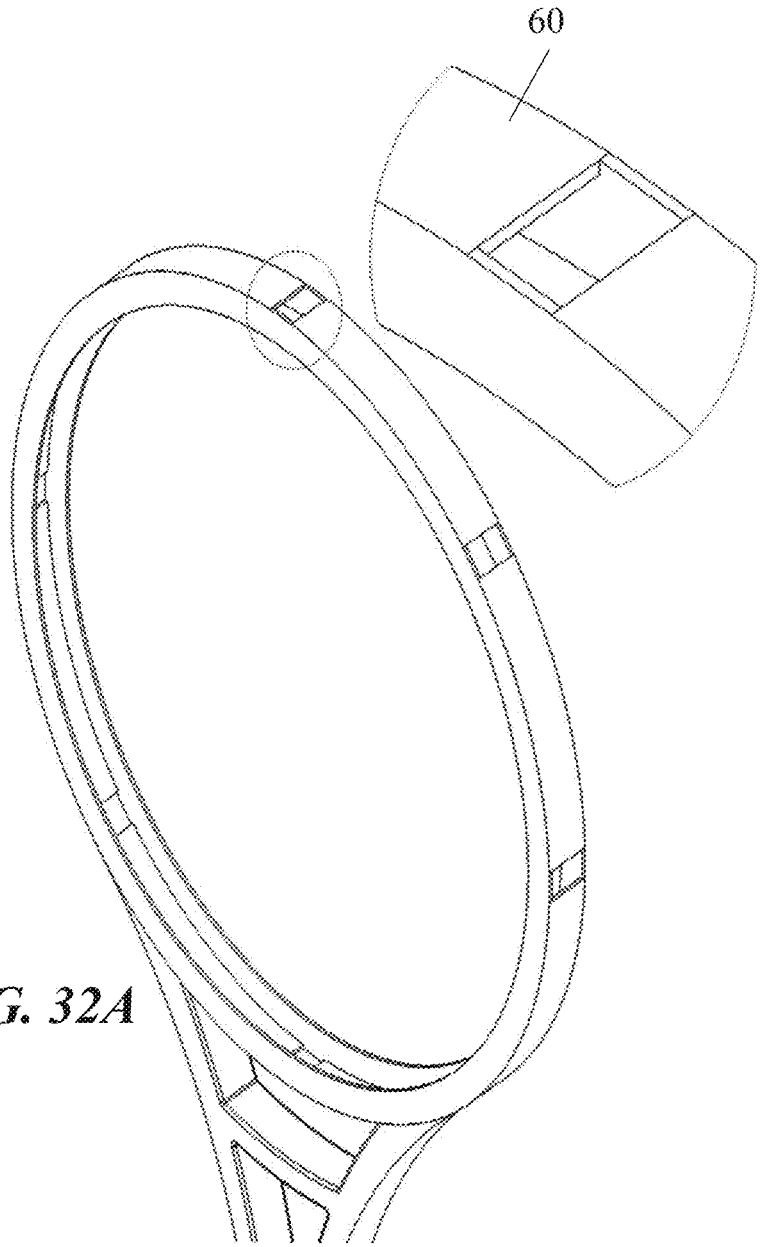
FIG. 32A shows a Receiving Slot in the Outer Frame in which the Clip/Isolator is docked.
FIG. 32B is a zoomed view of FIG. 32A.
Figures 35, 36:
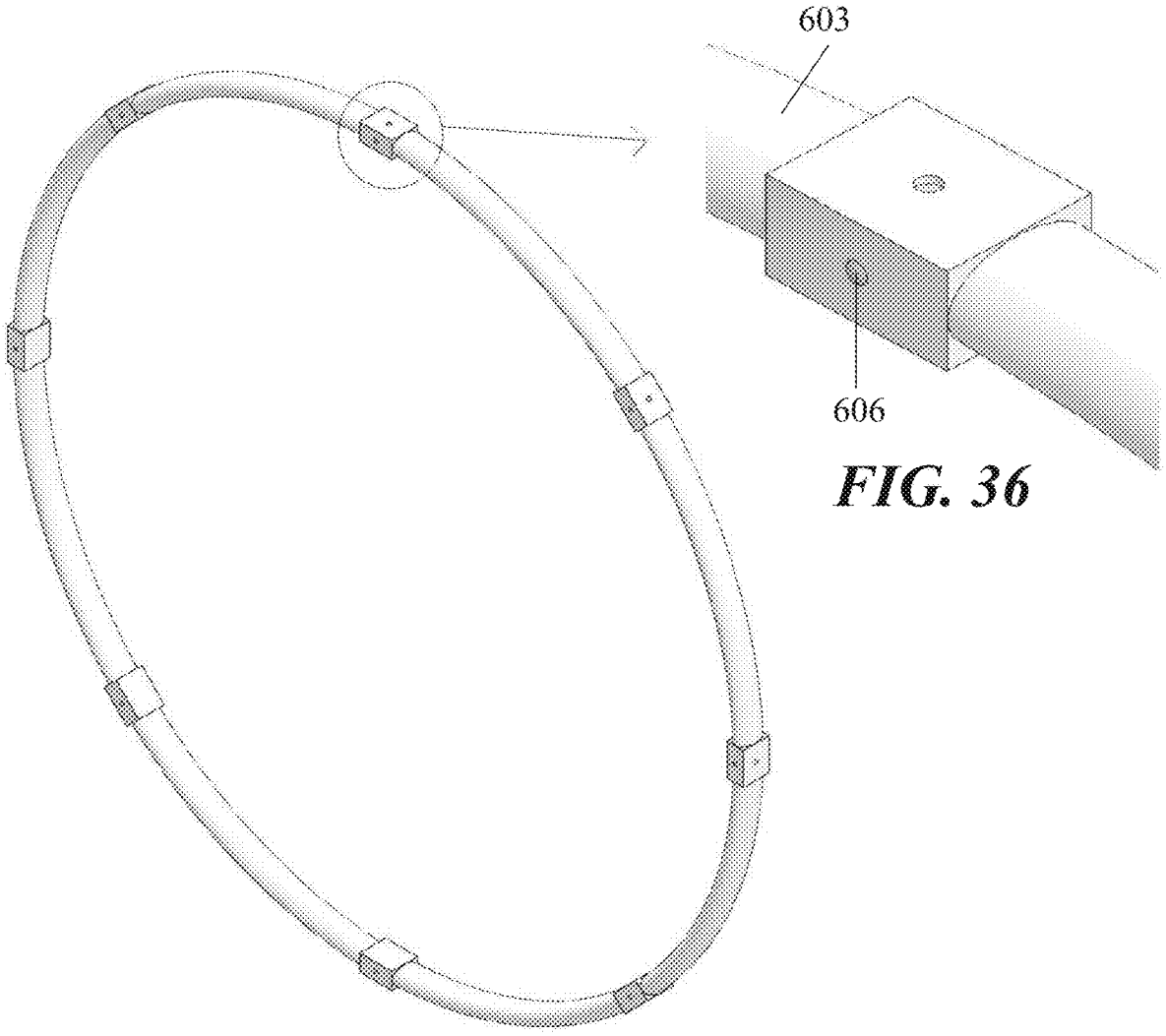
FIG. 35 shows an inner frame with 12 block Docking Features that accept the Clip/Isolators.
FIG. 36 is a zoomed area of FIG. 35 showing an in-plane spring attachment hole and potential ball bearing.
Figure 40:
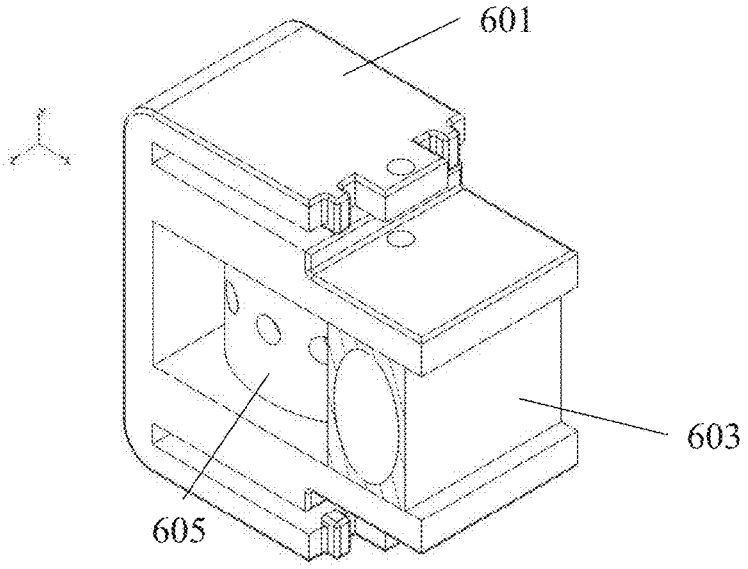
FIG. 40 shows an iso view of the Clip/Isolator, showing inner frame, the in-plane spring, and clip mounting arms.
Figure 41:
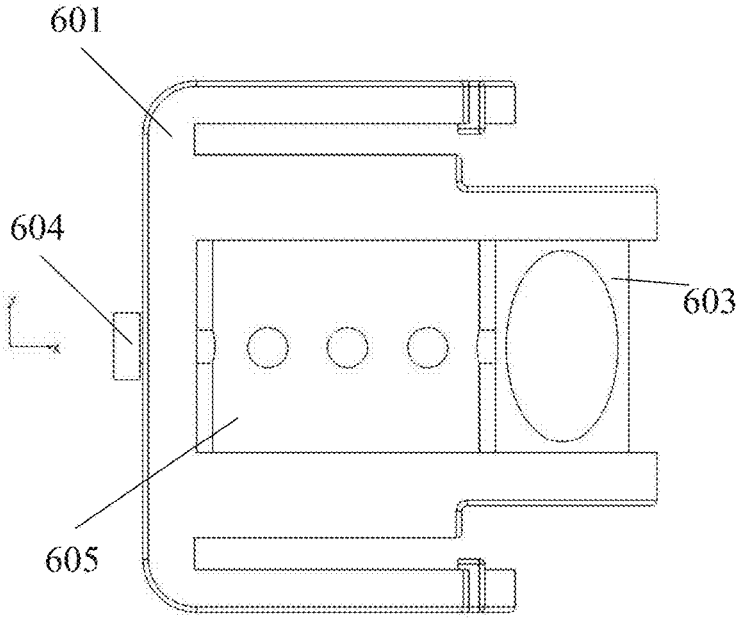
FIG. 41 is a side view of FIG. 40 showing a tensioning bolt for the in-plane spring and retaining tabs.
Figure 42:
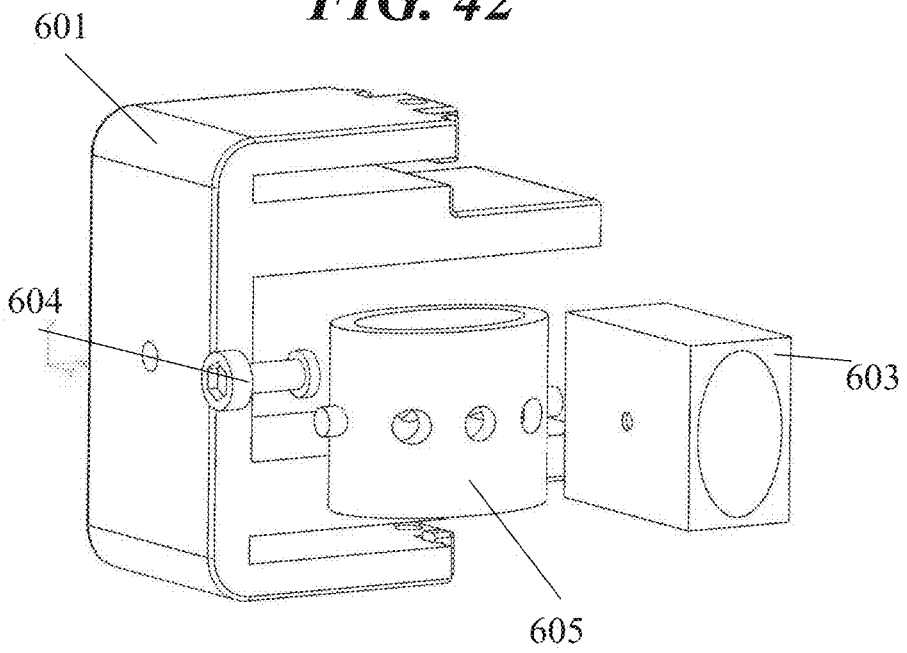
FIG. 42 shows an exploded view of the Clip/Isolator exposing two Male Bosses on the spring and a corresponding hole on the inner frame.
Figure 43:
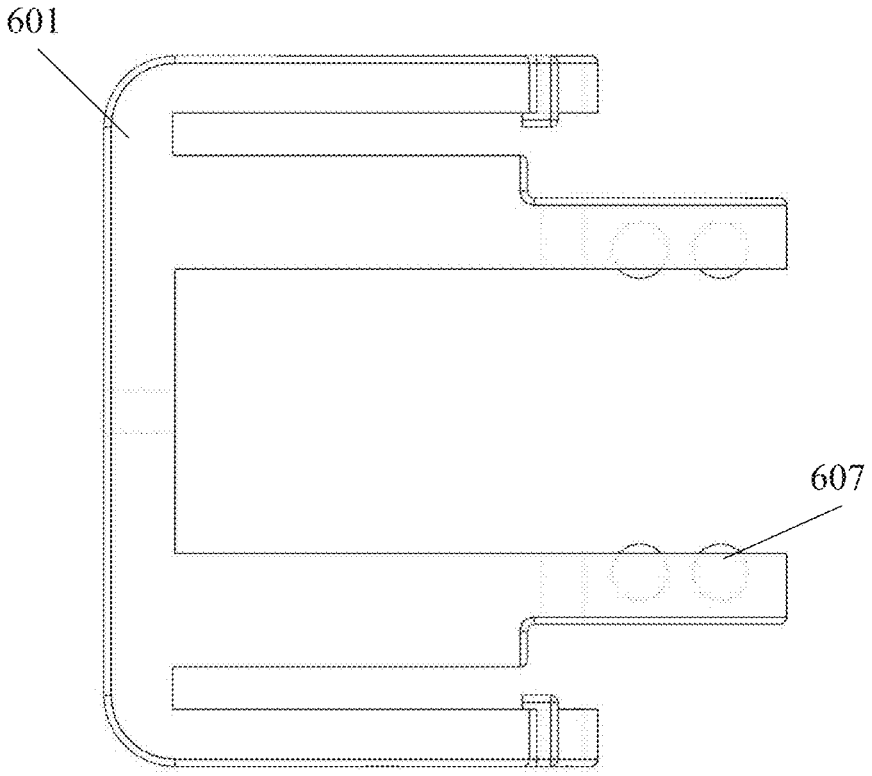
FIG. 43 shows a side view of the Clip/Isolator exposing ball bearings attached to the supporting arms.
Figure 44:
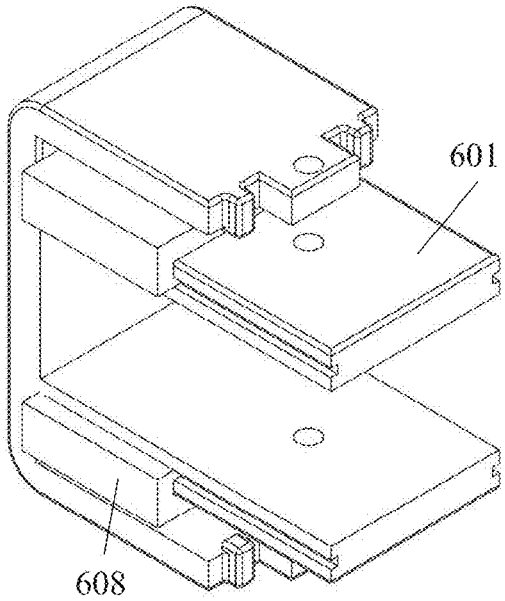
FIG. 44 shows a clip iso view with a sliding support that adjusts out-of-plane Clip/Isolator stiffness.
Figure 45:
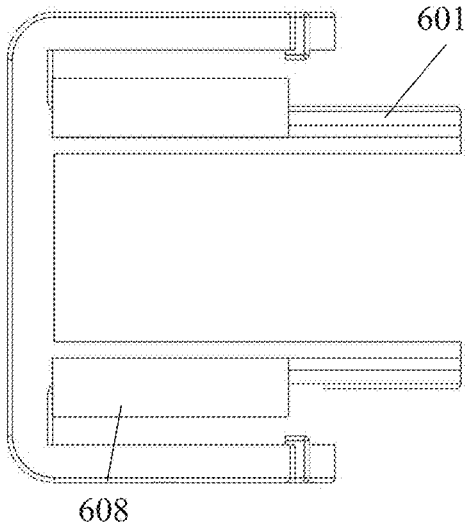
FIG. 45 shows a side view of FIG. 44.

FIGS. 27-47 are an example of a more detailed and manufacturable system that is assumed to incorporate the qualities of the generic system described earlier. A very brief review of this design is first presented, followed by a more complete explanation. FIG. 27 shows an Inner Frame 603 and an Outer Frame 602 that are held together by an Isolator 601 and which is attached to the Outer Frame by a Fastener 604 in FIG. 28A. FIGS. 28A, 28B and 28C show a detailed view of the assembled configuration. FIG. 30 is a section view of Figure where an Isolator 605 is shown and housed between the Isolator, the Inner Frame and the Fastener. FIG. 31 is an exploded view showing 8 equally spaced multiple Clips/Isolators for a single Inner Frame and Outer Frame. FIGS. 32A and 32B show a Receiving Slot in the Outer Frame 602 in which the Isolator component is inserted. FIG. 34 shows a cross section of the Outer Frame in FIG. 33. This open channel shape allows the Inner Frame, supported by the Clip/Isolator, adequate sway space for in-plane motion (x-y plane). FIG. 37 shows the Inner Frame 603 with 12 Docking Features 606 intended to interface with the Clip/Isolator 601. FIG. 38 shows a cross section of the Inner Frame 603 through the Docking Features in View A-A of FIG. 38. FIG. 39 shows a cross section in View B-B through the remainder of the Inner Frame. FIG. 40 shows an iso view of the Clip/Isolator, and FIG. 41 shows a side view of the Clip/Isolator and a section of the Inner Frame. The Clip/Isolator consists of an Upper Arm, a Lower Arm and two Inner Arms as shown in FIG. 40. FIGS. 40 and 41 show a retention feature on the distal end of the upper and Lower Arm can be seen. FIG. 42 shows an exploded view where two Male Bosses on the in-plane spring 605 can be seen as well as a female receiving feature on the Inner Frame 603. FIG. 43 shows ball bearings attached to the Clip/Isolator extending arms 607. FIG. 44-47 shows the Clip/Isolator with several positions of the Support Bar 608 for control of the out of plane stiffness of the Clip/Isolator.

The assembly, function and features of the design described in FIGS. 27-47 follows: The circular Inner Frame 603 is centered in the Z-direction inside the Outer Frame 602 in FIG. 27. The Docking Features 601 of the Inner Frame 602 in FIGS. 28A, 28B and 28C align with the Receiving Slot in the Outer Frame 602 of FIGS. 32A and 32B. The Docking Features on the Inner Frame 603 of FIG. 37 are of a different cross section than the rest of the Inner Frame (see FIGS. 38 and 39) to ensure the appropriate interface with the Clip while maintaining the low weight and strength necessary for the Inner Frame. One possible material for the inner frame is a low weight, high strength graphite composite to help achieve a low target weight of 30-35 grams.

The inner frame 603 in FIG. 31 is centrally placed in the outer frame 602, and the Clips/Isolators are then radially inserted thru the Receiving Slots in the Outer Frame, thus capturing the inner and outer frame together. Retention features in FIGS. 40 and 41 on the upper and Lower Arms of the Clips/Isolators lock the Clips/Isolators onto the Outer Frame 602 in FIG. 32 by docking into a receiving feature on the Outer Frame.

The Clip/Isolator 601 of FIG. 40 captures the inner frame 603 of FIGS. 40 and 41. Pre-assembly of the Clip/Isolator allows the in-plane spring 605 of FIGS. 40 and 41 to be inserted/replaced, hence adjusting the in-plane stiffness of the Clip/Isolator system. In this design the spring 605 can be of various geometric shapes and materials to provide varying stiffness in the x-y plane. The Isolator spring 605 in FIGS. 42 and 43 is housed between the two Inner Arms of the Clip/Isolator and inside the Receiving Slot in the Outer Frame 602 of FIGS. 32A and 32B, and the outside of the Inner Frame 603 Docking Features in FIGS. 35 and 36. This configuration allows for the Clip/Isolator to provide out of plane stiffness in the Z-direction in order to support the Inner Frame. The geometry and material of the inner extending support arms of the Clip/Isolator shown in FIGS. 40 through 43 could similarly determine the stiffness in the Z-direction and potentially independent from the stiffness in the x-y plane allowing for a tuning of the system. The top and bottom (Z-direction) surface of the inner frame 603 of FIG. 42 slides on the surfaces of the inner arms of the Clip/Isolator of FIG. 42. Since the friction between these surfaces could restrict in-plane motion of the Inner Frame, FIG. 43 shows another option for providing stiffness in the out of plane Z-direction where ball bearings 607 could be included to minimize the friction in the X-Y plane as the Inner Frame moves relative to the Outer Frame. The ball bearings could be mounted on the Clip/Isolator arms as shown in FIG. 43, or alternatively the bearing 606 of FIG. 36 could be mounted in the docking section of the Inner Frame 603 of FIG. 35. Other options, not shown, to minimize the friction might include a thin layer of any number of materials between the Inner Frame and Outer Frame that help to minimize friction in the X-Y plane while maintaining the stiffness necessary in the out of plane Z-direction. For both the ball bearings and friction reducing material, another objective is to minimize any rattle or vibration between the Inner Frame and the inner arms of the Clip/Isolator during and after impact with the ball. An interference fit that would pre-load the inner arms of the Clip/Isolator could reduce such vibration.

The in-plane spring 605 of FIGS. 40 through 43 shows two Male Bosses oriented to engage with the female receiving feature on both the Inner Frame and the Clip/Isolator.

The Docking Feature on the spring, in this case a Male Boss, could be of various designs to ensure the appropriate orientation of the spring to provide the correct playing characteristics. As shown in FIG. 31, any number of positions and styles of Clips/Isolators and Inner Frames can be easily interchanged to alter the stiffness in the X-Y directions and the Z-direction. The spring 605 of FIG. 42 can be pretensioned using adjusting bolt 604 of FIG. 42 to alter the stiffness of the spring in the X-Y plane and therefore change the playing characteristics.

Figure 46:
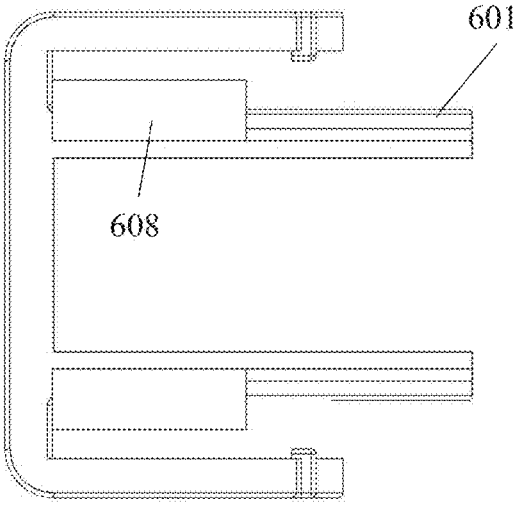
FIG. 46 shows a side view of FIG. 44 with a slider support position causing a flexible out-of-plane support.
Figure 47:
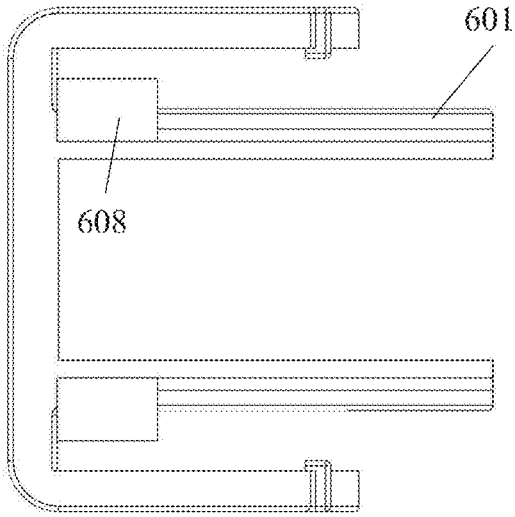
FIG. 47 shows a softer position for out-of-plane support.

FIGS. 44-47 show the inner arms of the Clip/Isolator with an adjustable Support Bar 608. The geometry and material of this Support Bar is one method of adjusting the stiffness in the out of plane or Z-direction. FIGS. 46 and 47 show the Support Bar of two different lengths which allows the inner arms 601 of FIGS. 44 through 47 to be cantilevered over different lengths. These positions allows for the adjustment of the out of plane Z-stiffness of the Clip/Isolator.

Figure 48:
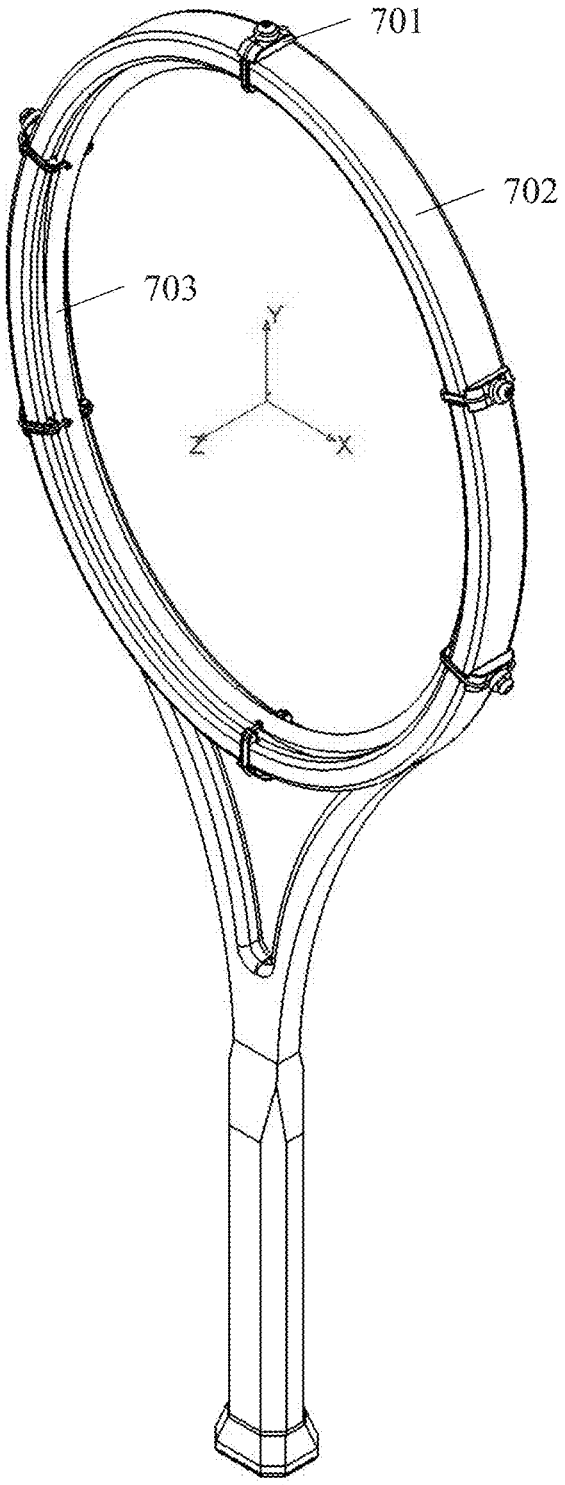
FIG. 48 shows an assembled view of a racquet with a "string" isolator system.
Figures 49A, 49B, 49C:
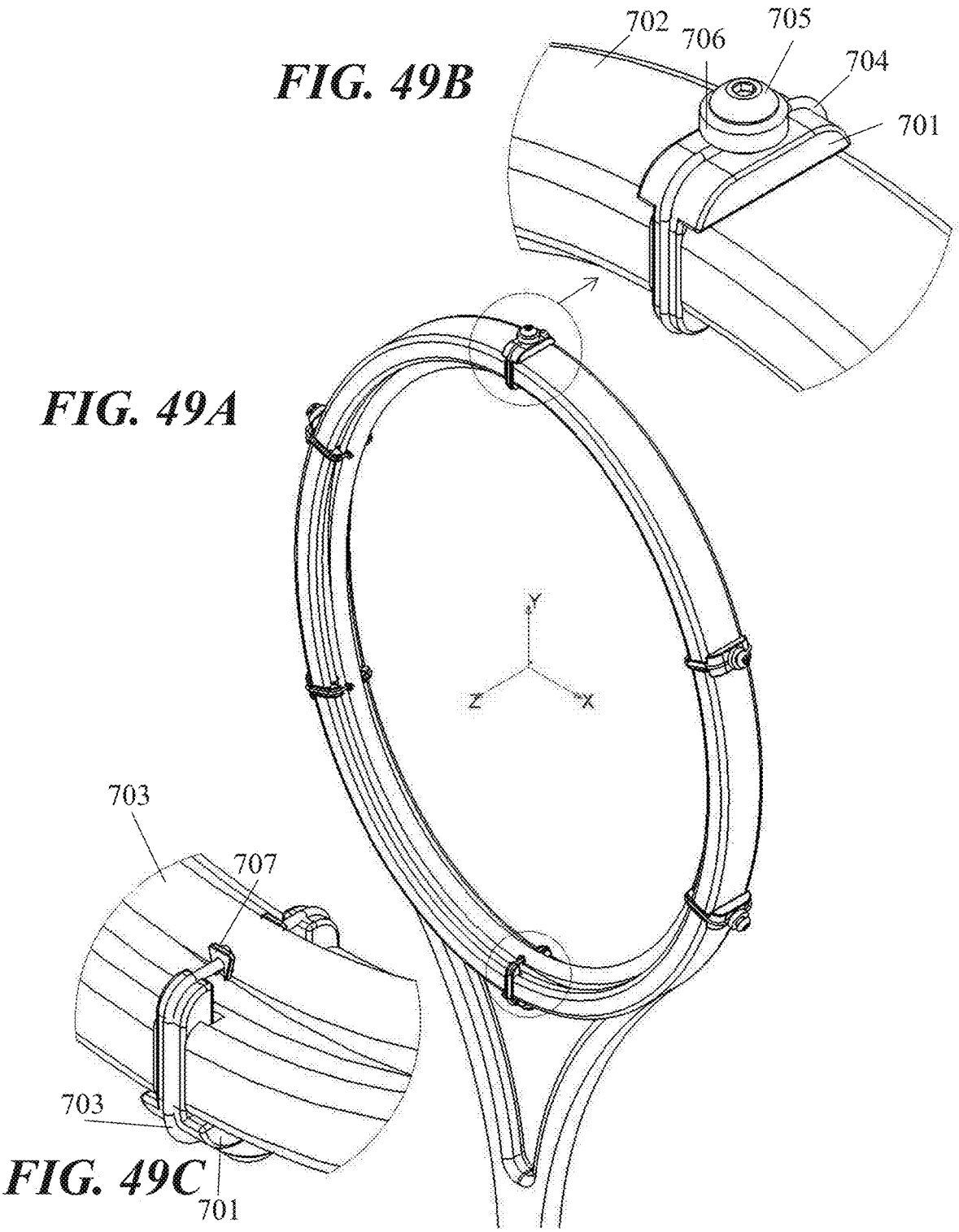
FIG. 49A shows a zoomed iso view of FIG. 48.
FIG. 49B shows a zoomed iso view of a Clip/String Isolator of FIG. 49A.
FIG. 49C shows a zoomed iso view of another Clip/String Isolator of FIG. 49A.
Figure 50:
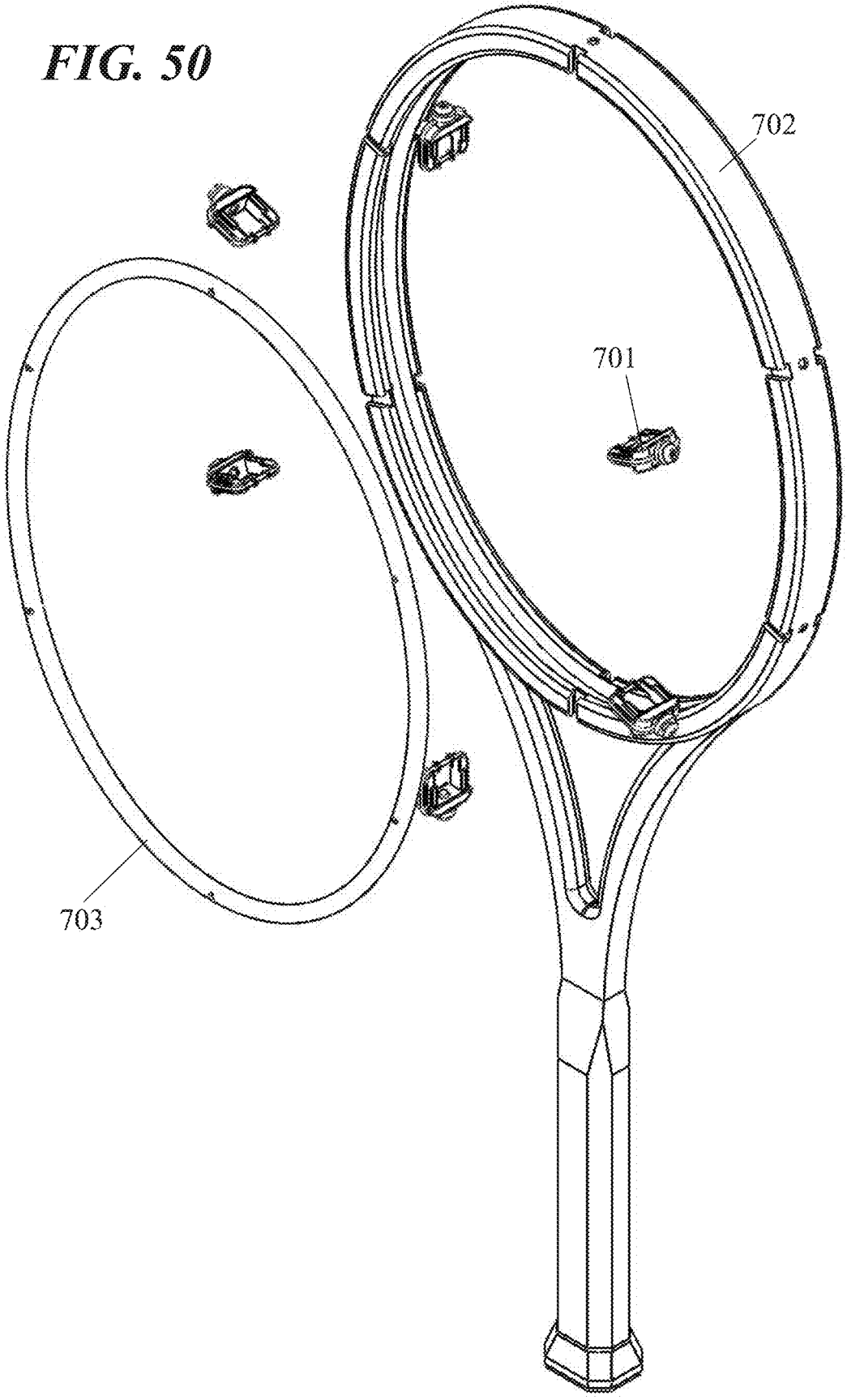
FIG. 50 shows an exploded view of various 6 Isolator assembly system.
Figure 59:
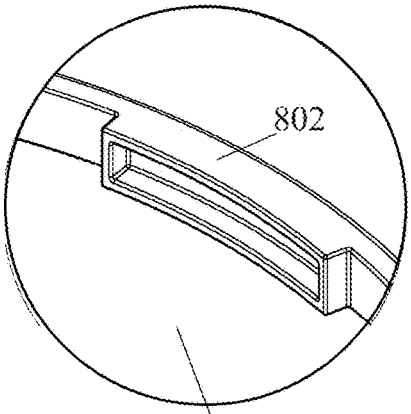
FIG. 59 is a zoomed view of the Receiving Port for the Isolator spring in the Outer Frame of FIG. 58.

FIGS. 48 to 52 are an example of a more detailed and manufacturable system that is assumed to incorporate the qualities of the generic system described earlier. A very brief review of this design is first presented, followed by a more complete explanation. FIG. 48 shows an assembled view of an elliptical head racquet system consisting of an Isolator 701, an Outer Frame 702 and an Inner Frame 703. FIGS. 49A, 49B and 49C show a detailed view where a tennis-like string 704 is wrapped around the Clip 701 and fastener 705/Washer 706 assembly, thus locking the assembly together. A String Clip 707 is shown attached to the string 704 in FIGS. 49A, 49B and 49C. The String Clips 707 attach the position of the Inner Frame to the string 704 and hence, via Isolator 701, to the Outer Frame 702. FIG. 50 shows an exploded view of various Isolator assemblies, the Inner Frame and the Outer Frame positioned around the frame. Female Docking Features can be seen on the Outer Frame where the Clips interface. Isolator Holes can be seen in the Inner Frame. FIG. 51 shows a detailed view of the overall assembly consisting of the Clip, Washer, Fastener, String Clip and string. FIGS. 51 and 52 show an exploded view of the Isolator assembly.

The assembly, functions and features of the design described by in FIGS. 48-52 are as follows: The Inner Frame is centered in the Z-direction inside the Outer Frame. The isolator systems, minus the string and string clips, are then inserted thru the Receiving Slots in the Outer Frame shown in FIGS. 49A, 49B, 49C and 50. The interface between the isolator and the Outer Frame is designed to ensure a rigid slip connection. The isolators could be made of various metals or plastics to provide the necessary playing characteristics.

The string is then threaded into the Isolator Holes in the Inner Frame and around the Isolator assembly. The string could be of various cross sectional shapes and materials (e.g., metal or plastic) to provide the necessary playing characteristics. The string could be a single piece or a compilation of smaller strands or anything capable of being tensioned appropriately.

The fastener is then tightened against the Washer to pull tension on the Isolator's string. Adjusting the tension on the Isolator's string could alter the playing characteristics of the Isolator system. Other methods of tensioning, including tying and crimping, could be used to hold tension and adjust the Isolator string. A tool could be used to tension the Isolator string that has a visual indicator of the exact amount of torque being applied through various obvious means. This visual indicator would provide the player with an understanding of the specific playing characteristics.

To maintain stiffness in the Z-direction a variety of mechanisms like collets or crimps could be used to stop the Inner Frame from moving in the Z-direction relative to the Outer Frame and provide the necessary stiffness in the Z-direction. The String Clip shown could snap onto the string that has a tapered surface that would 'bite' into the string when the racquet attempts to move in the Z-direction. Another method of limiting motion in the Z-direction is to have the tensioned string go through the C-Clip 701 of FIGS. 49A, 49B and 49C, weave into and out of the Inner Frame and then exit into the other side of the C-Clip. When tension is pulled the weaving of the string through the Inner Frame will allow the string to function as its own String Clip that maintains the necessary stiffness in the Z-direction.

Figure 58:
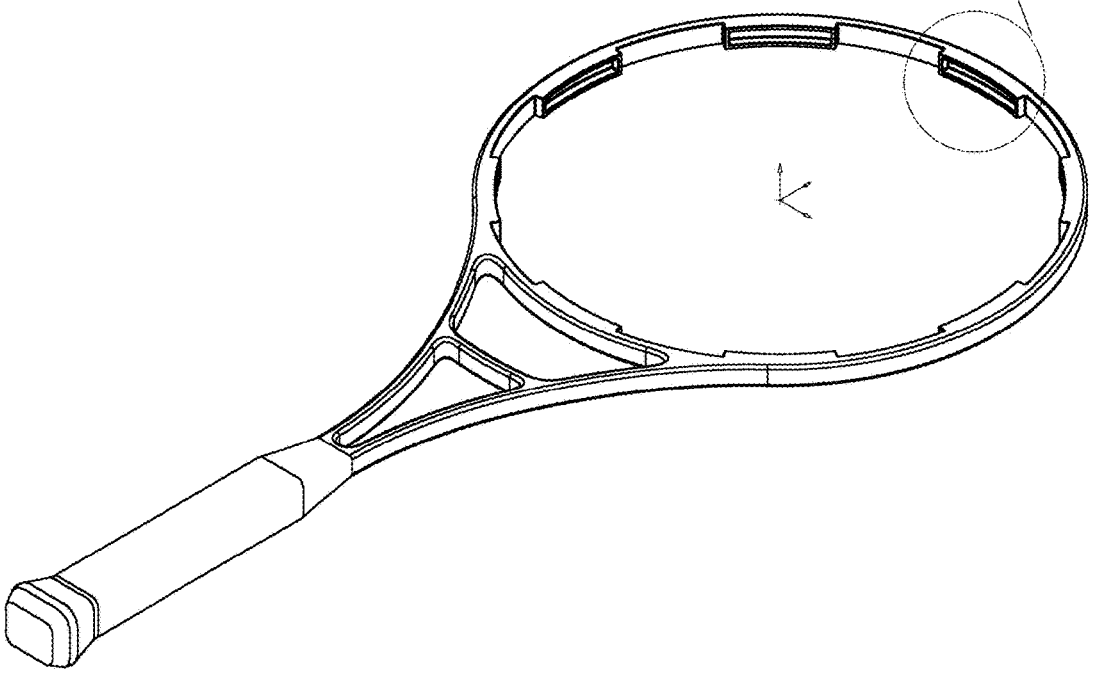
FIG. 58 is an iso view of the Outer Frame of FIG. 55.
Figure 60A:
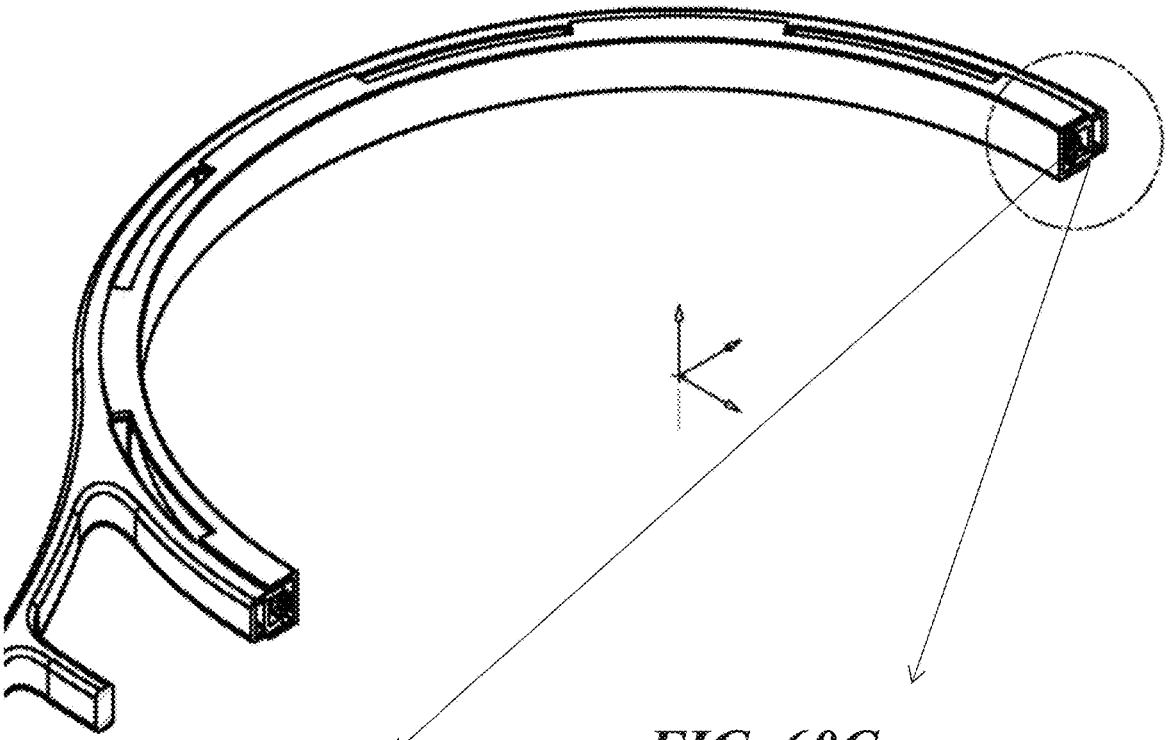
FIG. 60A shows a partial section view of the Assembled Inner and Outer Frame in locked position of the insert-and-twist Circular Head Racquet.
Figure 60B:
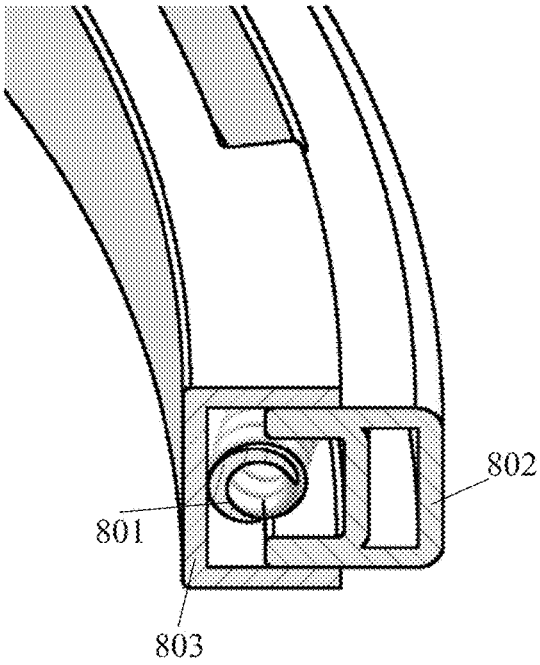
FIG. 60B shows a zoomed view of FIG. 60A showing the Isolator spring installed.
Figure 60C:
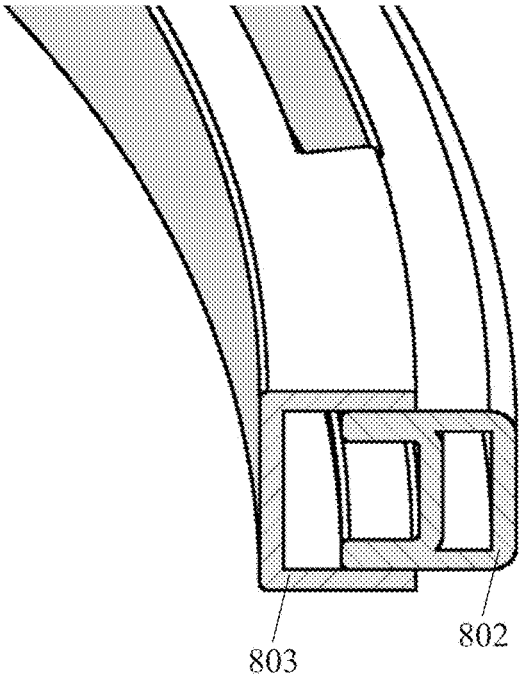
FIG. 60C shows a zoomed view of FIG. 60A showing the Isolator spring not installed.
Figure 61:
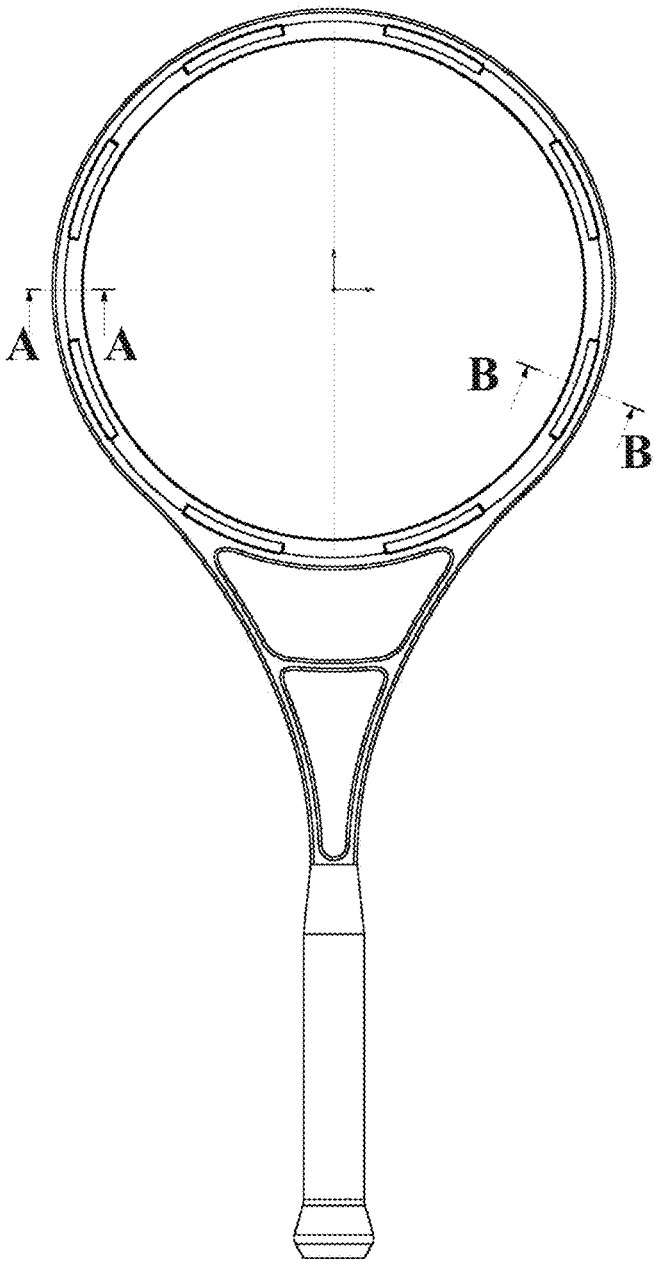
FIG. 61 is a front plan view of another embodiment.
Figure 62:
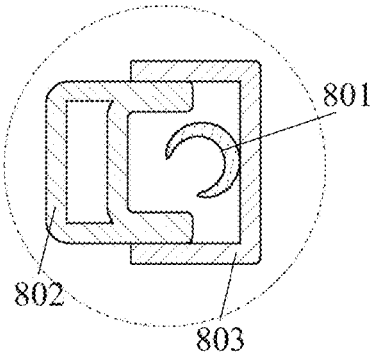
FIG. 62 shows x-section A-A of FIG. 61 through the Isolator when in locked position.
Figure 63:
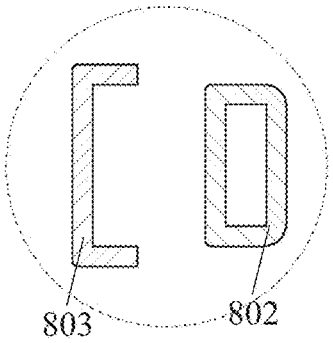
FIG. 63 shows a x-section B-B of FIG. 61; the x-section is not through the Isolator; system in locked position.
Figure 65:
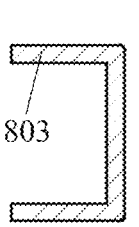
FIG. 65 shows x-section B-B taken through the Isolator boss of FIG. 64.
Figure 64:
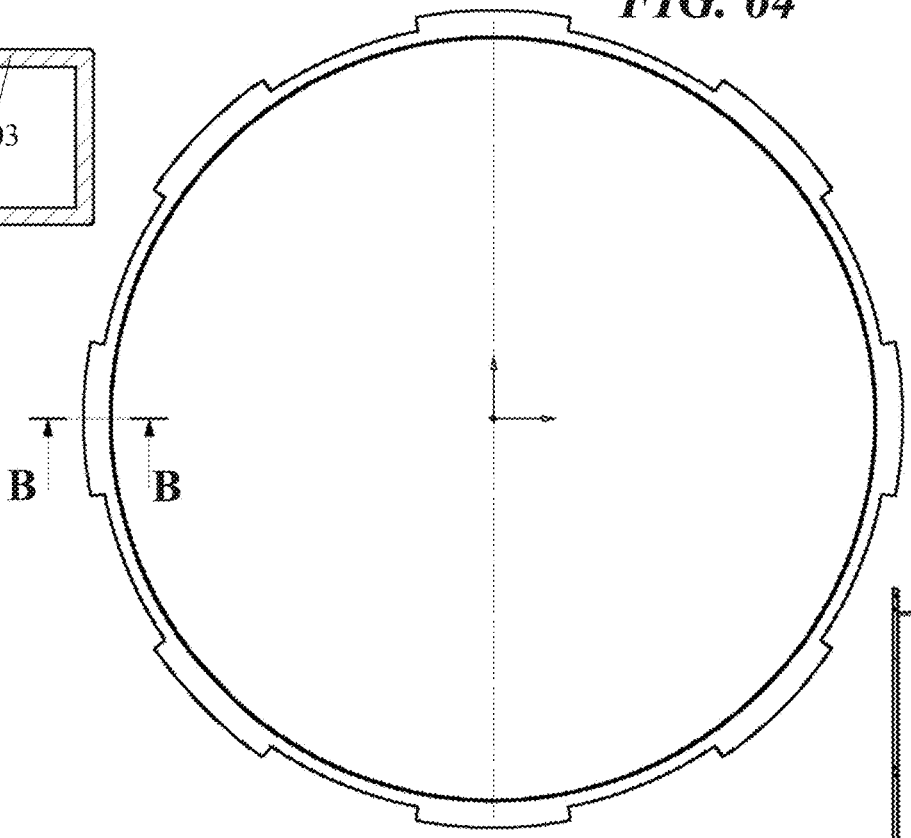
FIG. 64 shows a plane view of the circular head insert-and-twist Inner Frame.
Figure 66:
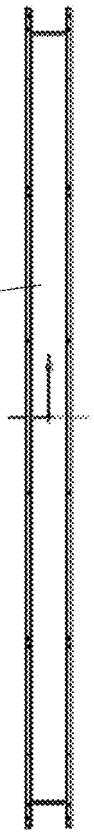
FIG. 66 is a side view of FIG. 64.

FIGS. 53-66 are an example of a more detailed and manufacturable system that is assumed to incorporate the qualities of the generic system described earlier. A very brief review of this design is first presented, followed by a more complete explanation. FIG. 53 shows a Circular Outer Frame 802, a Circular Inner Frame 803 and a Spring Isolator 801 placed into a Receiving Port in the Outer Frame. FIGS. 55 through 57 also illustrate this design. FIG. 56 shows a detailed view of the design in the locked position. FIG. 58 shows a detailed view of the Receiving Port for the spring isolator in the Outer Frame. FIGS. 60A, 60B, and 60C show a section view of the Inner and Outer Frame when assembled in the locked position. FIG. 62 shows a section view of FIG. 61 through the Isolator when in the locked position. FIG. 63 shows a section view of FIG. 61 not through the Isolator in the locked position. FIG. 65 shows a section view of the Inner Frame of FIG. 64 through the Isolator boss.

The assembly, functions and features of the design described in FIGS. 53-66 are as follows: A circular shaped Outer Frame of any cross section mates with a circular Inner Frame of any cross section. The geometry of the Inner Frame is rotationally symmetric and repeats every 45 degrees (8 identical segments). Receiving Ports in the Outer Frame allow the Inner Frame to lay inside the Outer Frame when in the unlocked position as shown in FIG. 53. Rotation of the Inner Frame relative to the Outer Frame 22.5 degrees locks the Inner Frame to the outer. FIGS. 60A, 60B, & 60C shows where the c-shaped cross section 803 of FIG. 60B of the Inner Frame is larger than the c-shaped cross section of the Outer Frame allowing the Inner Frame to encompass the Outer Frame. This principle could easily be flipped where the Inner Frame is housed inside the Outer Frame. Prior to rotation of the Inner Frame, between the inner and Outer Frame are cavities for various Isolators that provide necessary stiffness in the X-Y in-plane direction and the out of plane Z-direction. This allows easy removal of the Inner Frame and an easy exchange of Isolators for various playing options. FIG. 53 shows merely one example of a mechanical spring isolator 801 in the assembled position of FIG. 54. It is obvious that any variety of mechanical springs, living hinges, geometric structures, plastics and foams could be used interchangeably to provide the desired playing characteristics. Any number of methods could be used to ensure the Inner Frame stays in the locked position relative to the Outer Frame. This could include any number of traditional fastening methods or a geometric interface between the Inner and Outer Frame where a positive connection is attained when a certain angle of rotation is achieved. The desired stiffness in the X-Y direction and Z-direction could be achieved by any of the methods described in FIG. 48-52.

Figure 67:
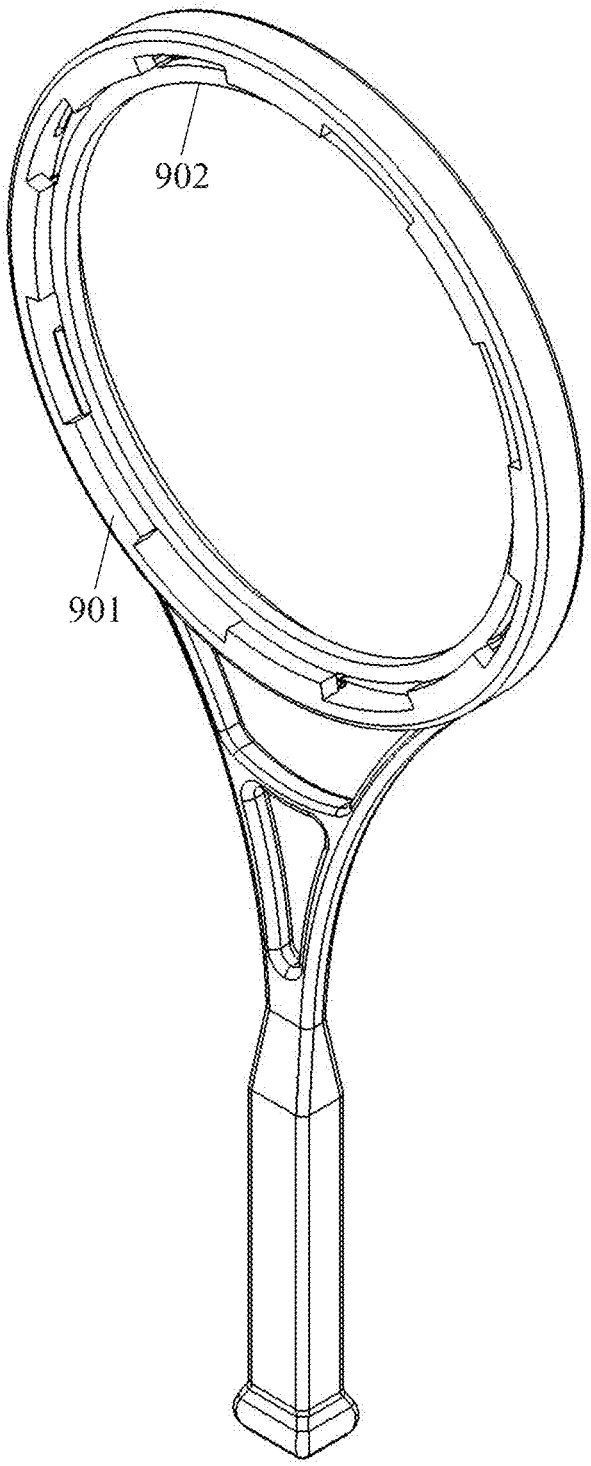
FIG. 67 shows an iso view of another insert-and-twist assembled Circular Head Racquet.
Figure 68:
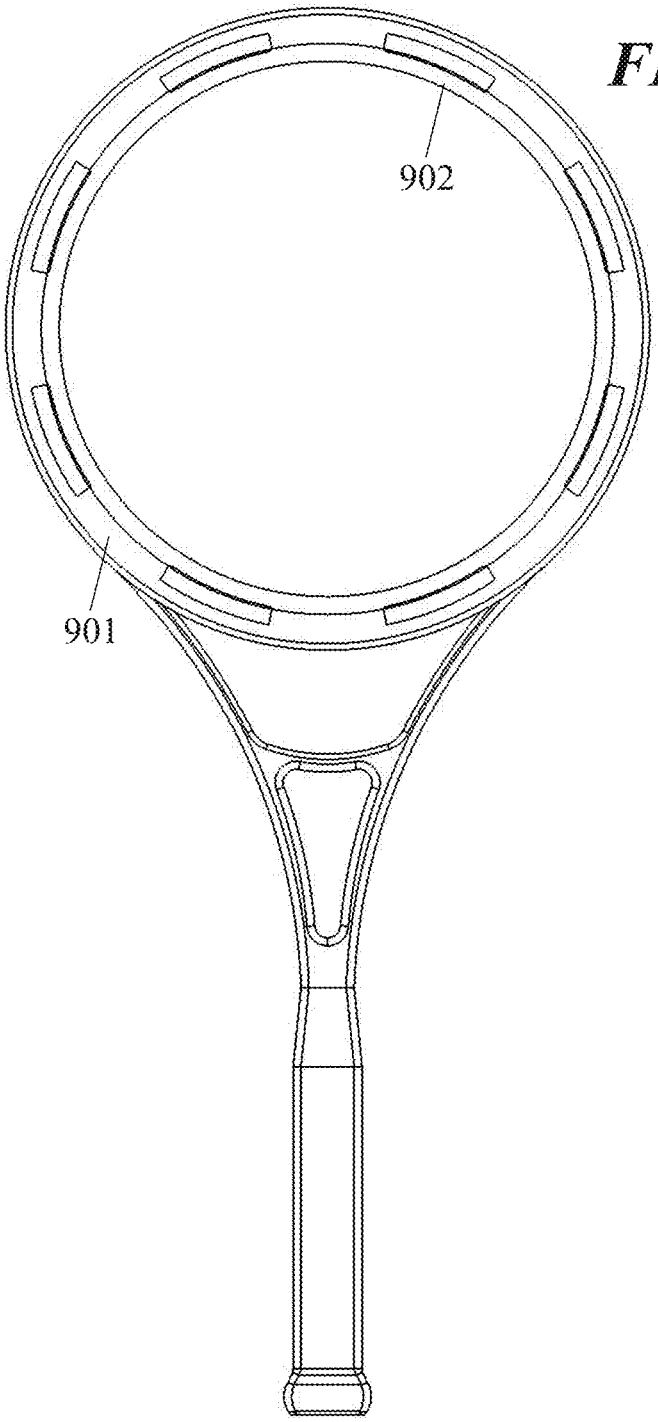
FIG. 68 shows the plan view of FIG. 67; in this design, the Circular Inner Frame, inserted and locked-rotated 22.5 degrees, fits inside the Circular Outer Frame.
Figure 69:
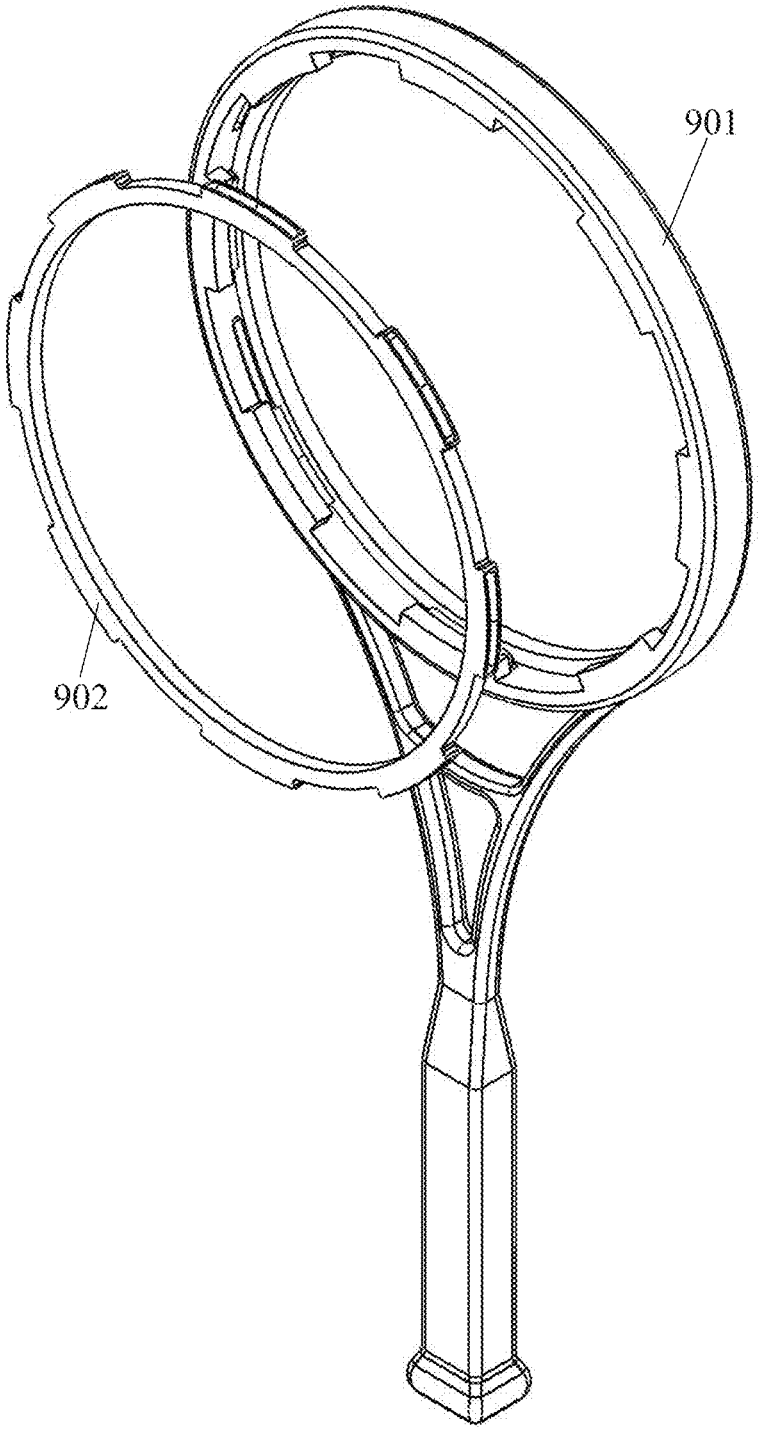
FIG. 69 shows an exploded view of FIGS. 67 and 68.

FIGS. 67-69 are an example of a more detailed and manufacturable system that is assumed to incorporate the qualities of the generic system described earlier. A very brief review of this design is first presented, followed by a more complete explanation. In the previous design, the circular head frame showed an inner frame designed to fit over the outer frame. This design has the inner frame fitting into the outer. FIG. 67 shows an iso view with a Circular Inner Frame 902 and a Circular Outer Frame 901. FIG. 68 shows a plan view of assembled system where the Circular Inner Frame has been rotated inside the Circular Outer Frame to the Locked Position. Figure shows an exploded view of the Circular Inner Frame and Circular Outer Frame.

The assembly, function and objectives of the design in FIG. 67-69 is similar to that described in FIG. 53-66. As previously noted, the major distinction is that in this design the Circular Inner Frame fits inside the Circular Outer Frame when rotated 22.5 degrees into the Locked Position. This present design better allows the weight of the Circular Inner Frame to be minimized.

Figure 72:
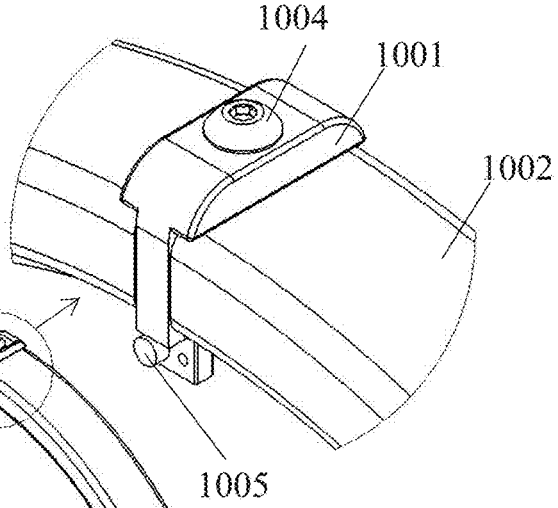
FIG. 72 shows a zoomed view of FIG. 70 of another Isolator.
Figure 70:
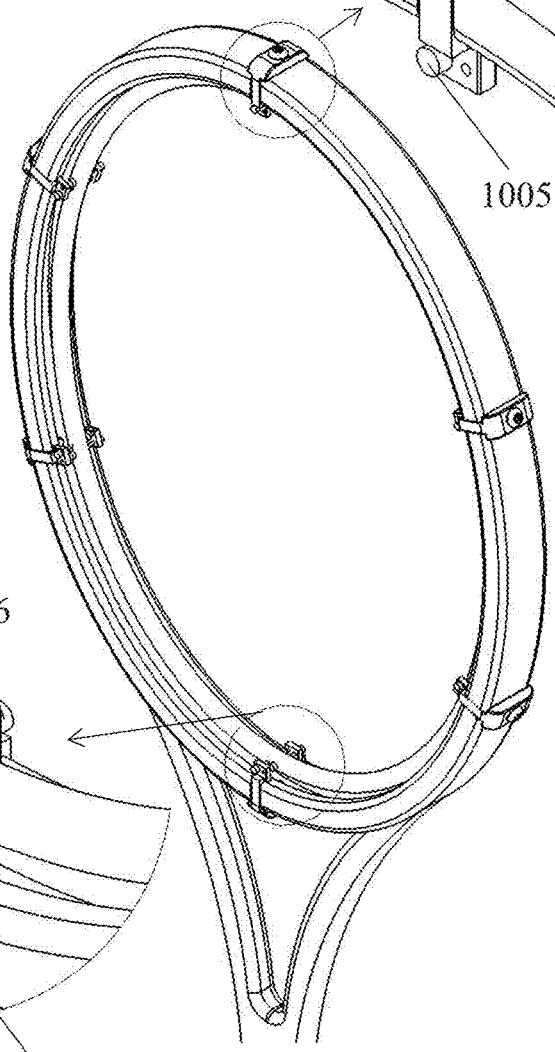
FIG. 70 shows an iso view of another racquet assembly showing 6 isolators spaced around an elliptical head frame.
Figure 71:
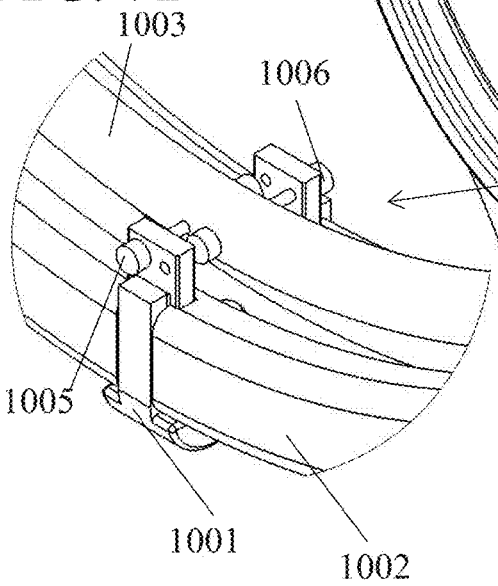
FIG. 71 shows a zoomed view of FIG. 70 of one of the Isolators.
Figure 73:
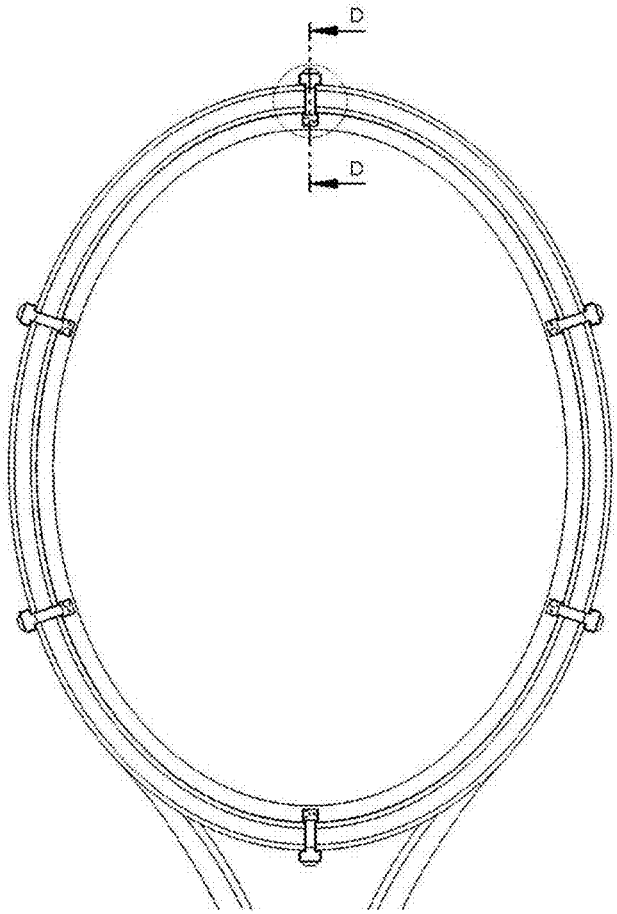
FIG. 73 is a plan view of FIG. 70.
Figure 74:
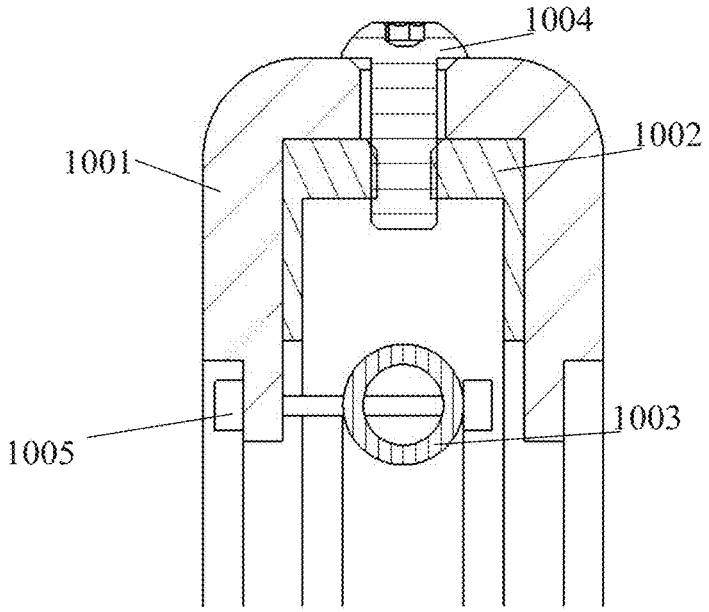
FIG. 74 is a x-section D-D of FIG. 73; the x-section shows an assembled isolator and inner/outer frames.
Figure 75:
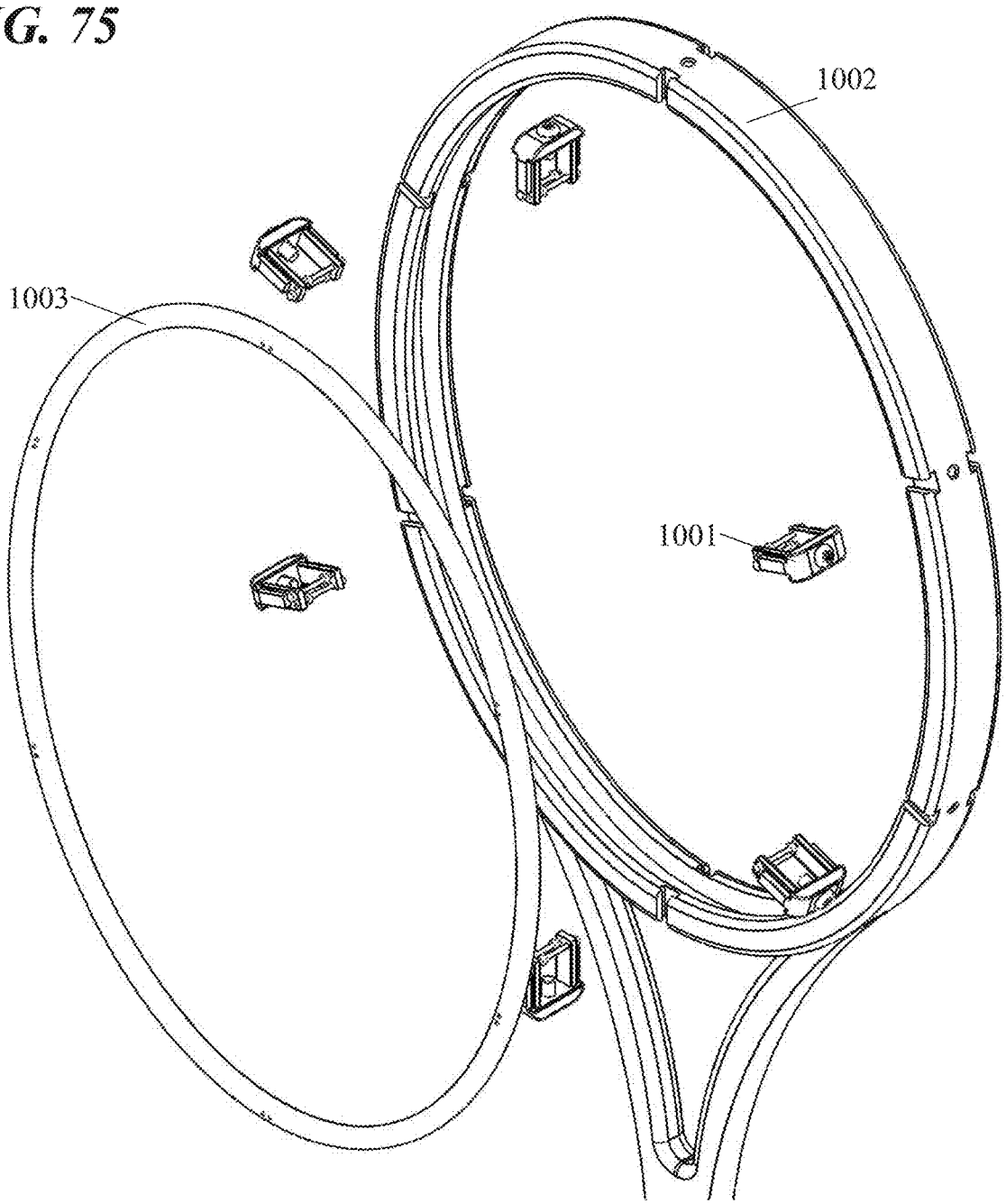
FIG. 75 shows an exploded view of FIG. 70; Receiving Features for the Isolator system are shown in the Outer Frame.
Figure 76:
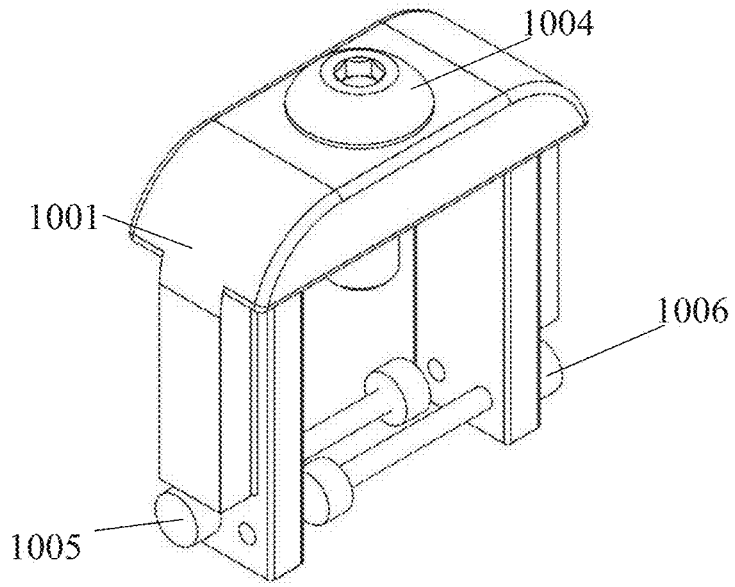
FIG. 76 shows an iso view of the Dual String Isolator System of FIG. 70, showing the dual string Fasteners and the Clip.
Figure 77:
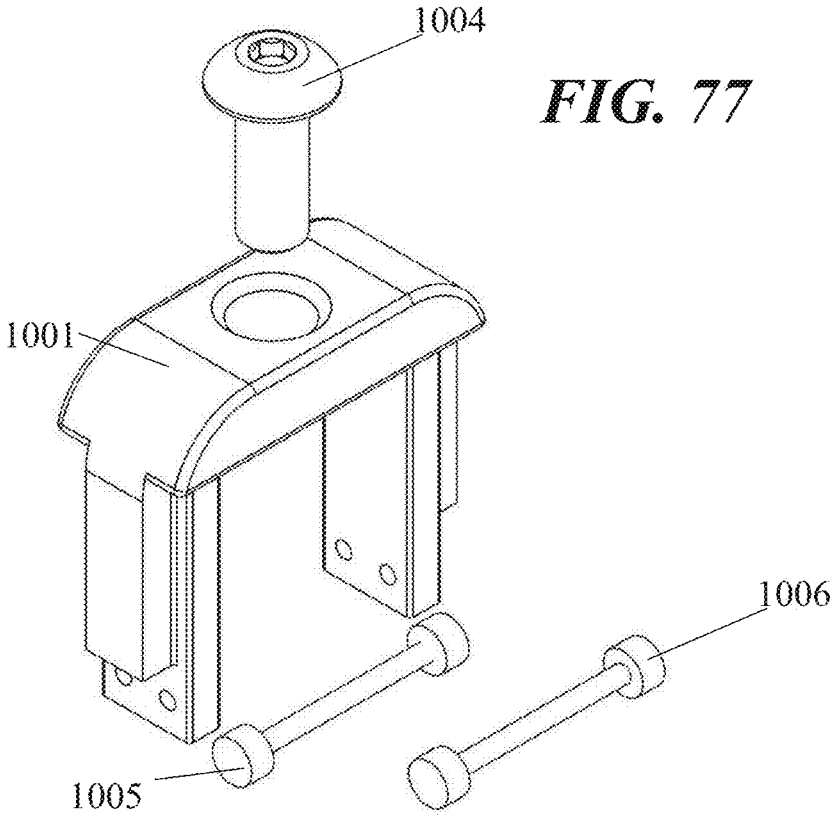
FIG. 77 shows an exploded view of FIG. 76.

FIGS. 70-77 are an example of a more detailed and manufacturable system that is assumed to incorporate the qualities of the generic system described earlier. A very brief review of this design is first presented, followed by a more complete explanation. FIGS. 70 through 72 shows an iso view and detailed views of the assembled design consisting of an Inner Frame 1003, an Outer Frame 1002, a Clip/Isolator assembly 1001, composed of a Fastener 1004 and an Upper and Lower String, 1005 and 1006. The racquet has an elliptical shaped head, but other shapes are acceptable. FIG. 74 is a section view of FIG. 73 showing the racquet in an assembled state. FIG. 75 shows the racquet in an exploded view where Receiving Features can be seen in the Outer Frame. FIG. 76 shows an iso view of the isolator assembly showing the Strings, the Fastener and the Clip (Inner and Outer Frame not shown). FIG. 76 shows Retention Features on either end of the Upper and Lower Strings 1005 and 1006. FIG. 77 shows an exploded view of the Isolator showing the Clip, Fastener and String Isolators.

The assembly, functions and features of the embodiments described by in FIGS. 70-77 are as follows. The Inner Frame is held centered in the Z-direction inside the Outer Frame. The Isolators and C-Clips engage the Receiving Features on the Outer Frame and are locked to the Outer Frame by the Fastener 1004 in FIGS. 76 and 77. Other methods of attaching the Clip to the outer frame are also obvious. Similar to the design described in FIGS. 48-52, the string of this Isolator system could come in the form of a string or other like material that can be tensioned. In this design, two String Isolators are used. One String Isolator is threaded thru the inner frame pulled in the positive Z-direction. The other is pulled in the negative Z-direction. Both string isolators have Retention Features that ensure the String Isolator does not pull through the Inner Frame. This Retention Feature could be a knot in the String Isolator, a crimp or another manufactured geometry built into the String Isolator. Each String Isolator would then be tied off or crimped once slipped thru the clip to ensure tension is held. This second retention feature could again be a knot or a crimp or a separate item that attaches to the String Isolator and ensures it does not slip back through the Clip 1001. The tension pulled on the String Isolator will help to dictate the stiffness in the X-Y plane and the Z-direction. The tension could be adjusted or different types/material/geometry of String Isolators could be used to allow different playing options.

Figure 78A:
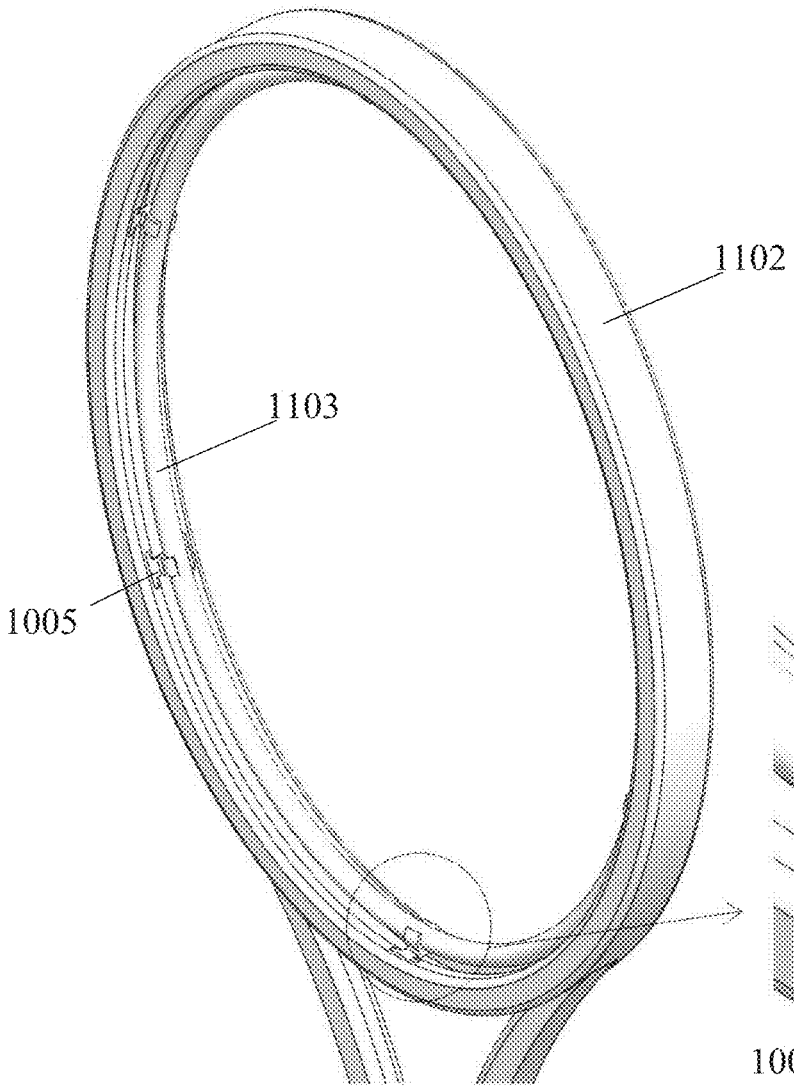
FIG. 78A shows an iso view of another racquet assembly showing an assembled Outer Frame, Inner Frame and a Snap Clip Isolator.
Figure 78B:
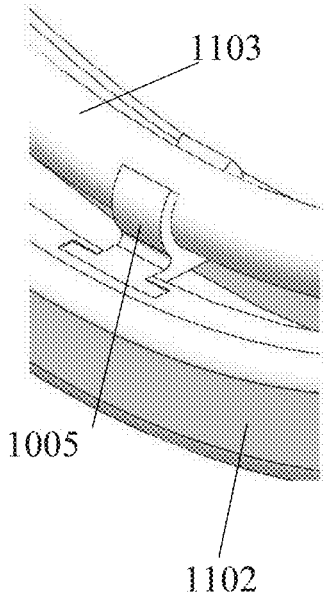
FIG. 78B is a zoomed view of an isolator clip of FIG. 78A.
Figure 79:
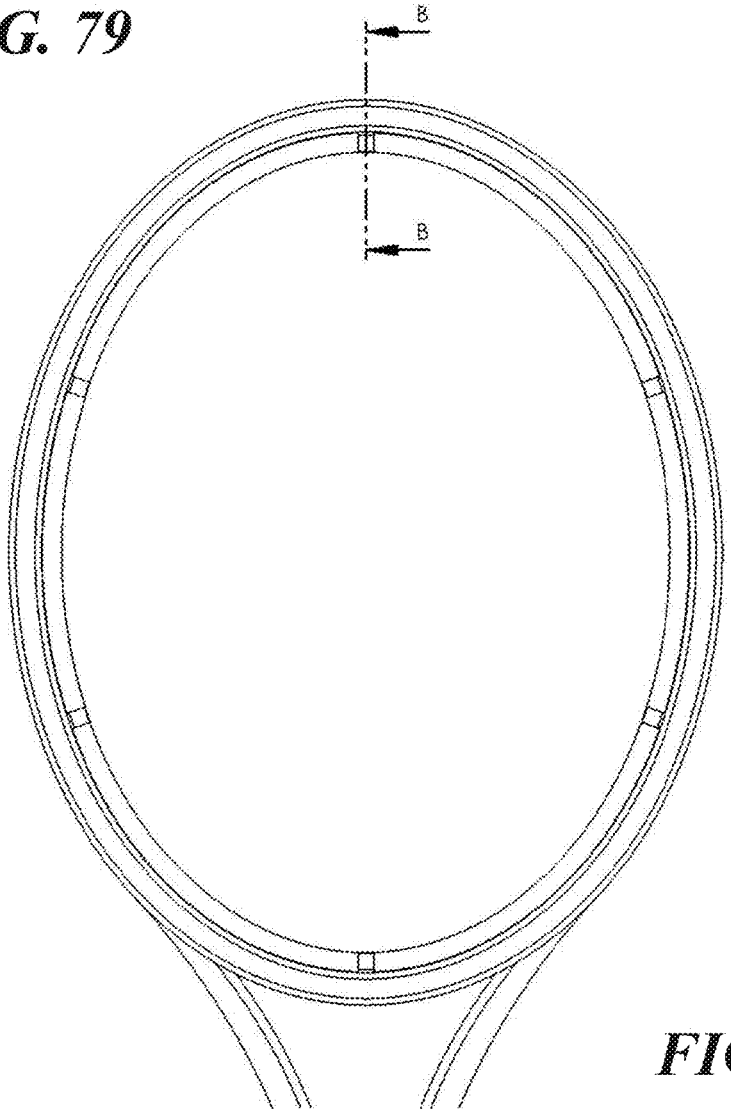
FIG. 79 is a plan view of FIG. 78A.
Figure 80:
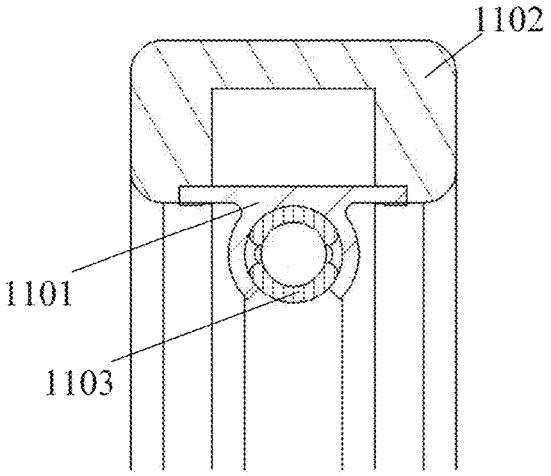
FIG. 80 is x-section B-B of FIG. 79 thru the Snap Clip Isolator where the Inner Frame is snapped into the Snap Clip.
Figures 81A, 81B:
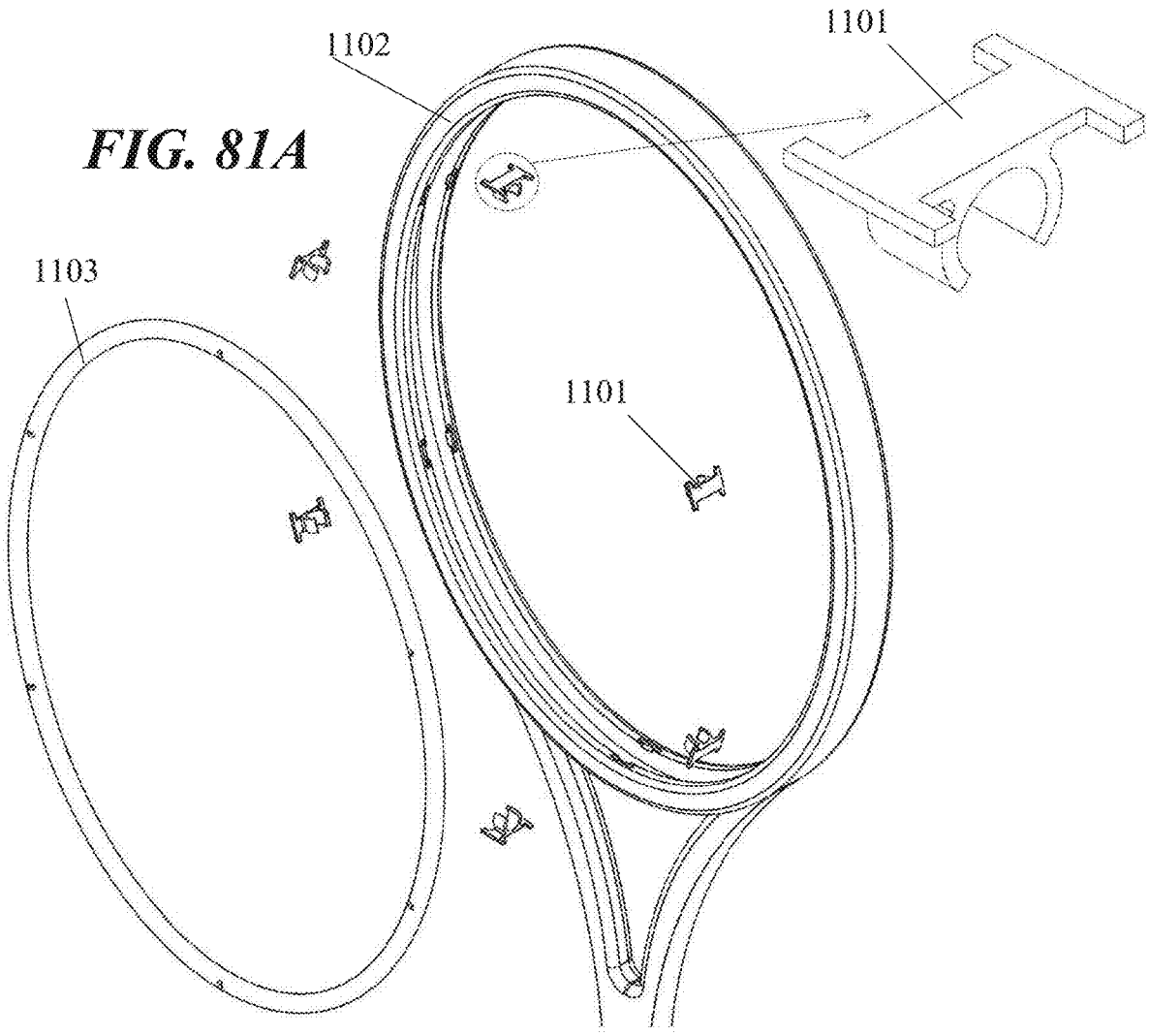
FIG. 81A is an exploded view of FIG. 78A.
FIG. 81B is a zoomed view of the Snap Clip Isolator.

FIGS. 78A-81B are an example of a more detailed and manufacturable system that is assumed to incorporate the qualities of the generic system described earlier. A very brief review of this design is first presented, followed by a more complete explanation. FIGS. 78A and 78B show an iso view and a detailed view of an Outer Frame 1102, an Inner Frame 1103 and a Snap Clip Isolator 1105. FIG. 80 is a section view of FIG. 79 thru the Snap Clip Isolator where the elliptical shaped Inner Frame (other shapes acceptable) is snapped into the Snap Clip. FIGS. 81A and 81B are both an exploded view of the design and a detailed view of the Snap Clip Isolator. In FIGS. 81A and 81B, Receiving Features in the Outer Frame can be seen.

The assembly, functions and features of the design described in FIGS. 78A-81B are as follows: The Inner Frame is placed inside the Outer Frame and centered in the Z-direction. Snap Clip Isolators are then attached to the Inner Frame and subsequently attached to the Outer Frame. The order of this operation could be reversed if easier to assemble. The geometry and material selection of the Snap Clip Isolator is such that it provides a greater stiffness in the Z-direction than it does in the X-Y direction to provide the necessary playing characteristics. It is obvious that a variety of Isolators could be designed with different material and geometry that could allow a player to quickly change his playing characteristics. The number and location of the Isolators could also alter the playing characteristics. The Snap Clip Isolator could be attached to the Outer Frame by any number of methods. The Receiving Features pictured would allow the Isolators to slip into a key slot thereby retaining the clips. Alternatively some sort of standard fastener could be used to hold the Snap Clip Isolator to the Outer Frame. Note the Inner Frame shown is of circular cross section and the Snap Clip Isolator has a living hinge that allows it to snap over and retain the Inner Frame. Alternative geometric designs are obvious that might provide greater retention capability, easier assembly and easier manufacturing.

Figures 82A, 82B, 82C:
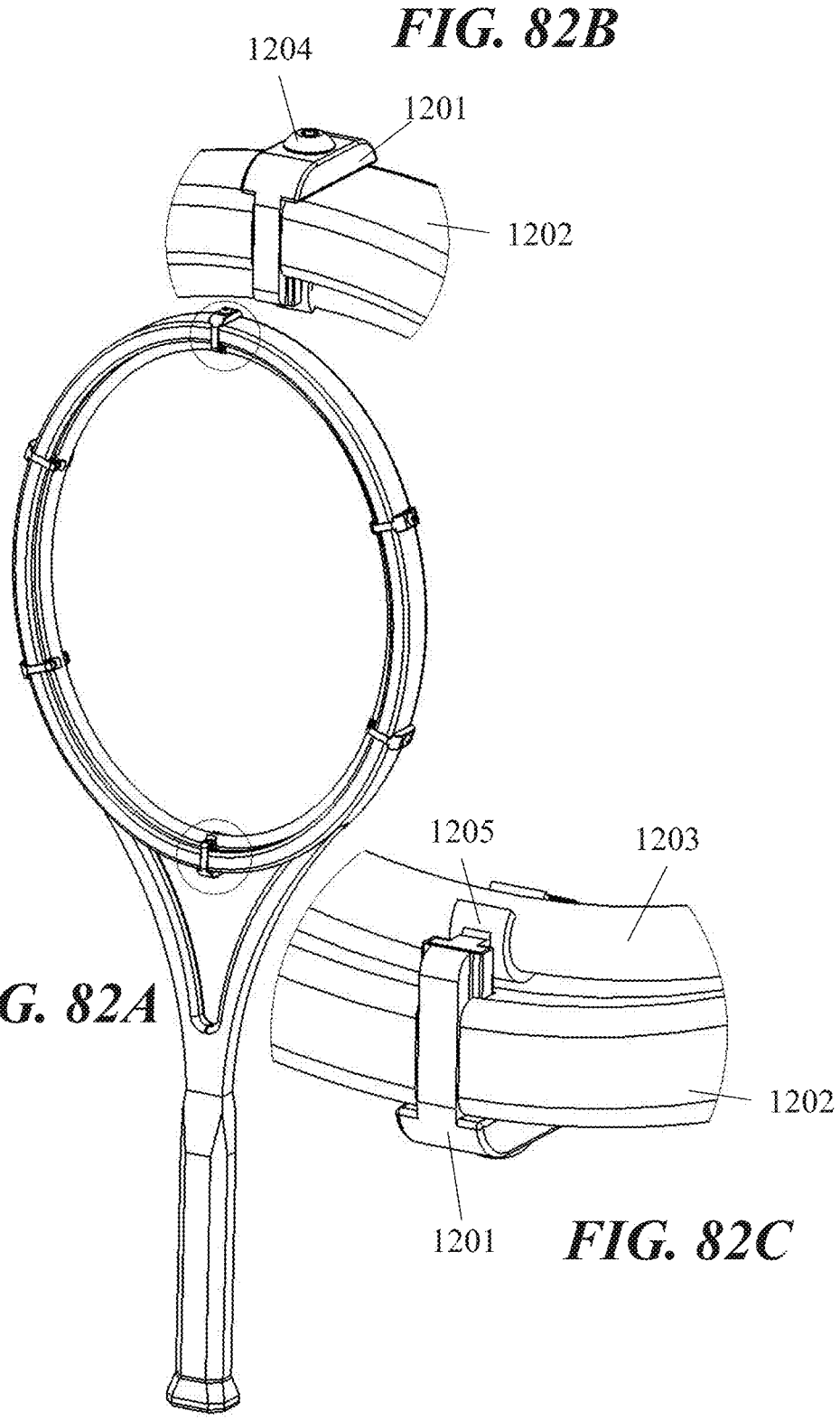
FIG. 82A is an iso view of still another racquet assembly showing 6 Isolator around an elliptical head frame.
FIG. 82B is a zoomed view of an Isolator of FIG. 82A.
FIG. 82C is a zoomed view of another Isolator of FIG. 82A.
Figure 83:
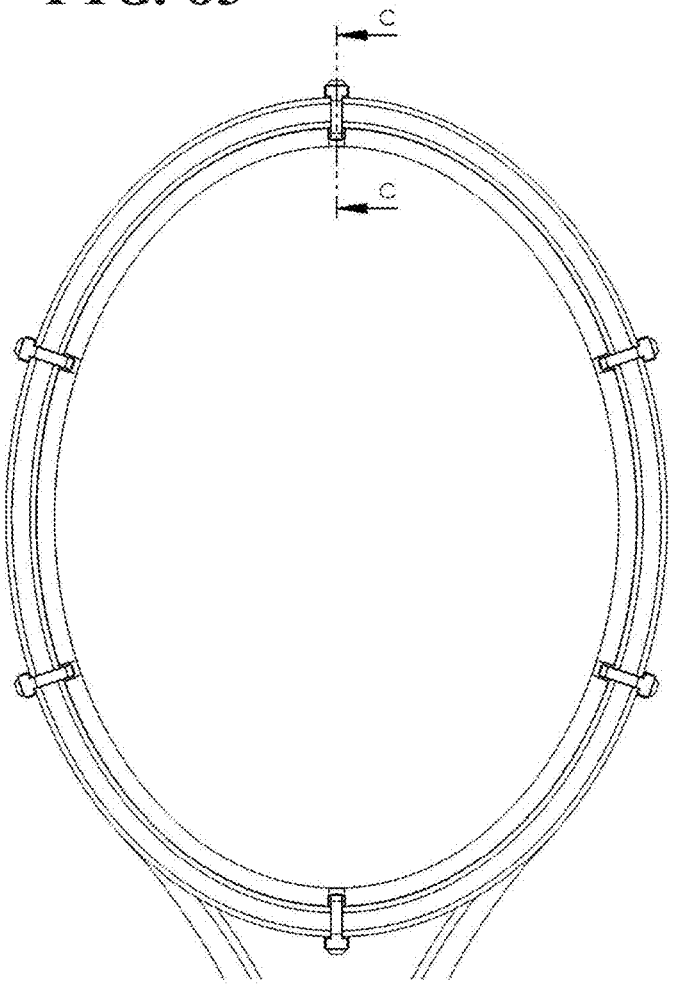
FIG. 83 is a plan view of FIG. 82A.
Figure 84:
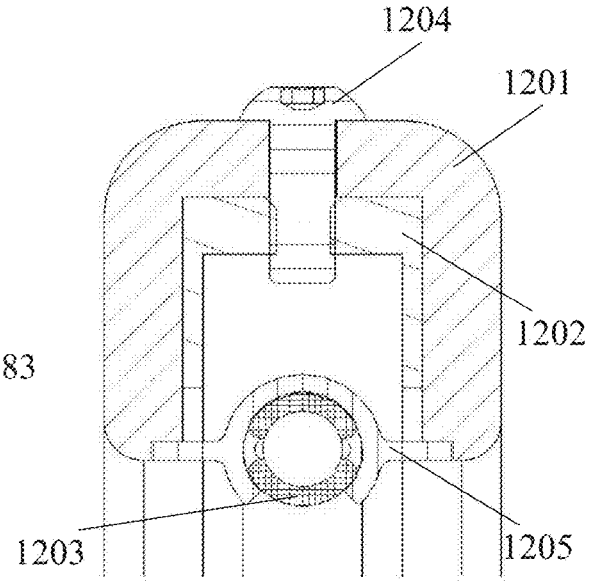
FIG. 84 is x-section C-C of FIG. 83; the x-section is through the isolator and inner and outer frame.
Figures 85A, 85B:
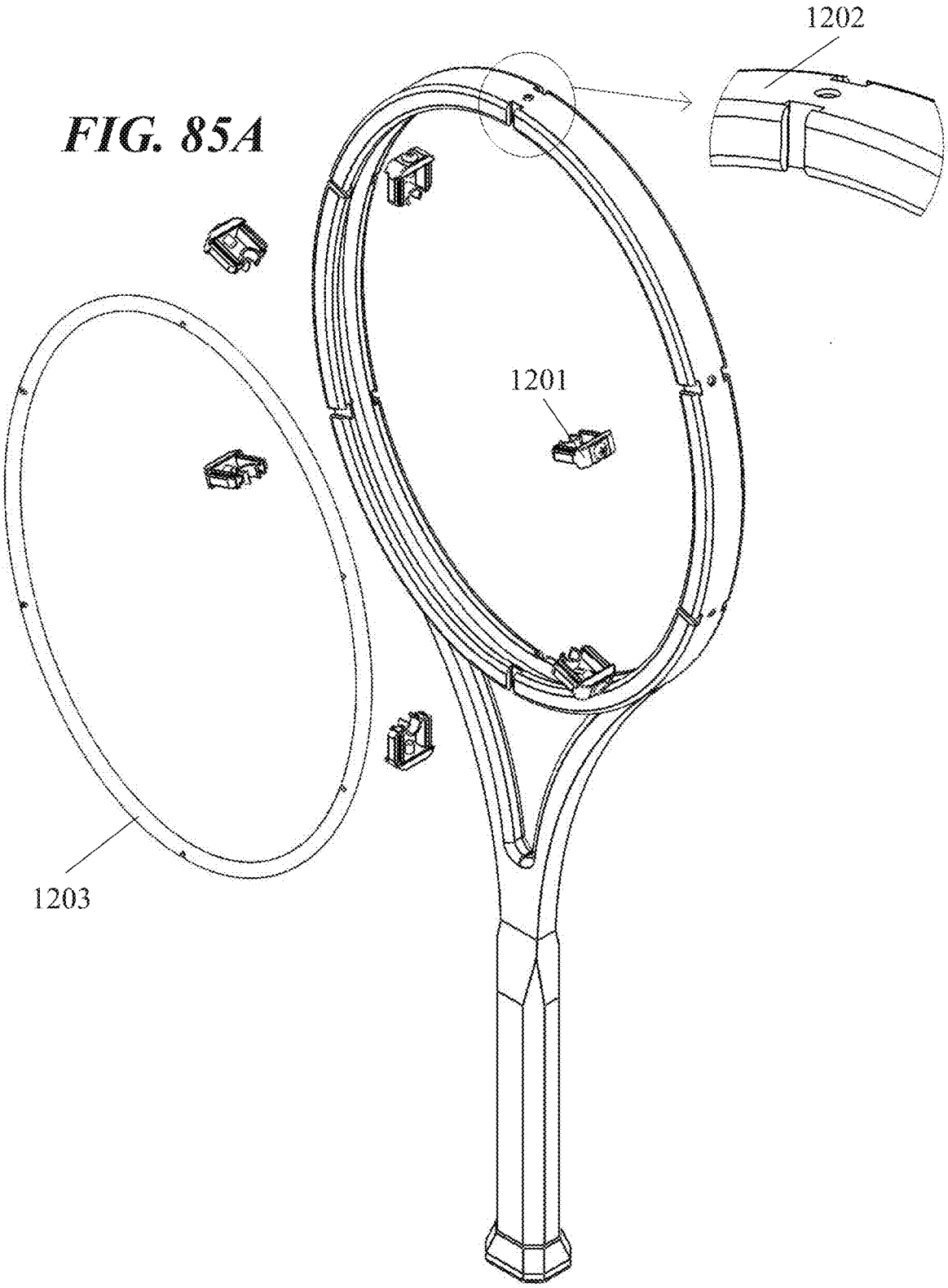
FIG. 85A is an exploded view of FIG. 82A showing Receiving Features for the Isolator in the Outer Frame.
FIG. 85B is a zoomed view of FIG. 85A showing the slot, in the outer frame, for the Isolator.
Figure 86:
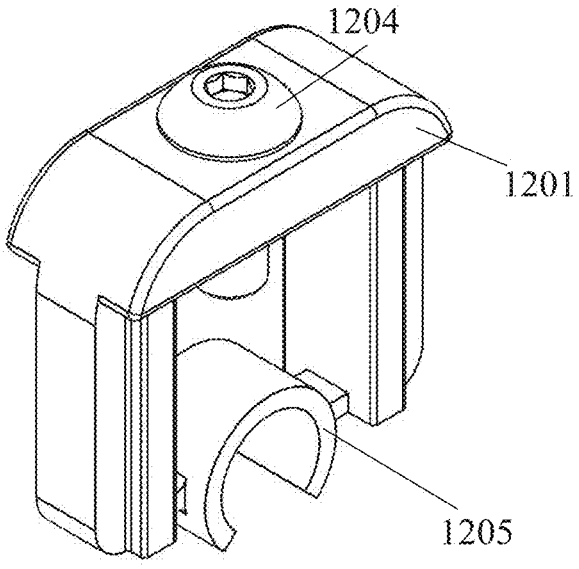
FIG. 86 is an iso of the Isolator system of FIG. 82A showing the C-clip, the Snap-on spring, and a locking bolt.
Figure 87:
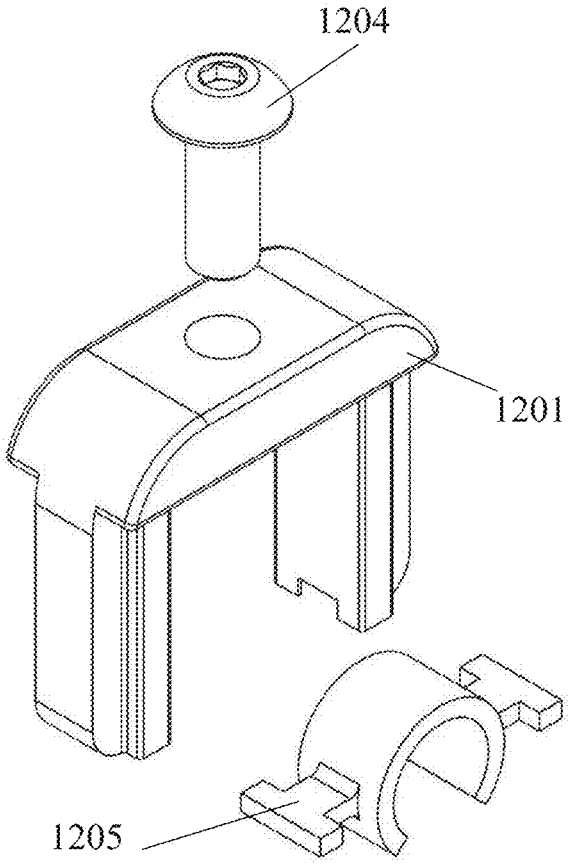
FIG. 87 is an exploded view of FIG. 86.

FIGS. 82A to 87 are an example of a more detailed and manufacturable system that is assumed to incorporate the qualities of the generic system described earlier. A very brief review of this design is first presented, followed by a more complete explanation. FIGS. 82A, 82B and 82C are assembled iso views of the racquet showing an Outer Frame 1202, an Inner Frame 1203, and a Snap Clip 1205 and C-Clip 1201 that makes up the Isolator system. FIG. 84 is a section view of FIG. 83 where a Fastener 1204 can be seen. FIGS. 85A, 85B and 85C are views of the racquet assembly where Receiving Features in the Outer Frame can be seen. FIG. 86 is a detailed iso view of the Isolator system. FIG. 87 is an exploded view of the Isolator system (the Inner and Outer Frame are not shown).

The assembly, functions and features of the design described by in FIGS. 82A-87 are as follows: This design is similar to that described in FIGS. 78A-81B with a difference in how the Snap Clip Isolator attaches to the Outer Frame. In this design a C-Clip is first inserted into Receiving Features in the Outer Frame. The C-Clip is attached to the Outer Frame with the fastener as described in previous designs. The upper and lower arm of the C-Clip 1201 in FIGS. 86 and 87 extend out to support the Snap-Clip 1205 of FIGS. 86 and 87. The Snap Clip 1205 is then attached to the Inner Frame and to the C-Clip by any of the methods described previously.

Figure 88:
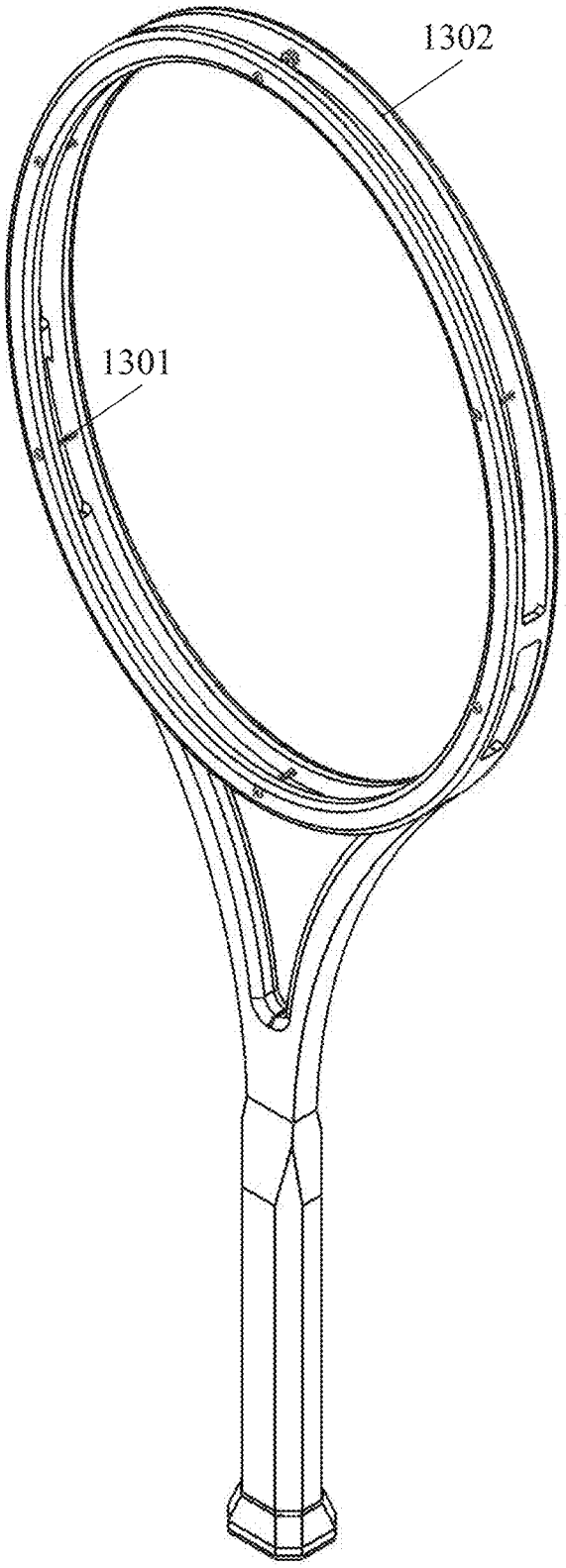
FIG. 88 is an iso of another racquet system showing a slot in the top of the Outer Frame for Inner Frame entry.
Figure 89:
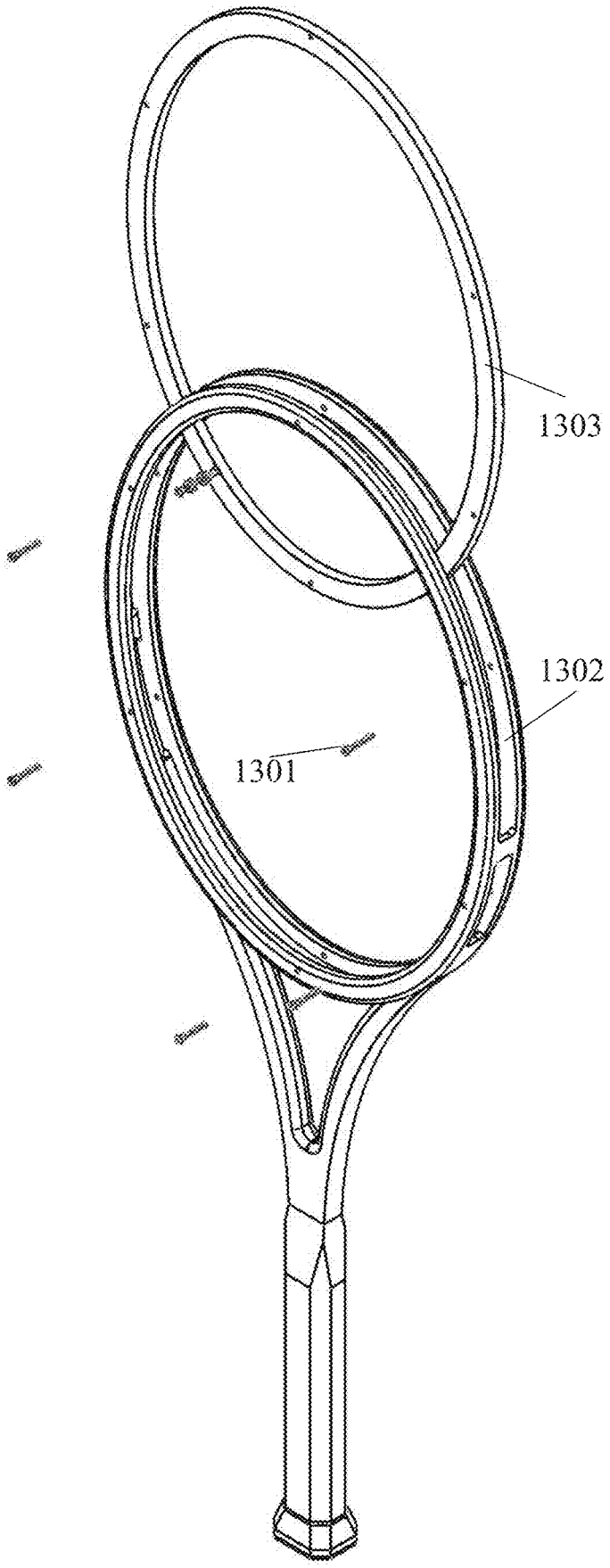
FIG. 89 shows an exploded view of FIG. 88 showing an Inner Frame, the Slotted Outer Frame and the Bolt Isolators.
Figure 90B:
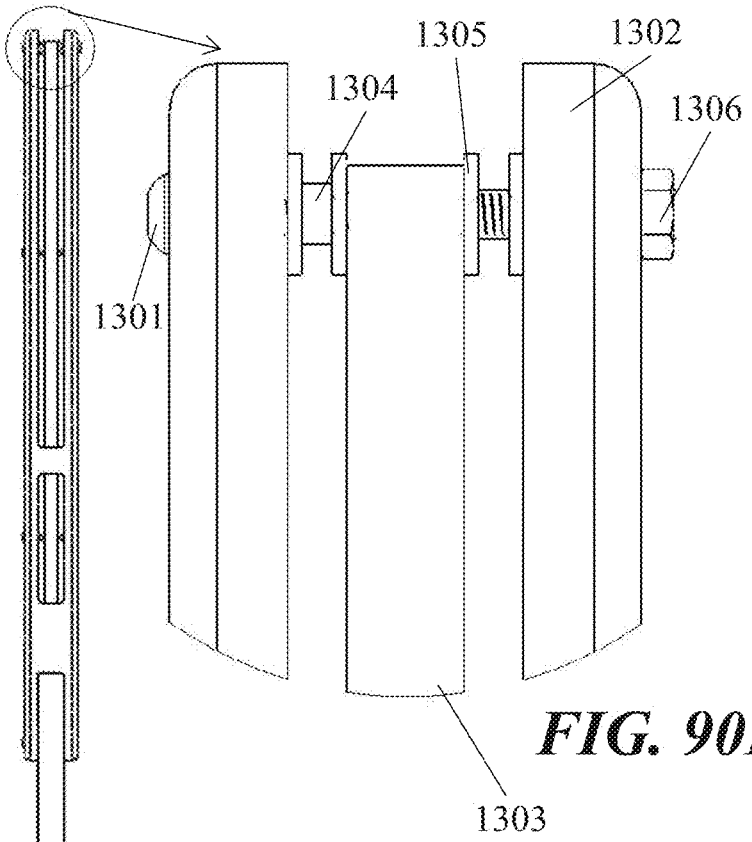
FIG. 90B is a zoomed view of FIG. 90A showing the isolator bolt connecting the inner and outer frame.
Figure 90A:
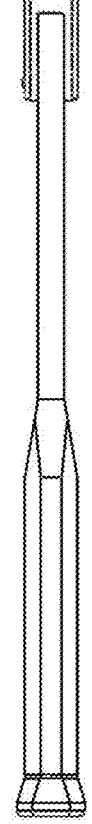
FIG. 90A shows a side view of FIG. 88.
Figure 91:
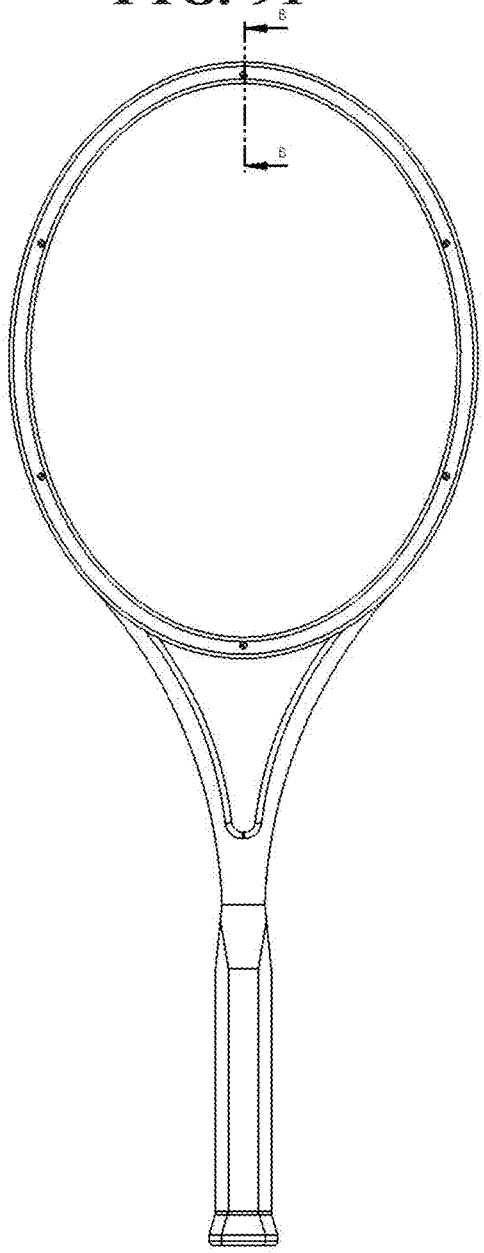
FIG. 91 is a plan view of FIG. 88.
Figure 92:
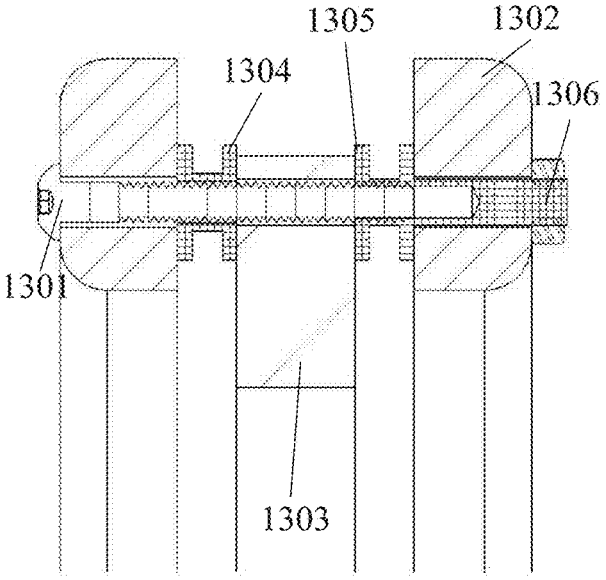
FIG. 92 is x-section B-B of FIG. 91 showing the bolt isolator and inner and outer frame.
Figure 93:
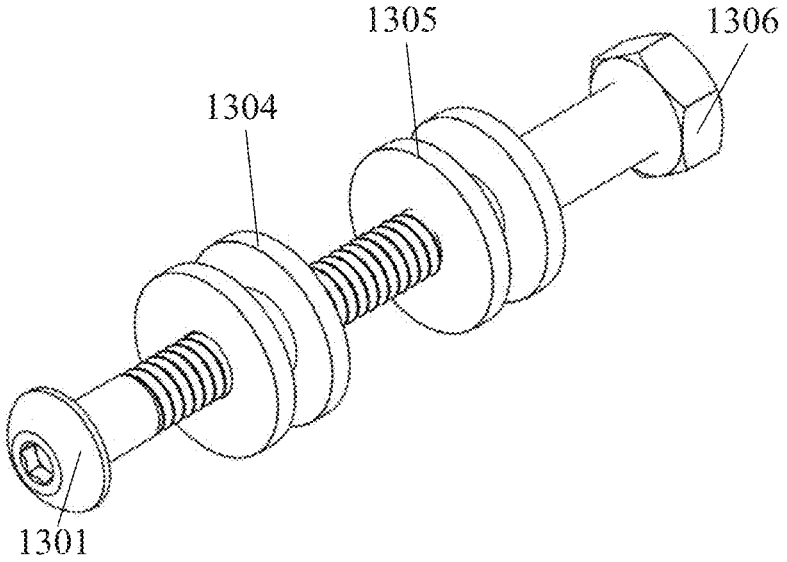
FIG. 93 shows an iso view of the Bolt Isolator assembly of FIG. 88.
Figure 94:
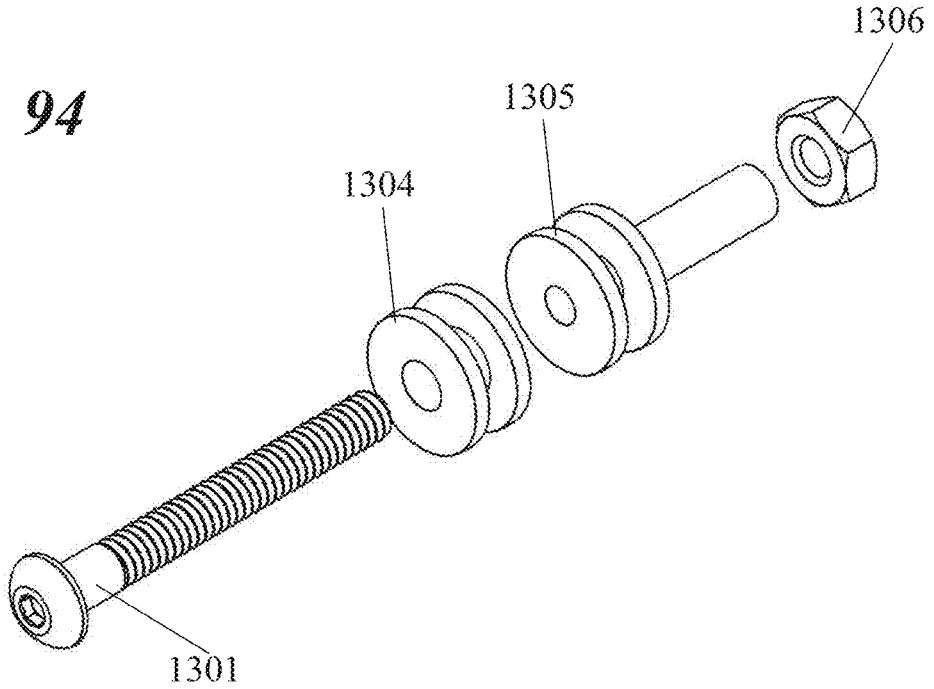
FIG. 94 shows an exploded view of FIG. 93.

FIGS. 88 through 94 are an example of a more detailed and manufacturable system that is assumed to incorporate the qualities of the generic system described earlier. A very brief review of this design is first presented, followed by a more complete explanation. FIG. 88 shows a Slotted Outer Frame 1302 and Bolt Isolators 1301 in an iso view. FIG. 89 shows an exploded view with the Inner Frame 1303 partially removed from the Slotted Outer Frame 1302 and Bolt Isolators 1301. FIGS. 90A and 90B show detailed views of the assembled racquet with an Upper and Lower Washer 1304/1305 and a Nut 1306. FIG. 92 shows a section view of FIG. 91 through an assembled racquet. FIG. 94 shows an iso view of the Bolt Isolator, Upper and Lower Washer and Nut without the Inner and Outer Frame depicted. FIG. 94 shows an exploded view of FIG. 93.

The assembly, functions and features of the embodiments described by in FIGS. 88-94 are as follows: The Slotted Outer Frame has an opening at the top of the racquet in the Y-direction that allows the Inner Frame to be inserted from the top. While other designs have the inner frame of a smaller overall circumference, this design allows the Inner Frame to be of equivalent circumference thereby minimizing the thickness of the overall assembly in the radial dimension. Another option to attach the Inner Frame to the Slotted Outer Frame is described here. A Bolt Isolator is placed through a hole in the Slotted Outer Frame shown in FIGS. 90A, 90B, 90C and 92. The Bolt Isolator is then slipped through the Upper Washer, through a hole in the Inner Frame, through the Lower Washer and then through the other side of the Slotted Outer Frame (FIG. 92). A Nut is then used to fasten the assembly together. It is obvious that the cross section, material and geometry of the various components would provide varying stiffness in the X-Y plane and Z-direction. As described previously, various methods such as ball bearings or friction reducing materials could also be incorporated between the various components of the assembly to allow movement in the X-Y in-plane direction and to minimize vibration. Another variation, not pictured here, would have the Isolator Bolt only extending through one side of the Slotted Outer Frame with the Nut then fastened against the Inner Frame. This would put the Bolt Isolator in a cantilevered configuration thereby changing X-Y in-plane stiffness and offering various playing properties. A ball bearing or similar concept could be combined to provide an added stiffness in the z-direction while allowing the cantilevered Bolt Isolator to dictate the stiffness in the X-Y direction.

Figure 95:
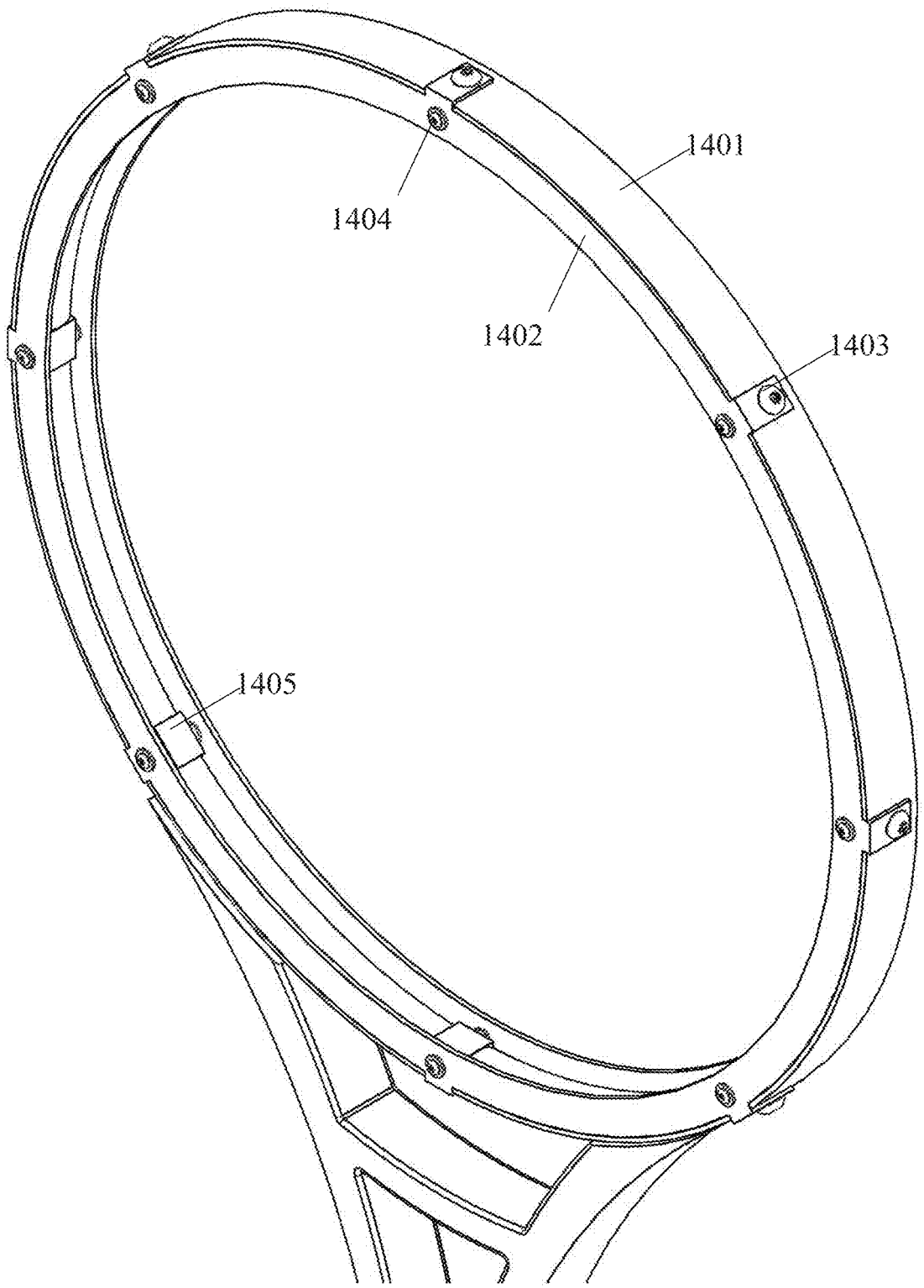
FIG. 95 is an iso view of a front entry racquet design showing the assembled front plate cover, outer frame, inner frame, and bolt isolators.
Figure 98:
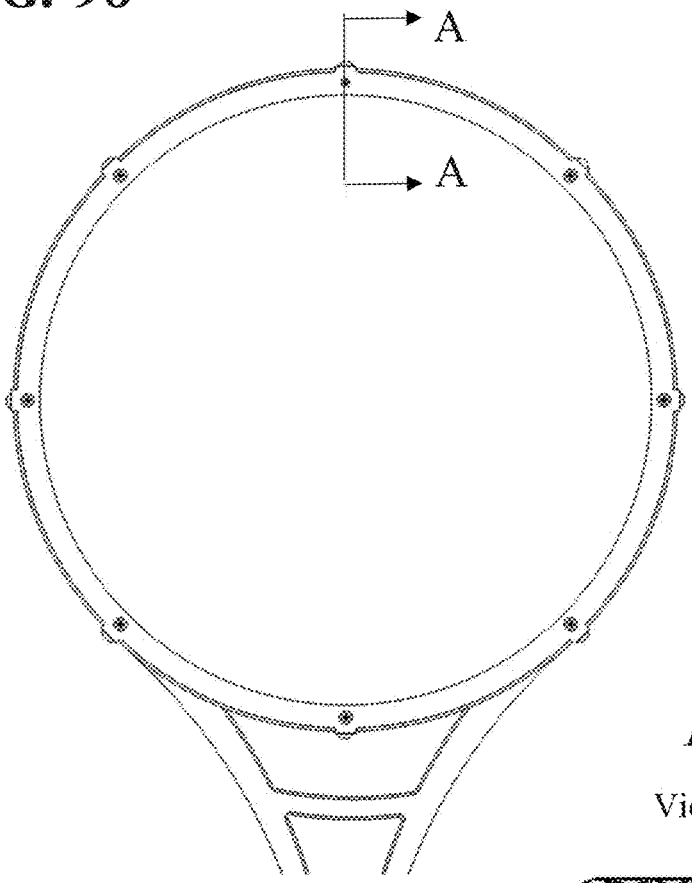
FIG. 98 is a plan view of FIG. 95.
Figure 99:
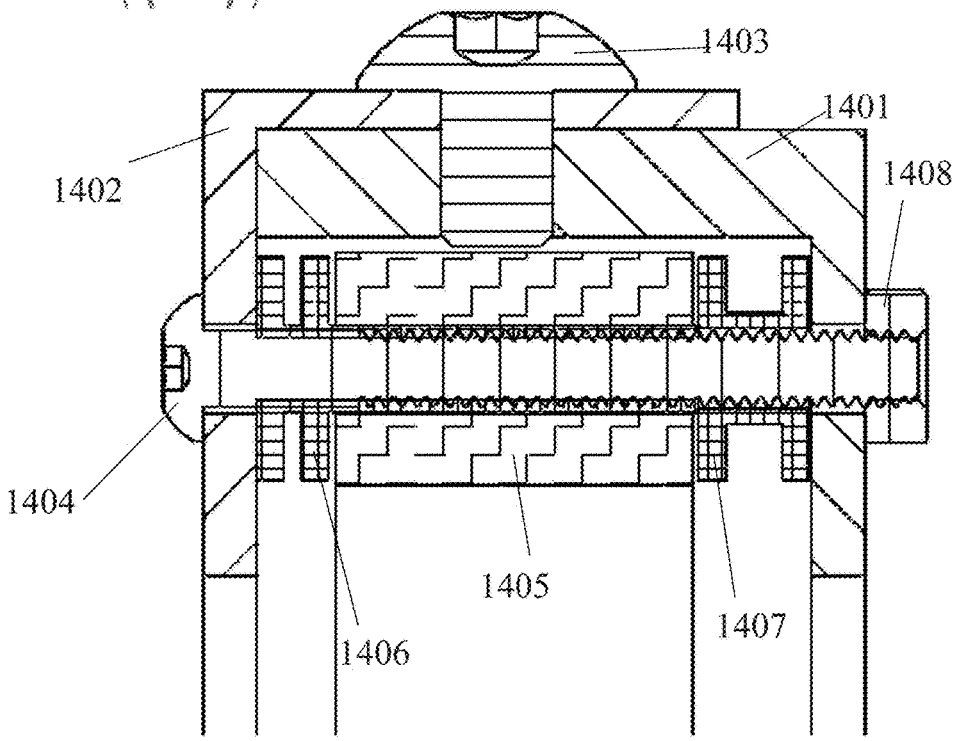
FIG. 99 is x-section A-A of FIG. 98 showing the inner frame, outer frame and isolator bolt assembly.
Figure 100:
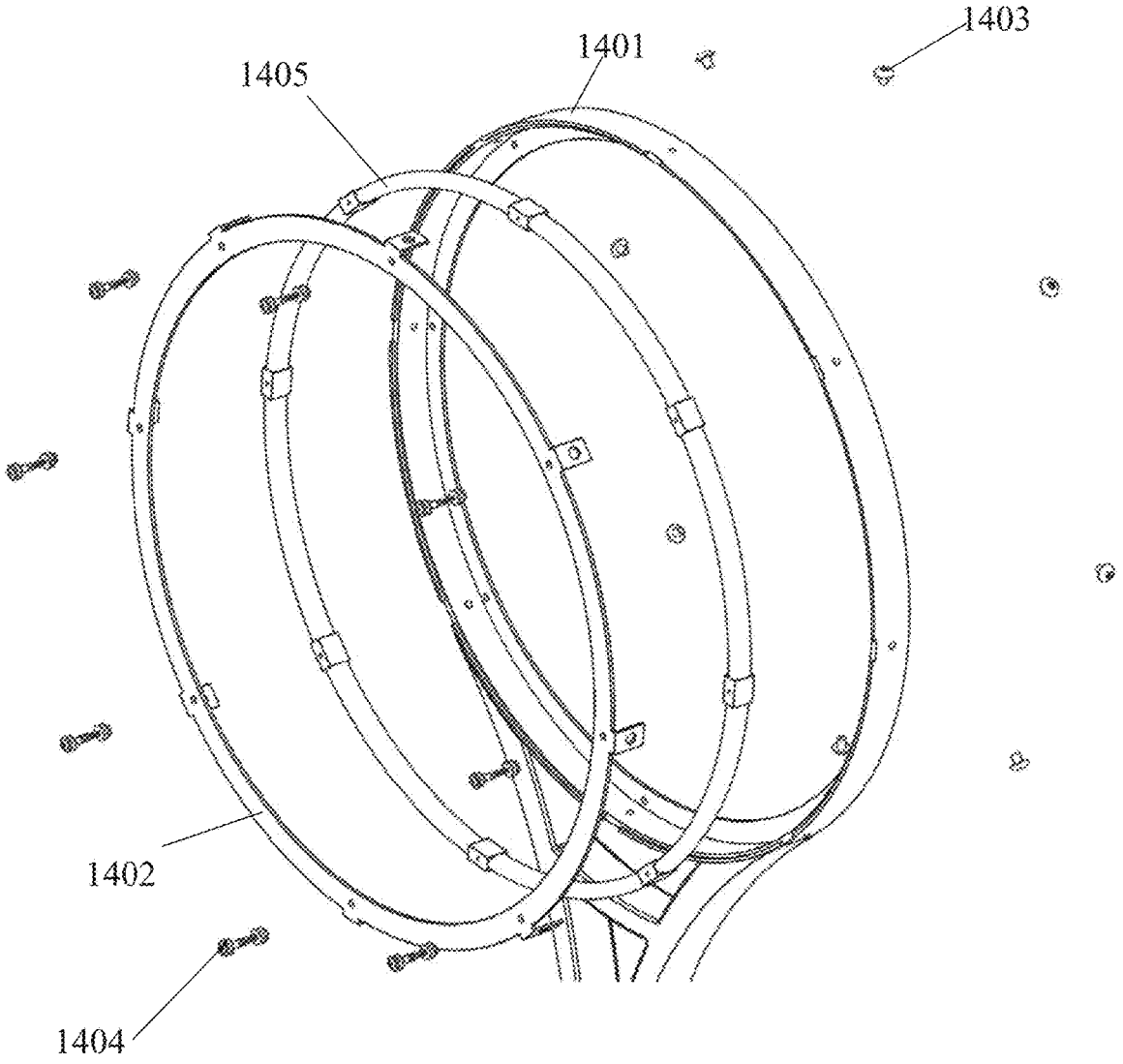
FIG. 100 shows an exploded view of FIG. 95.

FIGS. 95-100 are an example of a more detailed and manufacturable system that is assumed to incorporate the qualities of the generic system described earlier. A very brief review of this design is first presented, followed by a more complete explanation. FIG. 95 shows an iso view of the assembled embodiment with an Outer Frame 1401, a Cover Plate 1402, and a bolt style isolator system similar to that described in FIG. 88-94. FIGS. 95-100 show another construction of the outer frame that could adapt to a variety of isolator designs. Distinct from the C-shaped outer frame and Slotted Outer Frame described previously, this outer frame is a two piece construction. The first piece is L-Shaped 1401 while the second piece is a cover plate 1402. When fastened together, the two piece construction creates the C-shaped construction that allows the sway space for movement of the Inner Frame in the x-y plane. The removable face plate offers the obvious advantage of allowing the Inner Frame to be housed inside/hidden within the Outer Frame. Similar to the slotted frame described previously, this will reduce the radial thickness of the overall assembled racket.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A racquet comprising: an outer frame defined by a generally hoop shaped portion with a handle extending therefrom; an inner frame positionable within said outer frame having a string bed formed from a plurality of cross string elements and a plurality of main string elements; and a means for isolating and securing said inner frame to said outer frame constructed and arranged to allow for sway space deflection and to control overall in-plane stiffness between 30 lbs/in and 800 lbs/in and overall out-of-plane stiffness between 70 lbs/in and 600 lbs/in, said means for isolating and securing said inner frame to said outer frame provides a combined and coordinated out-of-plane stiffness of isolators with the string bed only out-of-plane stiffness, whose coordinated combined motion results in a nearly normal rebound of a tennis ball, independent of any ball impact eccentricity to a center of the string bed and is adjustable and combines out-of-plane stiffness, string bed stiffness, and in- plane stiffness to provide increased spin to a ball impacting said string bed wherein any specific isolator is adjusted, translational stiffness of two specific isolators, positioned diametrically opposite each other relative to a geometric center or center of mass of the inner frame, are adjusted using 66 significantly 3×-10× larger in-plane stiffness compared to other isolators, which in-plane perpendicular stiffness component of each diametrically opposite isolator is 3×-10× larger than any other isolator stiffness, thereby allowing a connection between the inner and outer frame to effectively move along a diameter direction in the plane of the inner frame, which said isolator adjustment allows the inner frame to achieve a spring-loaded in-plane rigid-body diametric- only motion relative to the outer frame.

2. The racquet according to claim 1 wherein an in-plane diametric direction can be in any direction, including a 3 o-clock to 9 o-clock direction, or a 1 o-clock to 7 o-clock, or any diametric clock direction.

3. The racquet according to claim 1 wherein in plane equivalent stiffness of all isolators, excluding the large-stiffness in-plane perpendicular direction of the diametrically opposite isolators, is adjusted to maximize ball rebound spin.

4. The racquet according to claim 1 wherein said inner frame is elliptical and said string bed is strung to minimize stresses in the inner frame according to an equation.

5. The racquet according to claim 1 wherein said inner frame is strung with tensions to minimize a weight of said inner frame by minimizing stresses in said inner frame according to an equation $$W_x=(a/b)^2W_y$$

$W_x$=cross strings load/unit length,
$W_y$=main strings load/unit length,
a=minor dimension, and
b=major dimension.

6. The racquet according to claim 1 wherein said inner frame moves in-plane relative to said outer frame to generate spin on a ball impacting said inner frame string bed.

7. The racquet according to claim 1 wherein said in-plane stiffness and said out-of-plane stiffness of said means for isolating and securing said inner frame to said outer frame are constructed and arranged to increase spin of a ball impacting the string bed at any racket stroke speed.

8. The tennis racquet according to claim 1 wherein said inner frame weighs between 20 grams and 200 grams.

9. The tennis racquet according to claim 1 wherein said means for isolating and securing said inner frame to said outer frame are interchangeable in size, quantity and type about a perimeter of said inner frame.

10. The racquet according to claim 1 wherein sway space deflection is between 0.01 inches and 1.5 inches in a XY plane.

11. The racquet according to claim 1 wherein sway space deflection is at any angle Theta-Z.

* * * * *